US009989877B2

(12) United States Patent
Tabata et al.

(10) Patent No.: US 9,989,877 B2
(45) Date of Patent: Jun. 5, 2018

(54) TRANSFER BELT AND IMAGE FORMATION APPARATUS

(71) Applicant: Konica Minolta, Inc., Tokyo (JP)

(72) Inventors: Eiji Tabata, Ibaraki (JP); Makiko Watanabe, Uji (JP); Nofumi Mizumoto, Nara (JP); Keiko Momotani, Ibaraki (JP); Shigeo Uetake, Higashiyamato (JP); Toshiya Natsuhara, Takarazuka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/712,433

(22) Filed: Sep. 22, 2017

(65) Prior Publication Data

US 2018/0095376 A1 Apr. 5, 2018

(30) Foreign Application Priority Data

Oct. 4, 2016 (JP) ..... 2016-196670
Oct. 4, 2016 (JP) ..... 2016-196671
Mar. 23, 2017 (JP) ..... 2017-056880

(51) Int. Cl.
*G03G 15/00* (2006.01)
*G03G 15/01* (2006.01)
*G03G 15/16* (2006.01)

(52) U.S. Cl.
CPC ..... *G03G 15/0163* (2013.01); *G03G 15/162* (2013.01); *G03G 15/1685* (2013.01); *G03G 15/1675* (2013.01); *G03G 15/5012* (2013.01); *G03G 2215/2009* (2013.01)

(58) Field of Classification Search
CPC . G03G 15/161; G03G 15/162; G03G 15/1685
See application file for complete search history.

(56) References Cited

U.S. PATENT DOCUMENTS

2003/0096130 A1* 5/2003 Kegasawa ..... G03G 7/0053 428/513
2014/0037315 A1* 2/2014 Tabata ..... G03G 21/0005 399/71

FOREIGN PATENT DOCUMENTS

JP 2014085633 A 5/2014
JP 2014102384 A 6/2014

* cited by examiner

*Primary Examiner* — Walter L Lindsay, Jr.
*Assistant Examiner* — Jessica L Eley
(74) *Attorney, Agent, or Firm* — Lucas & Mercanti, LLP

(57) ABSTRACT

A transfer belt transfers a toner image carried on a first main surface to a recording medium. When the transfer belt is pressed by using a lower block provided with a hole and an upper block with pressurization force increased at a prescribed rate and thereafter kept constant, E [-] and t0 are curve-fitted to a function $E=\alpha\times\exp(-t0/\tau)$ defined by a time constant $\tau$ [s] with respect to an amount of displacement of the transfer belt and a constant $\alpha$ [-], where E [-] is calculated as (a−b)/b, a [μm] represents a maximum value of an amount of displacement of a measurement region, b [μm] represents an amount of displacement of the measurement region after converged, and t0 [s] represents a time period from start of pressurization until the maximum pressurization force, and time constant $\tau$ satisfies a condition of $0.015\leq\tau\leq0.1$.

5 Claims, 53 Drawing Sheets

FIG.27

| | RESULT OF EVALUATION WITH DISPLACEMENT MEASUREMENT APPARATUS | | | | | RESULT OF EVALUATION OF IMAGE WITH ACTUAL MACHINE | |
|---|---|---|---|---|---|---|---|
| | BELT TYPE | TIME CONSTANT $\tau$ (sec) | E (—) | k1 ($\mu$m/s) | k2 ($\mu$m/s) | TRANSFERABILITY TO PAPER WITH IRREGULARITIES | PAPER SEPARABILITY |
| EXAMPLE 1 | A | 0.04 | 1.8 | 190 | 19 | EXCELLENT | GOOD |
| EXAMPLE 2 | B | 0.015 | 0.2 | 60 | 6 | EXCELLENT | GOOD |
| EXAMPLE 3 | C | 0.023 | 1.3 | 140 | 15 | EXCELLENT | GOOD |
| EXAMPLE 4 | D | 0.07 | 2 | 120 | 12 | EXCELLENT | GOOD |
| EXAMPLE 5 | E | 0.1 | 2 | 60 | 6 | EXCELLENT | SATISFACTORY |
| COMPARATIVE EXAMPLE 1 | F | 0.013 | 0.15 | 50 | 5 | FAILURE | GOOD |
| COMPARATIVE EXAMPLE 2 | G | 0.12 | 2 | 30 | 3 | GOOD | FAILURE |
| COMPARATIVE EXAMPLE 3 | X | 0.011 | 0.14 | 40 | 4.5 | FAILURE | GOOD |

FIG.34

| | RESULT OF EVALUATION WITH DISPLACEMENT AMOUNT MEASUREMENT APPARATUS | | RESULT OF EVALUATION WITH IMAGE FORMATION APPARATUS | |
|---|---|---|---|---|
| | BELT TYPE | TRANSIENT RESPONSE TIME PERIOD Tm(s) | NIP PRESSURIZATION DURATION Tnip(s) | TRANSFERABILITY TO PAPER WITH IRREGULARITIES |
| EXAMPLE 6 | A | 0.024 | 0.024 | GOOD |
| EXAMPLE 7 | A | 0.024 | 0.006 | SATISFACTORY |
| EXAMPLE 8 | A | 0.024 | 0.095 | SATISFACTORY |
| COMPARATIVE EXAMPLE 4 | A | 0.024 | 0.005 | FAILURE |
| COMPARATIVE EXAMPLE 5 | A | 0.024 | 0.098 | FAILURE |

FIG.35

| | RESULT OF EVALUATION WITH DISPLACEMENT AMOUNT MEASUREMENT APPARATUS | | RESULT OF EVALUATION WITH IMAGE FORMATION APPARATUS | |
|---|---|---|---|---|
| | BELT TYPE | TRANSIENT RESPONSE TIME PERIOD Tm(s) | NIP PRESSURIZATION DURATION Tnip(s) | TRANSFERABILITY TO PAPER WITH IRREGULARITIES |
| EXAMPLE 6 | A | 0.024 | 0.024 | GOOD |
| EXAMPLE 9 | B | 0.006 | 0.024 | SATISFACTORY |
| EXAMPLE 10 | C | 0.095 | 0.024 | SATISFACTORY |
| COMPARATIVE EXAMPLE 6 | D | 0.005 | 0.024 | FAILURE |
| COMPARATIVE EXAMPLE 7 | E | 0.099 | 0.024 | FAILURE |

FIG.57

| No. | PROCESS CONDITION | | | | BELT | | RESULT OF EVALUATION OF TRANSFERABILITY TO PAPER WITH IRREGULARITIES |
|---|---|---|---|---|---|---|---|
| | RADIUS OF OPPOSED ROLLER r [m] | DISTANCE OF TRAVEL FROM NIP ENTRY TO PEAK PRESSURE w [mm] | TORQUE APPLIED TO OPPOSED ROLLER T [N·m] | DURATION OF STAY IN PRESSURE FLAT REGION pt [msec] | tan δ | a·tan δ (a = 10.9) | |
| EXAMPLE 9 | 0.01 | 2.2 | 0.1 | 2.68 | 0.110 | 1.20 | GOOD |
| EXAMPLE 10 | 0.01 | 2.2 | 0.05 | 1.90 | 0.110 | 1.20 | GOOD |
| EXAMPLE 11 | 0.01 | 2.2 | 0.02 | 1.20 | 0.110 | 1.20 | GOOD |
| COMPARATIVE EXAMPLE 8 | 0.01 | 2.2 | 0.018 | 1.14 | 0.110 | 1.20 | POOR |
| COMPARATIVE EXAMPLE 9 | 0.01 | 2.2 | 0 | 0.00 | 0.110 | 1.20 | POOR |
| EXAMPLE 12 | 0.01 | 2.2 | 0.02 | 1.20 | 0.097 | 1.06 | GOOD |
| COMPARATIVE EXAMPLE 10 | 0.01 | 2.2 | 0.02 | 1.20 | 0.118 | 1.29 | POOR |
| EXAMPLE 13 | 0.014 | 2.4 | 0.12 | 2.59 | 0.110 | 1.20 | GOOD |
| EXAMPLE 14 | 0.014 | 2.4 | 0.06 | 1.83 | 0.110 | 1.20 | GOOD |
| EXAMPLE 15 | 0.014 | 2.4 | 0.026 | 1.21 | 0.110 | 1.20 | GOOD |
| COMPARATIVE EXAMPLE 11 | 0.014 | 2.4 | 0.022 | 1.11 | 0.110 | 1.20 | POOR |
| COMPARATIVE EXAMPLE 12 | 0.014 | 2.4 | 0 | 0.00 | 0.110 | 1.20 | POOR |
| EXAMPLE 16 | 0.014 | 2.4 | 0.026 | 1.21 | 0.097 | 1.06 | GOOD |
| COMPARATIVE EXAMPLE 13 | 0.014 | 2.4 | 0.026 | 1.21 | 0.118 | 1.29 | POOR |

FIG.58

| No. | PROCESS CONDITION | | | | BELT | | RESULT OF EVALUATION OF TRANSFERABILITY TO PAPER WITH IRREGULARITIES |
|---|---|---|---|---|---|---|---|
| | RADIUS OF OPPOSED ROLLER r [m] | DISTANCE OF TRAVEL FROM NIP ENTRY TO PEAK PRESSURE w [mm] | TORQUE APPLIED TO OPPOSED ROLLER T [N·m] | DURATION OF STAY IN PRESSURE FLAT REGION pt [msec] | Δt [msec] | k·Δt (k = 0.55) | |
| EXAMPLE 17 | 0.01 | 2.2 | 0.2 | 3.79 | 6.0 | 3.30 | GOOD |
| EXAMPLE 18 | 0.01 | 2.2 | 0.16 | 3.39 | 6.0 | 3.30 | GOOD |
| COMPARATIVE EXAMPLE 14 | 0.01 | 2.2 | 0.12 | 2.94 | 6.0 | 3.30 | POOR |
| COMPARATIVE EXAMPLE 15 | 0.01 | 2.2 | 0 | 0.00 | 6.0 | 3.30 | POOR |
| EXAMPLE 19 | 0.01 | 2.2 | 0.16 | 3.39 | 4.0 | 2.20 | GOOD |
| COMPARATIVE EXAMPLE 16 | 0.01 | 2.2 | 0.16 | 3.39 | 7.5 | 4.13 | POOR |
| EXAMPLE 20 | 0.014 | 2.4 | 0.24 | 3.67 | 6.0 | 3.30 | GOOD |
| EXAMPLE 21 | 0.014 | 2.4 | 0.2 | 3.35 | 6.0 | 3.30 | GOOD |
| COMPARATIVE EXAMPLE 17 | 0.014 | 2.4 | 0.14 | 2.80 | 6.0 | 3.30 | POOR |
| COMPARATIVE EXAMPLE 18 | 0.014 | 2.4 | 0 | 0.00 | 6.0 | 3.30 | POOR |
| EXAMPLE 22 | 0.014 | 2.4 | 0.2 | 3.35 | 4.0 | 2.20 | GOOD |
| COMPARATIVE EXAMPLE 19 | 0.014 | 2.4 | 0.2 | 3.35 | 7.5 | 4.13 | POOR |

TRANSFER BELT AND IMAGE FORMATION APPARATUS

Japanese Patent Applications Nos. 2016-196670 and 2016-196671 filed on Oct. 4, 2016 and Japanese Patent Application No. 2017-056880 filed on Mar. 23, 2017, including description, claims, drawings, and abstract the entire disclosure are incorporated herein by reference in its entirety.

BACKGROUND

Technological Field

The present invention relates to a transfer belt which transfers a carried toner image to a recording medium and an image formation apparatus including the same, and particularly to a transfer belt including an elastic layer and an image formation apparatus including the same.

Description of the Related Art

In general, in an image formation apparatus, a toner image formed on a surface of a photoconductor is transferred to a surface of a transfer belt in a primary transfer portion so that the toner image is carried on the transfer belt, and thereafter the toner image carried on the transfer belt is transferred to a recording medium such as paper in a secondary transfer portion.

Normally, in the secondary transfer portion, prescribed electric field is formed between a secondary transfer roller and an opposed roller which constitute a nip portion. With a function of the electric field, toner moves from the transfer belt which passes through the nip portion to the recording medium which similarly passes through the nip portion so that the toner image is transferred to the recording medium in the secondary transfer portion.

Various transfer belts have been proposed as transfer belts. A transfer belt including an elastic layer has been known as a transfer belt which allows transfer to a recording medium with irregularities in a recording surface (for example, embossed paper). For example, Japanese Laid-Open Patent Publications Nos. 2014-85633 and 2014-102384 disclose a transfer belt in which an elastic layer composed of acrylic rubber is provided on a base layer as a non-elastic layer composed of polyimide.

By using such a transfer belt with the elastic layer, when the transfer belt is pressed against the recording medium in the nip portion of the secondary transfer portion, the transfer belt deforms such that a part on a surface side of the transfer belt enters a recess located in a surface of the recording medium and a distance between a bottom surface of the recess in the recording medium and the surface of the transfer belt decreases. Thus, the function of the electric field is consequently promoted, toner more readily moves, and transferability to the recording medium with irregularities in the recording surface is improved.

SUMMARY

In order to achieve high transferability to a recording medium with a deeper recess in its surface even when a transfer belt having an elastic layer as described above is employed, the elastic layer provided in the transfer belt should be greater in thickness or lower in hardness.

When a transfer belt constructed as such is employed as an intermediate transfer belt of an image formation apparatus, however, a recording medium is not separated from the intermediate transfer belt at an exit of a transfer nip and a new problem of jamming occurs.

Therefore, the present invention was made to solve the above-described problems and an object thereof is to provide a transfer belt which can achieve high transferability also to a recording medium with surface irregularities and suppressed occurrence of jamming of the recording medium and an image formation apparatus including the same.

The present inventor has manufactured various belts each including an elastic layer and conducted studies. The present inventor has consequently found that only when a belt which is displaced with its surface exhibiting a prescribed characteristic behavior at the time of pressurization under a prescribed pressurization condition is employed as a transfer belt, high transferability also to a recording medium with surface irregularities is ensured while separability from the transfer belt of the recording medium which is difficult to be separated from the transfer belt such as paper of a small thickness or highly tacky paper can be ensured, and completed the present invention. Whether or not a belt is displaced with its surface exhibiting a prescribed characteristic behavior at the time of pressurization under a prescribed pressurization condition can be evaluated with a method of evaluation with a displacement amount measurement apparatus which has been invented by the present inventor and will be described later.

In order to achieve at least one of the above-described objects, a transfer belt reflecting one aspect of the present invention includes an elastic layer and serves to transfer a toner image carried on a first main surface which is one of a pair of exposed main surfaces including the first main surface and a second main surface located opposite to each other to a recording medium. When a pressurized region which is a part of the transfer belt is pressurized with pressurization force reaching 200 [kPa] at a predetermined rate of pressurization [kPa/ms] and thereafter being maintained constant at 200 [kPa] by using a lower block having a projecting curved surface having a width of 20 [min] and a radius of curvature of 20 [mm] as an upper surface and provided with a hole having a diameter of 1.25 [mm] in a top portion of the projecting curved surface and an upper block having a recessed curved surface having a width of 20 [mm] and a radius of curvature of 20.3 [mm] as a lower surface, placing the transfer belt on the upper surface of the lower block such that the first main surface faces the upper surface of the lower block, and sandwiching the part of the transfer belt between the projecting curved surface and the recessed curved surface by lowering the upper block toward the lower block, the transfer belt satisfies such a condition that E [-] calculated as (a−b)/b and t0 are curve-fitted to an exponential function expressed as $E=\alpha\times\exp(-t0/\tau)$ defined by a time constant $\tau$ [s] with respect to an amount of displacement of the transfer belt and a constant $\alpha$ [-], where a [μm] represents a maximum value of an amount of displacement of a measurement region which is a portion in the first main surface corresponding to the hole, b [μm] represents an amount of displacement of the measurement region after convergence of displacement of the measurement region, and t0 [s] represents a time period from a time point of start of pressurization against the pressurized region until a time point when the pressurization force reaches 200 [kPa], and the time constant $\tau$ satisfies a condition of $0.015\leq\tau\leq0.1$.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 27 is a table showing results of evaluation of belts and results of evaluation of images in Examples.

FIG. 34 is a table showing a result of checking of transferability to embossed paper (transferability to paper with irregularities) of the intermediate transfer belt with a nip pressurization duration Tnip [s] being varied for a belt type A of which transient response time period Tm [s] is set to 0.024 [s].

FIG. 35 is a table showing a result of checking of transferability to embossed paper (transferability to paper with irregularities) of the intermediate transfer belt with nip pressurization duration Tnip [s] being set to 0.024 [s] for various intermediate transfer belts different in transient response time period Tm [s].

FIG. 57 is a diagram showing conditions and results in a first verification experiment.

FIG. 58 is a diagram showing conditions and results in a second verification experiment.

DETAILED DESCRIPTION OF EMBODIMENTS

Hereinafter, one or more embodiments of the present invention will be described with reference to the drawings. However, the scope of the invention is not limited to the disclosed embodiments.

Embodiment 1

<Image Formation Apparatus>

Figure 1:
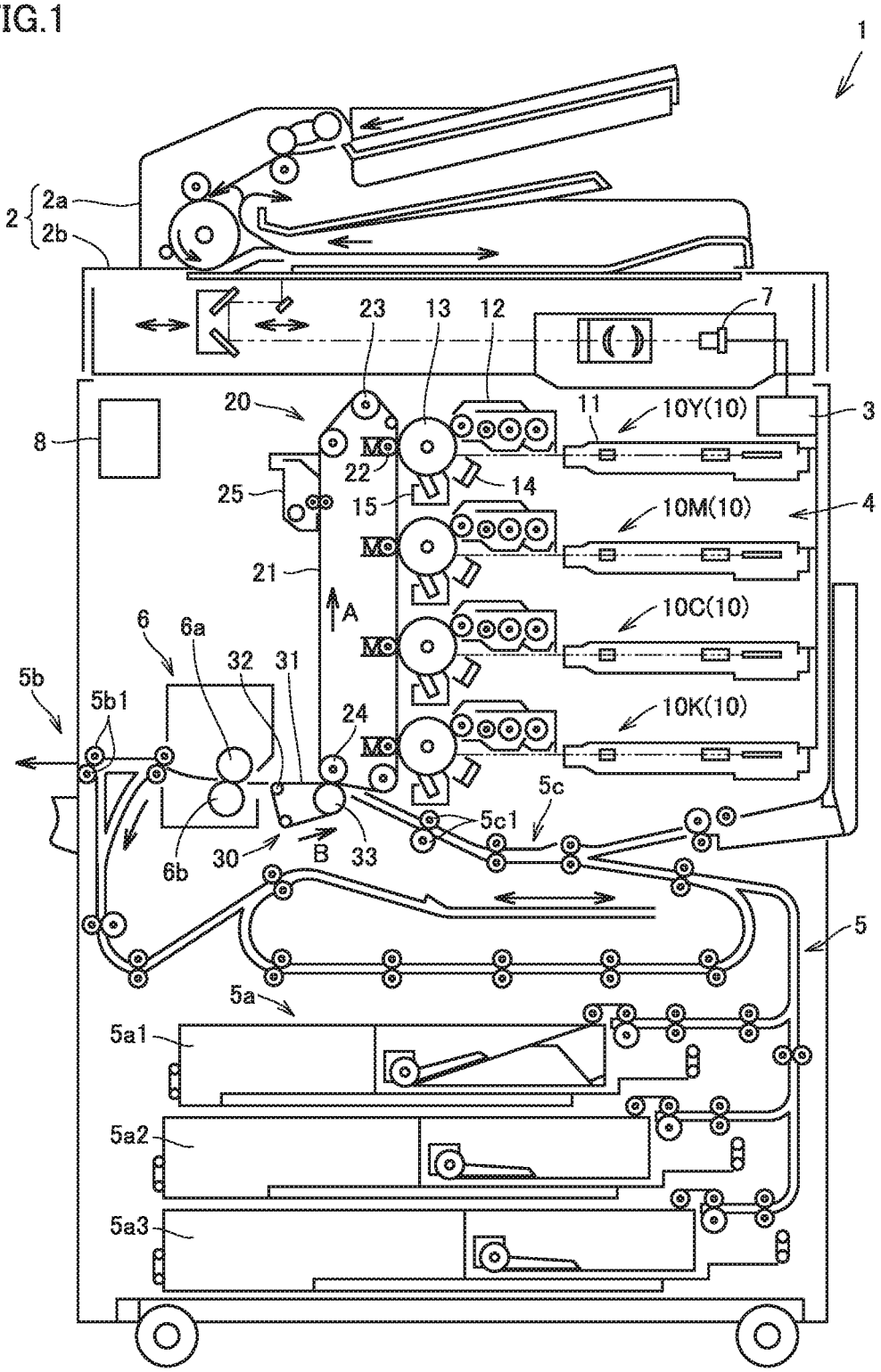
FIG. 1 is a schematic diagram of an image formation apparatus in Embodiment 1 of the present invention.

FIG. 1 is a schematic diagram of an image formation apparatus in Embodiment 1 of the present invention. An image formation apparatus 1 in the present embodiment will initially be described with reference to FIG. 1. Image formation apparatus 1 in the present embodiment is what is called a digital multi-function peripheral.

As shown in FIG. 1, image formation apparatus 1 includes an image reading portion 2, an image processing portion 3, an image formation portion 4, a paper transportation portion 5, and a fixation apparatus 6.

Image reading portion 2 has an automatic document feed apparatus 2*a* and a document image scanning apparatus 2*b* (scanner). Document image scanning apparatus 2*b* is provided with contact glass, various lens systems, and a CCD sensor 7. CCD sensor 7 is connected to image processing portion 3. Image processing portion 3 performs prescribed image processing on an input image.

Image formation portion 4 has an image formation unit 10 (10Y, 10M 10C, and 10K) which forms an image with toner of a color of each of yellow (Y), magenta (M), cyan (C), and black (K). Since the image formation units are identical in construction other than stored toner, a sign representing a color will not be provided hereafter. Image formation portion 4 further has an intermediate transfer unit 20 and a secondary transfer unit 30.

Image formation unit 10 has an exposure apparatus 11, a development apparatus 12, a photoconductor drum 13, a charging apparatus 14, and a drum cleaning apparatus 15. A surface of photoconductor drum 13 is photoconductive and the photoconductor drum is implemented, for example, by a negatively charged organic photoconductor. Photoconductor drum 13 is an image carrier which carries a toner image.

Charging apparatus 14 is implemented, for example, by a corona charger, however, it may be a contact charging apparatus which charges photoconductor drum 13 by bringing a contact charging member such as a charging roller, a charging brush, or a charging blade into contact therewith. Exposure apparatus 11 is implemented, for example, by semiconductor laser.

Development apparatus 12 is implemented, for example, by a two-component development type development apparatus, however, it may be implemented by a one-component development type development apparatus free from a carrier.

Intermediate transfer unit 20 has an intermediate transfer belt 21, a primary transfer roller 22 which brings intermediate transfer belt 21 in pressure contact with photoconductor drum 13, a plurality of support rollers 23 including an opposed roller 24, and a belt cleaning apparatus 25. Intermediate transfer belt 21 is an endless transfer belt. Primary transfer roller 22 mainly implements a primary transfer portion which transfers a toner image carried on photoconductor drum 13 to intermediate transfer belt 21.

Intermediate transfer belt 21 is looped around the plurality of support rollers 23 and it is movable. As a drive roller of at least one of the plurality of support rollers 23 rotates, intermediate transfer belt 21 runs at a constant speed in a direction shown with an arrow A.

Secondary transfer unit 30 has an endless secondary transfer belt 31 and a plurality of support rollers 32 including a secondary transfer roller 33. Secondary transfer belt 31 is looped around secondary transfer roller 33 and support rollers 32. As a drive roller of at least one of the plurality of support rollers 32 rotates, secondary transfer belt 31 runs in a direction shown with an arrow B. Secondary transfer roller 33 and opposed roller 24 mainly implement a secondary transfer portion which transfers a toner image carried on intermediate transfer belt 21 to a recording medium.

Fixation apparatus 6 serves to fix a toner image transferred to paper as a recording medium onto the paper, and has a fixation roller 6*a* which heats and melts toner on the paper and a pressurization roller 6*b* which presses the paper against fixation roller 6*a*.

Paper transportation portion 5 has a paper feed portion 5*a*, a paper ejection portion 5*b*, and a transportation path portion 5*c*. Paper feed tray units 5*a*1 to 5*a*3 which constitute paper feed portion 5*a* store paper identified based on a grammage or a size for each type set in advance. Transportation path portion 5*c* has a plurality of transportation roller pairs such as a registration roller pair 5*c*1. Paper ejection portion 5*b* is implemented by a paper ejection roller 5*b*1.

A speed of transportation of paper in transportation path portion 5*c* is determined by a control unit 8.

Transportation path portion 5*c* includes a motor, a motor driver, and a gear in addition to secondary transfer belt 31 and the plurality of transportation roller pairs described above. The plurality of transportation roller pairs, the motor, the motor driver, and the gear transport paper as various motors are rotated upon receiving an electric signal from control unit 8.

Examples of members rotated by the various motors described above include a development roller included in development apparatus 12, photoconductor drum 13, intermediate transfer belt 21, secondary transfer roller 33, fixation roller 6*a*, and the transportation roller pairs described above. These members may be driven collectively by one motor or separately by a plurality of motors. An outer circumferential surface of each of these members is preferably driven at the same linear velocity (which is generally referred to as a system speed). Control unit 8 can change a system speed by changing a speed of the various motors or a gear.

Though the present embodiment exemplifies an example in which a transportation belt and a transportation belt drive mechanism driving the same are employed as means for transporting paper between the secondary transfer portion and fixation apparatus 6, any means is applicable as the means so long as it is capable of transporting paper from the secondary transfer portion to fixation apparatus 6. For example, a transportation roller pair which transports paper and a transportation roller pair drive mechanism which drives the same without using a belt may implement the means, or secondary transfer roller 33 and opposed roller 24 and a roller drive mechanism which drives the same may implement the means such that paper is transported directly to fixation apparatus 6 by secondary transfer roller 33 and opposed roller 24.

Processing for forming an image by image formation apparatus 1 will now be described. Document image scanning apparatus 2*b* reads a document on the contact glass through optical scanning Light reflected from the document is read by CCD sensor 7 and converted to input image data. Input image data is subjected to prescribed image processing by image processing portion 3 and sent to exposure apparatus 11. Input image data may be sent from an external personal computer or a mobile device to image formation apparatus 1.

Photoconductor drum 13 rotates at a constant peripheral speed. Charging apparatus 14 uniformly negatively charges the surface of photoconductor drum 13. Exposure apparatus 11 emits laser beams corresponding to input image data of each color component to photoconductor drum 13 and forms an electrostatic latent image on the surface of photoconductor drum 13. Development apparatus 12 has toner adhere to the surface of photoconductor drum 13 and visualizes the electrostatic latent image on photoconductor drum 13. A toner image in accordance with the electrostatic latent image is thus formed on the surface of photoconductor drum 13.

The toner image on the surface of photoconductor drum 13 is transferred to intermediate transfer belt 21 by intermediate transfer unit 20. Transfer residual toner which remains on the surface of photoconductor drum 13 after transfer is removed by drum cleaning apparatus 15 having a drum cleaning blade which comes in sliding contact with the surface of photoconductor drum 13. As intermediate transfer belt 21 is brought in pressure contact with photoconductor drum 13 by primary transfer roller 22, toner images of respective colors are successively transferred to intermediate transfer belt 21 as being superimposed on one another.

Secondary transfer roller 33 is brought in pressure contact with opposed roller 24 with intermediate transfer belt 21 and secondary transfer belt 31 being interposed. A transfer nip is thus formed. Paper is transported to the transfer nip by paper transportation portion 5 and passes through the transfer nip. A registration roller portion provided with registration roller pair 5*c*1 corrects a lean of paper and adjusts timing of transportation.

As paper is transported to the transfer nip, a prescribed voltage is applied to secondary transfer roller 33. As the voltage is applied, a toner image carried on intermediate transfer belt 21 is transferred to paper. Transfer residual toner which remains on the surface of intermediate transfer belt 21 is removed by belt cleaning apparatus 25 having a belt cleaning blade which comes in sliding contact with the surface of intermediate transfer belt 21. A cleaning apparatus which adopts brush cleaning may be adopted as belt cleaning apparatus 25 so long as it cleans residual toner on intermediate transfer belt 21. When toner high in transfer ratio is employed, a form without using a cleaning apparatus is also applicable. Paper to which the toner image has been transferred is transported toward fixation apparatus 6 by secondary transfer belt 31.

A construction in which a secondary transfer roller is in direct contact with paper without using the secondary transfer portion may also be applicable. In this case, paper to which a toner image has been transferred is sent toward fixation apparatus 6 as secondary transfer belt 31 rotates.

Fixation apparatus 6 heats and pressurizes transported paper to which the toner image has been transferred in a nip portion. The toner image is thus fixed to the paper. The paper having the toner image fixed is ejected out of the apparatus by paper ejection portion 5*b* including paper ejection roller 5*b*1.

Toner is prepared by containing a coloring agent or a charge control agent or a release agent as necessary in a binder resin followed by treatment with an external additive, and generally used known toner can be employed. Toner has a volume average particle size preferably within a range not smaller than 2 [μm] and not greater than 12 [μm] and more preferably within a range not smaller than 3 [μm] and not greater than 9 [μm] in terms of image quality.

Though toner has a shape factor SF-1 preferably from 100 to 140, limitation to this range is not necessarily intended.

Shape factor SF-1 is found by randomly scanning 100 pieces of toner imaged with a scanning electron microscope at 5000× with a scanner, analyzing the toner with an image processing analyzer "Luzex AP" (manufactured by Nireco Corporation), and calculating an average value of a shape factor (SF-1) derived from an expression below:

$$\text{SF-1}=[\{(\text{absolute maximum length of particle})^2/(\text{area of projection of particle})\}\times(\pi/4)]\times 100.$$

Fine particles of a metal oxide such as silica or titania are employed as an external additive for toner and particles from a small size such as 30 [nm] to a relatively great size such as 100 [nm] are employed. For the purpose of powder fluidity and charge control, inorganic fine particles having an average primary particle size not greater than 40 [nm] may be employed. As necessary, in order to lower adhesion force, inorganic or organic fine particles greater in size may also be used together. Examples of inorganic fine particles include, in addition to silica or titania, alumina, metatitanate, zinc oxide, zirconia, magnesia, calcium carbonate, magnesium carbonate, calcium phosphate, cerium oxide, and strontium titanate. In order to enhance dispersibility or powder fluidity, surface treatment of inorganic fine particles may separately be performed.

A carrier is not particularly limited and a generally used known carrier such as a binder carrier or a coating carrier can be used. Though a particle size of the carrier is not limited, it is preferably not smaller than 15 [μm] and not greater than 100 [μm].

<Intermediate Transfer Belt>

Figure 2:
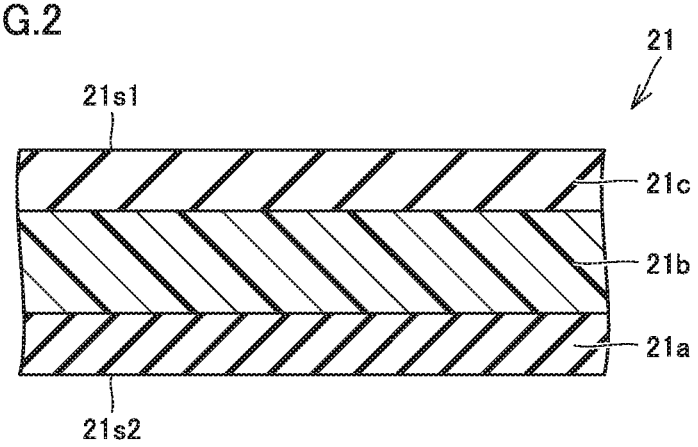
FIG. 2 is a cross-sectional view of an intermediate transfer belt shown in FIG. 1.

FIG. 2 is a cross-sectional view of the intermediate transfer belt shown in FIG. 1. A construction of intermediate transfer belt 21 will now be described with reference to FIG. 2.

As shown in FIG. 2, intermediate transfer belt 21 is formed from a member having a first main surface 21*s*1 and a second main surface 21*s*2 which are a pair of exposed main surfaces located opposite to each other, and includes a base layer 21*a*, an elastic layer 21*b*, and a surface layer 21*c*.

Elastic layer 21*b* is provided to cover base layer 21*a* and surface layer 21*c* is provided to cover elastic layer 21*b*. Thus, first main surface 21*s*1 described above is defined by surface layer 21*c* and second main surface 21*s*2 described above is defined by base layer 21*a*.

Intermediate transfer belt 21 serves to transfer a toner image carried as described above to a recording medium such as paper and the toner image is carried on first main surface 21*s*1 described above.

Base layer 21*a* is a layer for enhancing mechanical strength of intermediate transfer belt 21 as a whole, and formed from a layer composed, for example, of an organic polymeric compound. Examples of organic polymeric compounds of which base layer 21*a* is composed include polycarbonate, a fluorine-based resin, a styrene-based resin such as polystyrene, chloropolystyrene, poly-α-methylstyrene, a styrene-butadiene copolymer, a styrene-vinyl chloride copolymer, a styrene-vinyl acetate copolymer, a styrene-maleic acid copolymer, a styrene-acrylic acid ester copolymer (a styrene-methyl acrylate copolymer, a styrene-ethyl acrylate copolymer, a styrene-butyl acrylate copolymer, a styrene-octyl acrylate copolymer, and a styrene-phenyl acrylate copolymer), a styrene-methacrylic acid ester copolymer (a styrene-methyl methacrylate copolymer, a styrene-ethyl methacrylate copolymer, and a styrene-phenyl methacrylate copolymer), a styrene-a-methyl chloroacrylate copolymer, and a styrene-acrylonitrile-acrylic acid ester copolymer (a homopolymer or a copolymer containing styrene or a styrene substitute), a methyl methacrylate resin, a butyl methacrylate resin, an ethyl acrylate resin, a butyl acrylate resin, a modified acrylic resin (a silicone modified acrylic resin, a vinyl chloride resin modified acrylic resin, and an acrylic-urethane resin), a vinyl chloride resin, a vinyl chloride-vinyl acetate copolymer, a rosin modified maleic acid resin, a phenol resin, an epoxy resin, a polyester resin, a polyester polyurethane resin, polyethylene, polypropylene, polybutadiene, polyvinylidene chloride, an ionomer resin, a polyurethane resin, a silicone resin, a ketone resin, an ethylene-ethyl acrylate copolymer, a xylene resin and a polyvinyl butyral resin, a polyamide resin, a polyimide resin, a modified polyphenylene oxide resin, modified polycarbonate, and a mixture thereof. Base layer 21 may be constituted of a plurality of layers different in material.

A conductive agent may be added to base layer 21*a* for adjustment of a resistance value. Only one type of a conductive agent or a plurality of types of conductive agents may be added. Though a content of the conductive agent in base layer 21*a* is preferably not less than 0.1 part by weight and not more than 20 parts by weight with respect to 100 parts by weight of a material for the base layer, limitation thereto is not intended.

Elastic layer 21*b* is a layer for providing elasticity to intermediate transfer belt 21 and it is formed, for example, from a layer composed of an organic compound exhibiting viscoelasticity. Examples of organic compounds of which elastic layer 21*b* is composed include butyl rubber, fluorine-based rubber, acrylic rubber, ethylene propylene diene rubber (EPDM), nitrile butadiene rubber (NBR), acrylonitrile butadiene styrene rubber, natural rubber, isoprene rubber, styrene-butadiene rubber, butadiene rubber, ethylene-propylene rubber, an ethylene-propylene terpolymer, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber, thermoplastic elastomer (for example, polystyrene based, polyolefin based, polyvinyl chloride based, polyurethane based, polyamide based, polyurea, polyester based, and fluorine resin based), and a mixture thereof. Elastic layer 21*b* may be constituted of a plurality of layers different in material.

A conductive agent for exhibiting conductivity may be added to elastic layer 21*b*. Only one type of a conductive agent or a plurality of types of conductive agents may be added. Though a content of the conductive agent in elastic layer 21*b* is preferably not less than 0.1 part by weight and not more than 30 parts by weight with respect to 100 parts by weight of a material for the elastic layer, limitation thereto is not intended. A total content of the conductive agent in elastic layer 21*b* is set to an amount which can achieve a desired volume resistivity of intermediate transfer belt 21, and a volume resistivity of intermediate transfer belt 21 is, for example, not lower than $10^8$ [Ω-cm] and not higher than $10^{12}$ [Ω-cm].

The conductive agent described above includes an ionic conductive agent and an electronic conductive agent. Examples of the ion conductive agent include silver iodide, copper iodide, lithium perchlorate, lithium trifluoromethanesulfonate, lithium salt of an organic boron complex, lithium bis(imide) ($(CF_3SO_2)_2NLi$), and lithium tris(methide) ($(CF_3SO_2)_3CLi$). Examples of the electronic conductive agent include a metal such as silver, copper, aluminum, magnesium, nickel, and stainless steel and a carbon compound such as graphite, carbon black, carbon nanofibers, and carbon nanotubes.

In addition to the conductive agent described above, elastic layer 21*b* may contain a resin in a form of a non-fiber and a resin in a form of a fiber.

Examples of the resin in the form of the non-fiber include a thermosetting resin such as a phenol resin, a thermosetting urethane resin, an epoxy resin, and a reactive monomer and a thermoplastic resin such as polyvinyl chloride, polyvinyl acetate, and thermoplastic urethane. Though a content of the resin in the form of the non-fiber with respect to a material for the elastic layer in elastic layer 21*b* is preferably not less than 20 parts by weight and not more than 60 parts by weight with respect to 100 parts by weight of the material for the elastic layer, limitation thereto is not intended.

Examples of the resin in the form of the fiber include cotton, hemp, silk, and a resin-based fiber such as rayon, acetate, nylon, acrylic, vinylon, vinylidene, polyester, polystyrene, polypropylene, and aramid. Though a content of the resin in the form of the fiber in elastic layer 21*b* is preferably not less than 10 parts by weight and not more than 40 parts by weight with respect to 100 parts by weight of the material for the elastic layer, limitation thereto is not intended.

A commonly used additive such as a vulcanizing agent, a vulcanization accelerator, a vulcanization aid, a co-cross-linking agent, a softener, and a plasticizer may further be contained in elastic layer 21*b*. A single additive alone may be added or two or more of the additives may be added as being combined.

For example, sulfur, an organic sulfur-containing compound, and an organic peroxide can be employed as a vulcanizing agent.

Examples of the co-cross-linking agent include ethylene glycol dimethacrylate, trimethylolpropane dimethacrylate, a polyfunctional methacrylate monomer, triallyl isocyanurate, and a metal containing monomer as a co-cross-linking agent composed of an organic peroxide. Though an amount of addition of the co-cross-linking agent in elastic layer 21*b* is preferably not more than 5 parts by weight with respect to 100 parts by weight of the material for the elastic layer, limitation thereto is not intended.

A material for surface layer 21*c* is not particularly restricted, however, a material which enhances transferability by lowering adhesion force of toner to intermediate transfer belt 21 is preferred. From such a point of view, for example, a material obtained by dispersing one type or two or more types of powders or particles of a fluorine resin, a fluorine compound, carbon fluoride, titanium dioxide, and silicon carbide in a base material composed of polyurethane, polyester, an epoxy resin, or a mixture thereof can be employed as surface layer 21*c*. A surface of elastic layer 21*b* may be reformed to define surface layer 21*c*.

These powders and particles are materials for lowering surface energy of first main surface 21*s*1 and enhancing lubricity, and a dispersion in which powders and particles different in size are dispersed can also be employed. Surface energy of first main surface 21*s*1 may be lowered by forming a fluorine-rich layer on the surface by employing a fluorine based rubber material and performing heat treatment.

Base layer 21*a* is higher in hardness than elastic layer 21*b*. As elastic layer 21*b* is supported by base layer 21*a* which is less likely to deform than elastic layer 21*b*, elastic layer 21*b* is less likely to deform toward second main surface 21*s*2, and instead, it is more likely to deform toward first main surface 21*s*1. A hardness of base layer 21*a* and elastic layer 21*b* can be measured with a micro durometer (for example, MD-1 manufactured by Kobunshi Keiki Co., Ltd.).

Surface layer 21*c* is higher in hardness than elastic layer 21*b*. Surface layer 21*c* harder than elastic layer 21*b* can be formed by using a photocurable resin, applying an uncured resin to a surface of elastic layer 21*b*, and curing the resin with ultraviolet rays. Alternatively, surface layer 21*c* harder than elastic layer 21*b* can also be formed through reforming treatment such as hardening treatment of a portion around a surface of elastic layer 21*b*

Surface layer 21*c* does not necessarily have to be provided, and intermediate transfer belt 21 can also consist of base layer 21*a* and elastic layer 21*b*. Intermediate transfer belt 21 may consist of elastic layer 21*b* without providing base layer 21*a*. Alternatively, in addition to base layer 21*a*, elastic layer 21*b*, and surface layer 21*c* described above, another layer can further be added to form multi-layered intermediate transfer belt 21 constituted of four or more layers.

First main surface 21*s*1 of intermediate transfer belt 21 has a ten point height of roughness profile Rz preferably not smaller than 0.5 [μm] and not greater than 9.0 [μm] and more preferably not smaller than 3.0 [μ] and not greater than 6.0 [μm]. When ten point height of roughness profile Rz is smaller than 0.5 [μm], intimate contact with a contact member is concerned. When ten point height of roughness profile Rz is greater than 9.0 [μm], toner and paper dust tend to accumulate in irregularities and quality of an image may lower. Ten point height of roughness profile Rz refers to surface roughness defined under JIS B0601 (2001).

Intermediate transfer belt 21 in the present embodiment is displaced such that a part of a surface thereof (that is, first main surface 21*s*1) exhibits a prescribed characteristic behavior when it is evaluated based on a method of evaluation with a displacement amount measurement apparatus which will be described later, and details thereof will be described later.

<Construction of Secondary Transfer Portion>

Figure 3:
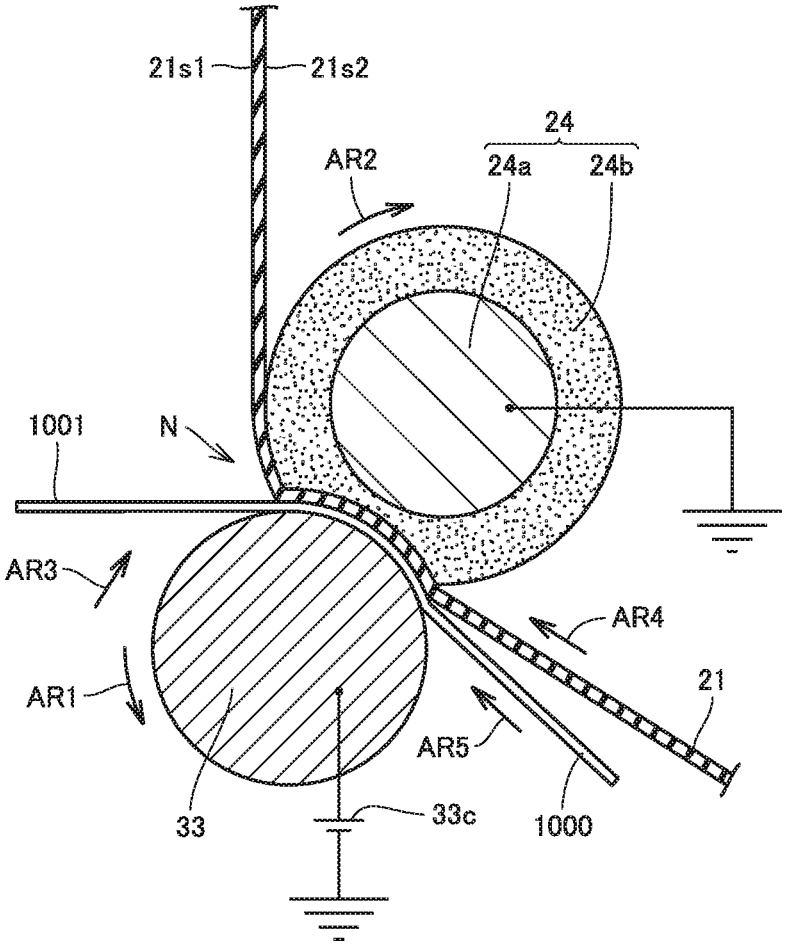
FIG. 3 is a schematic diagram of a secondary transfer portion shown in FIG. 1.

FIG. 3 is a schematic diagram of the secondary transfer portion shown in FIG. 1. A detailed construction of the secondary transfer portion will now be described with reference to FIG. 3. FIG. 3 does not show secondary transfer belt 31.

As shown in FIG. 3, intermediate transfer belt 21 is arranged to pass through the secondary transfer portion of image formation apparatus 1.

The secondary transfer portion includes secondary transfer roller 33 and opposed roller 24 which are arranged in parallel as being opposed to each other. A nip portion N is formed between secondary transfer roller 33 and opposed roller 24. Intermediate transfer belt 21 is arranged as being inserted through nip portion N and a recording medium 1000 such as paper is supplied similarly to also pass through nip portion N.

Secondary transfer roller 33 is composed of a conductive material and a secondary transfer power supply 33*c* is connected to secondary transfer roller 33. Opposed roller 24 includes a core 24*a* composed of a conductive material and a conductive elastic portion 24*b* which covers a circumferential surface of core 24*a*. Core 24*a* is grounded. Prescribed electric field is thus formed in nip portion N by secondary transfer roller 33, opposed roller 24, and secondary transfer power supply 33*c*.

Intermediate transfer belt 21 is arranged to pass on a side of opposed roller 24 relative to recording medium 1000 and recording medium 1000 is supplied to pass on a side of secondary transfer roller 33 relative to intermediate transfer belt 21. Intermediate transfer belt 21 is arranged such that first main surface 21*s*1 faces recording medium 1000 (that is, secondary transfer roller 33) and second main surface 21*s*2 faces opposed roller 24.

First main surface 21*s*1 of intermediate transfer belt 21 is thus arranged to face a recording surface 1001 of recording medium 1000 in nip portion N.

Secondary transfer roller 33 is rotationally driven in a direction shown with an arrow AR1 in the figure and opposed roller 24 is rotationally driven in a direction shown with an arrow AR2 in the figure. Secondary transfer roller 33 is pressed by a not-shown pressing mechanism in a direction shown with an arrow AR3 in the figure in transfer of a toner image, so that secondary transfer roller 33 and opposed roller 24 are brought in pressure contact with each other with secondary transfer belt 31 (see FIG. 1), intermediate transfer belt 21, and recording medium 1000 being interposed.

Intermediate transfer belt 21 and recording medium 1000 are transported in a direction shown with an arrow AR4 and a direction shown with an arrow AR5 in the figure based on rotation of secondary transfer roller 33 and rotation of opposed roller 24, respectively. In passage through nip portion N, intermediate transfer belt 21 and recording medium 1000 are in intimate contact with each other as being sandwiched between secondary transfer roller 33 and opposed roller 24 in a pressurized state. Prescribed electric field described above is applied to intermediate transfer belt 21 and recording medium 1000 in the portion of intimate contact. Toner which has adhered to first main surface 21*s*1 of intermediate transfer belt 21 thus adheres to recording surface 1001 of recording medium 1000 so that a toner image is transferred.

Since the surface of secondary transfer roller 33 is higher in hardness than the surface of opposed roller 24, intermediate transfer belt 21 and recording medium 1000 in the portion sandwiched between secondary transfer roller 33 and opposed roller 24 is curved along the surface of secondary transfer roller 33. Therefore, a recessed curved surface which extends along an axial direction of secondary transfer roller 33 is formed on first main surface 21*s*1 of intermediate transfer belt 21 and a toner image is transferred in this portion. A hardness of the surface of secondary transfer roller 33 and opposed roller 24 can be measured with a micro durometer (for example, MD-1 manufactured by Kobunshi Keiki Co., Ltd.).

A pressure is applied to intermediate transfer belt 21 in the secondary transfer portion and the primary transfer portion described above. As intermediate transfer belt 21 deforms as a result of application of the pressure, an area of contact between first main surface 21*s*1 and toner increases and adhesion force between toner and intermediate transfer belt 21 increases. Intermediate transfer belt 21, however, has hard surface layer 21*c* and first main surface 21*s*1 of intermediate transfer belt 21 is high in hardness. Therefore, even when a pressure is applied, first main surface 21*s*1 is less likely to deform, or even though first main surface 21*s*1 deforms, it tends to quickly return to the original state. Therefore, increase in area of contact between first main surface 21*s*1 and toner is suppressed and increase in adhesion force between toner and intermediate transfer belt 21 is suppressed. A toner image can thus more reliably be transferred.

<Secondary Transfer Portion in Comparative Example>

Figure 4:
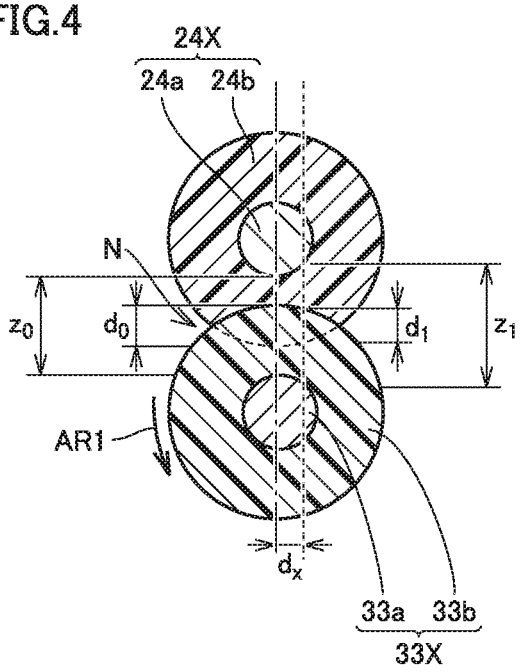
FIG. 4 is a diagram showing a secondary transfer portion in a comparative example.

FIG. 4 is a diagram showing a secondary transfer portion in a comparative example. The secondary transfer portion in the comparative example will be described with reference to FIG. 4.

As shown in FIG. 4, the secondary transfer portion in the comparative example includes an opposed roller 24X, a secondary transfer roller 33X, and nip portion N.

Opposed roller 24X has core 24*a* and elastic portion 24*b* which covers a circumferential surface of core 24*a*. For example, silicone rubber is used for elastic portion 24*b*. Opposed roller 24X is provided to rotate as following rotation of secondary transfer roller 33X. No rotational torque is externally directly applied to opposed roller 24X.

Secondary transfer roller 33X has a core 33*a* and an elastic portion 33*b*. For example, silicone rubber is used for elastic portion 33*b*. Secondary transfer roller 33X is rotationally driven in the direction shown with AR1. Elastic portion 33*b* is harder than elastic portion 24*b*. Therefore, while secondary transfer roller 33X and opposed roller 24X are in pressure contact with each other, secondary transfer roller 33X digs in opposed roller 24X.

Elastic portion 24*b* may be harder than elastic portion 33*b* and opposed roller 24X may dig into secondary transfer roller 33X.

At the center of the nip portion, an amount of digging d0 is maximum and a distance z0 between core 24*a* of opposed roller 24X and core 33*a* of secondary transfer roller 33X is minimum Therefore, at the center of the nip portion, a pressure applied to the intermediate transfer belt is maximum.

A pressure at a point displaced from the center of the nip by dx along a direction of travel of the belt is considered. At a point distant by distance dx from a line connecting the center of opposed roller 24X and the center of secondary transfer roller 33X to each other, a distance between core 24*a* of opposed roller 24X and core 33*a* of secondary transfer roller 33X is set to z1 greater than z0. Accordingly, an amount of digging is also set to d1 smaller than amount of digging d0 at the center of the nip portion.

As a distance along the direction in parallel to the direction of travel of the transfer belt from the center of the nip portion is thus longer, an amount of digging decreases and a distance between core 24*a* of opposed roller 24X and core 33*a* of secondary transfer roller 33X increases.

When an amount of digging is small, force with which core 24*a* of opposed roller 24X and secondary transfer roller 33X sandwich the transfer belt therebetween becomes weaker. When a distance between core 24*a* of opposed roller 24X and core 33*a* of secondary transfer roller 33X is long, an internal stress produced by digging of elastic portion 33*b* is absorbed as being distributed over a wider range. With both of these effects, as a distance from the center of the nip portion along the direction in parallel to the direction of travel of the belt is longer, a pressure applied to the intermediate transfer belt abruptly decreases (see FIG. 5).

In the comparative example, an example in which an elastic roller in which an elastic portion is provided around a core made of a metal implements secondary transfer roller 33X and opposed roller 24X is exemplified by way of example. Even when a rigid roller composed of a metal without an elastic portion implements any of secondary transfer roller 33X and opposed roller 24X, a similar pressure distribution is exhibited.

<Problem Which Occurs in Use of Intermediate Transfer Belt in Secondary Transfer Portion in Comparative Example>

In general, when an intermediate transfer belt having an elastic layer is employed, transferability to a recess in paper is improved, because a surface of the belt can deform as following irregularities in paper when the intermediate transfer belt with the elastic layer is employed. In order to achieve deformation of the surface of the intermediate transfer belt as following irregularities in paper, a softer and thicker elastic layer of the intermediate transfer belt is more advantageous because an amount of deformation of the intermediate transfer belt is greater and the intermediate transfer belt is more likely to deform such that the surface of the intermediate transfer belt enters the recess in paper.

Even in a system including an intermediate transfer belt having a soft and thick elastic layer, however, transferability to paper with irregularities may become poor without sufficient exhibition of capability of an elastic belt to follow irregularities. The present inventors have found that this problem is caused by delay in deformation attributed to viscosity of the elastic layer, which will be described in detail with reference to FIG. 5.

Figure 5:
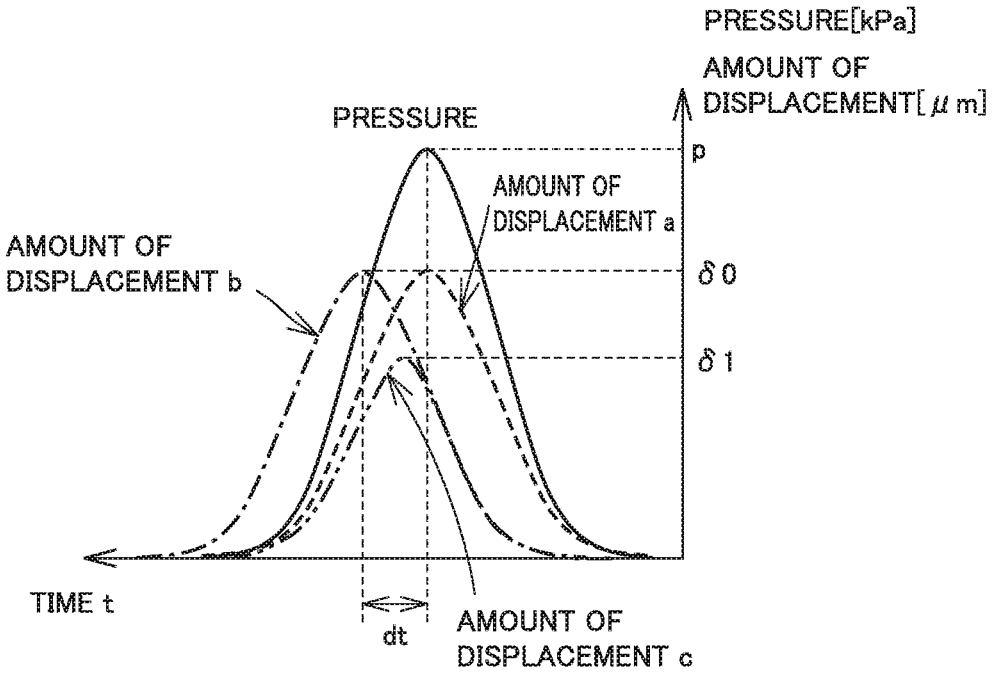
FIG. 5 is a diagram for illustrating delay in deformation of the intermediate transfer belt relative to application of a pressure to the intermediate transfer belt in transfer in the secondary transfer portion in the comparative example.

FIG. 5 is a diagram for illustrating delay in deformation of the transfer belt relative to application of a pressure to the transfer belt in transfer in the secondary transfer portion in the comparative example. Delay in deformation of the transfer belt relative to application of a pressure to the transfer belt will be described with reference to FIG. 5.

A solid line in FIG. 5 represents change over time in pressure (pressure distribution) applied to any one point on the intermediate transfer belt when that any point passes through the nip portion between secondary transfer roller 33X and opposed roller 24X with movement of the belt as described above.

Though increase in pressure is gentle around an entry of the nip portion, it abruptly rises from a certain point. The point of rise is a boundary where force of pressure contact between secondary transfer roller 33X and opposed roller 24X is reliably applied. The pressure increases at a steep slope, attains to a peak value at the center of the nip portion (a point where core 33*a* of secondary transfer roller 33X and core 24*a* of opposed roller 24X are most proximate to each other), and again abruptly decreases.

FIG. 5 shows variation in amount of displacement of the surface of the intermediate transfer belt in accordance with the pressure distribution. The amount of displacement refers to an amount of displacement of the surface of the intermediate transfer belt toward a recess in paper as a result of deformation of the elastic layer upon application of the pressure. Therefore, since a distance between the recess in paper and the surface of the belt is shorter as an amount of displacement is larger, a larger amount of displacement is preferred.

An amount of displacement a as shown with a dashed line in FIG. 5 represents an amount of displacement which varies in proportion to a pressure applied to the intermediate transfer belt. Such displacement of the belt occurs based on elastic deformation of the elastic layer. Since strain is in proportion to a stress (up to an elastic limit) in the elastic layer such as rubber, based on this principle, an amount of displacement in proportion to an applied pressure like amount of displacement a is exhibited.

Normally, however, an elastic layer such as rubber also has viscosity, and due to such viscosity, variation in displacement is delayed relative to variation in pressure.

An amount of displacement b shown with a chain dotted line in FIG. 5 represents an amount of displacement as combined with delay in displacement relative to a pressure due to viscosity of the elastic layer. Amount of displacement b increases or decreases as being delayed by a delay dt relative to increase or decrease in pressure. Amount of displacement b, however, is drawn as a virtual curve, and the belt is not actually displaced as shown with amount of displacement b for a reason as below.

A pressure applied to the intermediate transfer belt abruptly decreases beyond the center of the nip as described above. In response, an amount of displacement of the intermediate transfer belt also decreases.

Therefore, like an amount of displacement c shown with a chain double dotted line in FIG. 5, in a phase of increase in pressure, an amount of displacement of the intermediate transfer belt rises as being delayed by delay dt, and in a phase of decrease in pressure, an amount of displacement also decreases (to be exact, as slightly being delayed relative to application of a pressure). A maximum value of the amount of displacement of the intermediate transfer belt is thus set to a value 61 smaller than 60 which represents inherent deformation capability determined solely by elasticity of the intermediate transfer belt.

When a delay in displacement due to viscosity of the elastic layer is thus long, a maximum value of the amount of displacement of the intermediate transfer belt in the nip portion is smaller than an amount determined by inherent deformation capability of the intermediate transfer belt. Therefore, the intermediate transfer belt cannot deform to sufficiently bury a recess in paper and transferability to paper with irregularities becomes poor.

<Details of Secondary Transfer Portion According to Embodiment 1>

The image formation apparatus according to the present embodiment was made to solve the problem above, and as will be described later, it is constructed to have a pressure flat region where a pressure applied to intermediate transfer belt 21 as a result of pressure contact between secondary transfer roller 33 and opposed roller 24 is substantially constant around a peak and constructed such that a time period during which any one point on the belt passes through the pressure flat region is longer than a delay relative to application of a pressure causing deformation of the intermediate transfer belt.

Figure 6:
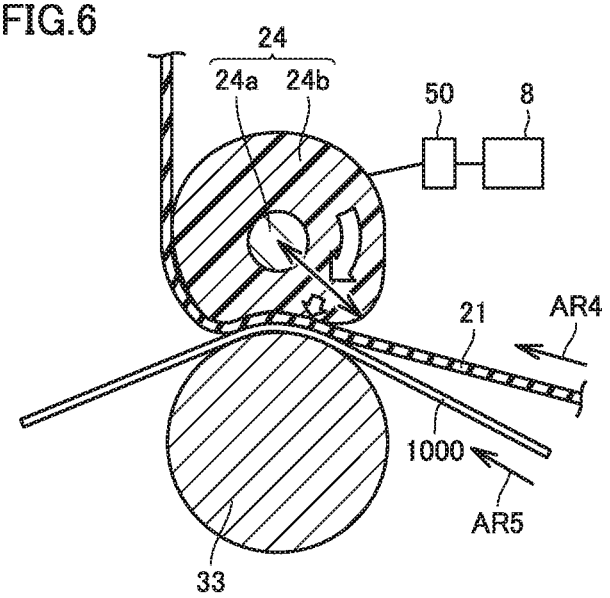
FIG. 6 is a schematic diagram showing a state of pressure contact in the secondary transfer portion according to Embodiment 1.

FIG. 6 is a schematic diagram showing a state of pressure contact in the secondary transfer portion according to Embodiment 1. A state of pressure contact in the secondary transfer portion according to Embodiment 1 will be described with reference to FIG. 6.

As shown in FIG. 6, image formation apparatus 1 includes a rotational drive portion 50 which applies rotary torque to opposed roller 24. An operation of rotational drive portion 50 is controlled by control unit 8. Rotational drive portion 50 applies rotary torque to opposed roller 24 such that a direction of rotation in the nip portion is the same as a direction of rotation of the intermediate transfer belt in nip portion N.

Application of rotary torque to opposed roller 24 does not mean indirect rotation of opposed roller 24 with intermediate transfer belt 21 being interposed but means direct application of force in a direction of rotation of opposed roller 24 separately from the former. Force for rotating opposed roller 24 in a direction the same as drive and transportation of intermediate transfer belt 21 is applied.

In a general image formation apparatus, an opposed roller does not particularly have means for rotationally driving the same, and the opposed roller rotates as following the intermediate transfer belt owing to frictional force between a rear surface of the intermediate transfer belt and an outer circumferential surface of the opposed roller.

Control unit 8 controls an operation of rotational drive portion 50 so as to apply rotary torque when paper with irregularities is adopted as a recording medium. For example, a gloss sensing unit (not shown) which senses a gloss of a recording medium is provided on a transportation path in image formation apparatus 1 so that the gloss sensing unit measures a gloss of a transported recording medium. Control unit 8 determines whether or not paper with irregularities is adopted as a recording medium based on a result of sensing by the gloss sensing unit. When the gloss of the recording medium is lower than a prescribed threshold value, determination as paper with irregularities is made.

The gloss sensing unit is not an essential component, and an operation panel (not shown) for performing various operations of the image formation apparatus may be used to obtain information on paper. As a user inputs information on a type, a thickness, and a gloss of a recording medium through the operation panel of image formation apparatus 1, control unit 8 can determine whether or not paper with irregularities is adopted as a recording medium based on the input information.

Even when rotary torque is applied to opposed roller 24 as described above as shown with a hollow arrow in the figure, a gap between opposed roller 24 and secondary transfer roller 33 remains unchanged. At a peak position (the center of the nip portion), a peak pressure determined by a distance between core 24*a* of opposed roller 24 and secondary transfer roller 33, an amount of digging of secondary transfer roller 33, and a hardness of elastic portion 24*b* is applied to intermediate transfer belt 21.

When rotary torque is applied to opposed roller 24 as shown with the hollow arrow in the figure, elastic portion 24*b* (a rubber layer) of opposed roller 24 greatly expands toward an outer side of nip portion N on an upstream side of the peak position in the direction of transportation of the recording medium.

When rotary torque is applied to opposed roller 24, force is applied to more strongly push elastic portion 24*b* of opposed roller 24 toward the peak position, whereas force is applied in a direction of pushing back elastic portion 24*b* of opposed roller 24 owing to frictional force between opposed roller 24 and the rear surface of intermediate transfer belt 21.

With application of such forces, elastic portion 24*b* of opposed roller 24 stays on the upstream side of the center of the nip portion and greatly expands to the outer side of the nip portion. Expanded elastic portion 24*b* strongly pushes the rear surface of intermediate transfer belt 21 toward secondary transfer roller 33 when it is pushed toward the center of the nip portion. Therefore, a pressure applied to intermediate transfer belt 21 is higher on the upstream side of the center of the nip portion.

Elastic portion 24*b* has a function to deform itself to smooth out a pressure when there are a portion high in pressure and a portion low in pressure in elastic portion 24*b*. A region where a pressure is substantially equal to a peak pressure is formed on the upstream side of the peak position.

Figure 7:
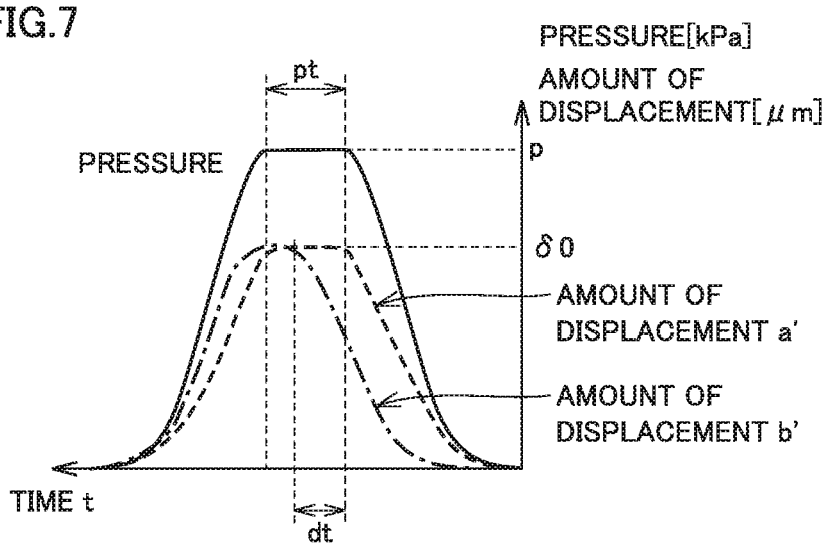
FIG. 7 is a diagram showing a pressure applied to the intermediate transfer belt and an amount of displacement of a transfer belt in transfer in the secondary transfer portion according to Embodiment 1.

FIG. 7 is a diagram showing a pressure applied to the intermediate transfer belt and an amount of displacement of the intermediate transfer belt in transfer in the secondary transfer portion according to Embodiment 1. A pressure applied to intermediate transfer belt 21 and an amount of displacement of intermediate transfer belt 21 will be described with reference to FIG. 7.

As described above, in Embodiment 1, in a distribution of a pressure applied to the intermediate transfer belt when the intermediate transfer belt passes through the nip portion, a region where a pressure is substantially equal to a peak pressure is formed on the upstream side of the peak position.

Therefore, a distribution of the pressure applied to any one point located on intermediate transfer belt 21 when that any one point passes through the nip portion has an increase region where a pressure increases over time, a flat region continuing to the increase region where a pressure is constant in spite of lapse of time, and a decrease region continuing to the flat region where a pressure decreases over time, with the ordinate representing a pressure and the abscissa representing time, as shown with a solid line in FIG. 7.

As shown in FIG. 7, pt represents a duration in which any one point stays in the flat region with movement (a time period required for passage through the flat region).

FIG. 7 shows variation in amount of displacement of the surface of the intermediate transfer belt when a pressure based on the pressure distribution is applied to the intermediate transfer belt, in addition to the pressure distribution.

An amount of displacement a' shown with a dashed line in FIG. 7 represents an amount of displacement which varies in proportion to a pressure applied to intermediate transfer belt 21, that is, a state that there is no delay in displacement relative to a pressure applied to intermediate transfer belt 21.

In contrast, an amount of displacement b' shown with a chain dotted line in FIG. 7 represents an amount of displacement of intermediate transfer belt 21 as being delayed by dt relative to application of a pressure, that is, actual displacement of intermediate transfer belt 21 in Embodiment 1.

Amount of displacement b' attains to a maximum value of the amount of displacement as being delayed by dt relative to amount of displacement a'. At a time point when amount of displacement b' attains to the maximum value, a pressure applied to intermediate transfer belt 21 has attained to a peak value p. A pressure applied to intermediate transfer belt 21 starts to decrease in the pressure distribution after amount of displacement b' attains to the maximum value. Therefore, even amount of displacement b' which is delayed in displacement can attain to maximum value 60 as large as that of amount of displacement a' without delay in displacement.

Relation between a duration pt of stay in the flat region (a time period for passage through the flat region) and delay dt by which intermediate transfer belt 21 deforms as being delayed relative to variation in pressure greatly affects whether or not capability to follow irregularities is exhibited without inherent capability of intermediate transfer belt 21 to deform being impaired.

When a condition of pt dt is satisfied, inherent capability of intermediate transfer belt 21 to deform is exhibited without being impaired and deformation can sufficiently follow an irregular shape of a recording medium. When a condition of pt≤dt is satisfied, on the other hand, inherent capability of intermediate transfer belt 21 to deform is not sufficiently exhibited and deformation may not sufficiently be able to follow the irregular shape of the recording medium.

As set forth above, in image formation apparatus 1 according to Embodiment 1, by setting duration pt in which any one point of intermediate transfer belt 21 stays in the flat region in the distribution of an applied pressure when that any one point passes through the nip portion to be longer than delay dt from a time when that any one point reaches a boundary between the increase region and the flat region in the pressure distribution until a time when an amount of deformation of intermediate transfer belt 21 attains to the peak, inherent capability of intermediate transfer belt 21 to deform is exhibited without being impaired and deformation can sufficiently follow the irregular shape of the recording medium. Consequently, good transferability to a recording medium which has significant irregularities can be realized in a stable manner.

<Method 1 of Calculating Duration pt of Stay in Flat Region>

Figure 8:
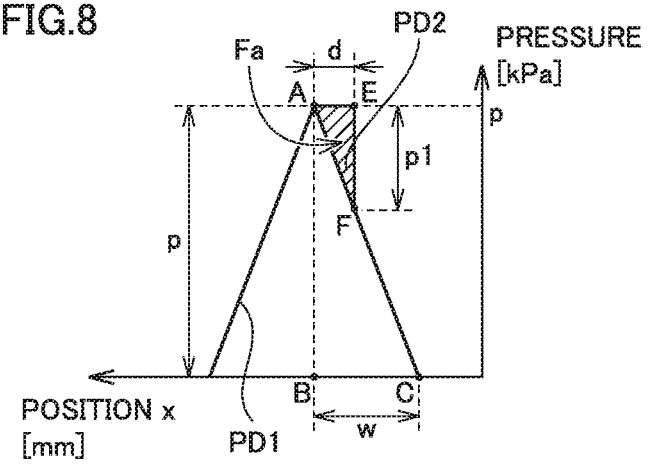
FIG. 8 is a diagram showing in a simplified manner, a pressure applied to the intermediate transfer belt in transfer in the secondary transfer portion according to Embodiment 1.
Figure 9:
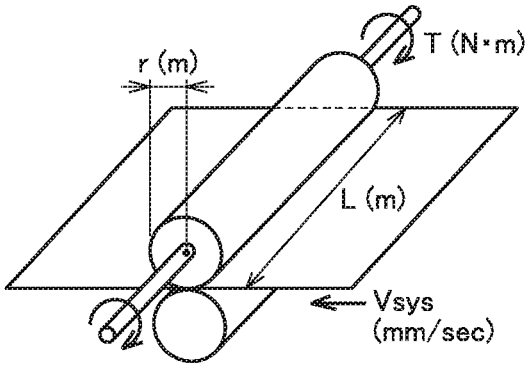
FIG. 9 is a diagram for illustrating a condition of transfer in the secondary transfer portion according to Embodiment 1.

FIG. 8 is a diagram showing in a simplified manner, a pressure applied to the intermediate transfer belt in transfer in the secondary transfer portion according to Embodiment 1. FIG. 9 is a diagram for illustrating a condition of transfer in the secondary transfer portion according to Embodiment 1. A method of calculating duration pt of stay in which any one point stays in the flat region when intermediate transfer belt 21 passes through the nip portion will be described with reference to FIGS. 8 and 9.

As shown in FIG. 8, it can be assumed that a distribution of a pressure applied to any one point on intermediate transfer belt 21 when that any one point passes through the nip portion is represented by the sum of a first pressure distribution PD1 of a pressure applied to any one point when that any one point passes through the nip portion while no rotary torque is applied to opposed roller 24 and a second pressure distribution PD2 of a pressure applied by the rotary torque to that any one point.

As shown in FIG. 8, the distribution of the pressure applied to any one point on intermediate transfer belt 21 when that any one point passes through the nip portion can be such that the pressure applied to intermediate transfer belt 21 which is produced by applying rotary torque to opposed roller 24 is combined with the simplified pressure distribution along the direction of travel of the belt in an upward triangular shape. FIG. 8 shows a pressure applied to the intermediate transfer belt as a result of application of rotary torque with a hatched portion.

As shown in FIGS. 8 and 9, duration pt [msec.] in which any one point stays in the flat region is expressed in an expression (1) below, where Vsys [mm/sec.] represents a speed of transportation of a recording medium, w [mm] represents a distance of travel of any one point from a position where the pressure starts to increase at an entry of the nip portion in first pressure distribution PD1 to a position where the pressure attains to the maximum, T [N.m] represents rotary torque applied to the opposed roller, r [m] represents a radius of the opposed roller, L [m] represents a length of the nip portion in the direction in parallel to an axial direction of the transfer roller, and p [kPa] represents a maximum value of the pressure in first pressure distribution PD1.

$$pt=(1/Vsys)\sqrt{2wt/rLp}\times10^3 \qquad \text{Expression (1)}$$

The expression (1) can be calculated as follows. Pressing force Fa [N/m] against intermediate transfer belt 21 produced by applying rotary torque T [N.m] to opposed roller 24 is expressed in an expression (2) below, where r [m] represents a radius of the opposed roller and L [m] represents a length of the nip portion in the direction in parallel to the axial direction of the transfer roller.

$$F\alpha=T/rL \qquad \text{Expression (2)}$$

Fa corresponds to an area of a triangle AEF shown with the hatched portion in FIG. 8.

Since triangle AEF and a triangle CBA shown in FIG. 8 are in similitude relation, a height p1 of triangle AEF is expressed in an expression (3) below, where d [mm] represents a width of the flat region in the distribution of the pressure applied to any one point on intermediate transfer belt 21 when that any one point passes through the nip portion, w [mm] represents a distance of travel of any one point from the position where the pressure starts to increase at the entry of the nip portion in first pressure distribution PD1 to the position where the pressure attains to the maximum, and p [kPa] represents the maximum value of the pressure in first pressure distribution PD1.

$$p1=d\times p/w \qquad \text{Expression (3)}$$

Since d represents a bottom and p1 represents a height of triangle AEF, an area S of triangle AEF is expressed in an expression (4) below.

$$S=d\times p1/2=d\times(d\times p/w)/2=d^2\times p/2w \qquad \text{Expression (4)}$$

Since area S of triangle AEF corresponds to Fa as described above, an expression (5) below is obtained from relation between the expression (2) and the expression (4).

$$Fa=T/rL=d^2\times p/2w \qquad \text{Expression (5)}$$

As a result of transformation of the expression (5), width d of the flat region in the pressure distribution can be expressed in an expression (6) below.

$$d=\sqrt{2wt/rLp} \qquad \text{Expression (6)}$$

Duration pt [msec.] in which any one point stays in the flat region is expressed in an expression (7) below, where Vsys [mm/sec.] represents a system speed, that is, a speed of transportation of a recording medium.

$$pt=d/Vsys\times10^3 \qquad \text{Expression (7)}$$

By substituting the expression (6) into the expression (7), relation in the expression (1) as described above is obtained.

Since duration pt in which any one point stays in the flat region can be calculated by using the expression (1), delay dt from the time when any one point reaches the boundary between the increase region and the flat region in the pressure distribution until the time when an amount of deformation of intermediate transfer belt 21 attains to the peak can readily be set based on calculated pt.

<Method 2 of Calculating Duration pt of Stay in Flat Region>

Figure 10:
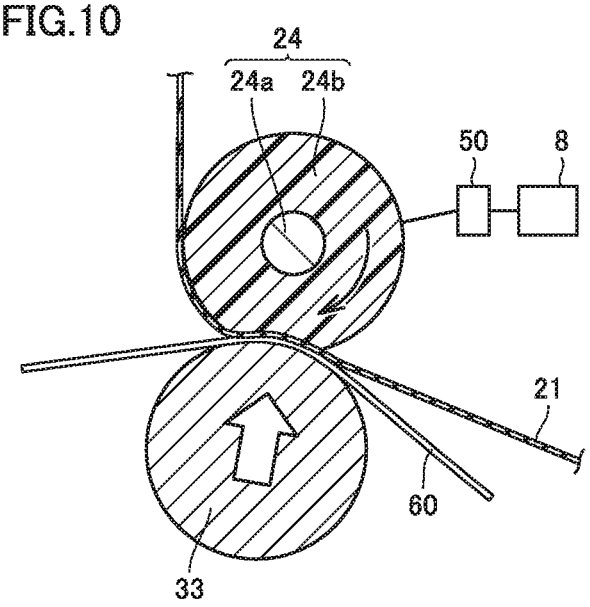
FIG. 10 is a diagram showing measurement of a pressure applied to the intermediate transfer belt in transfer in the secondary transfer portion according to Embodiment 1.
Figure 11:
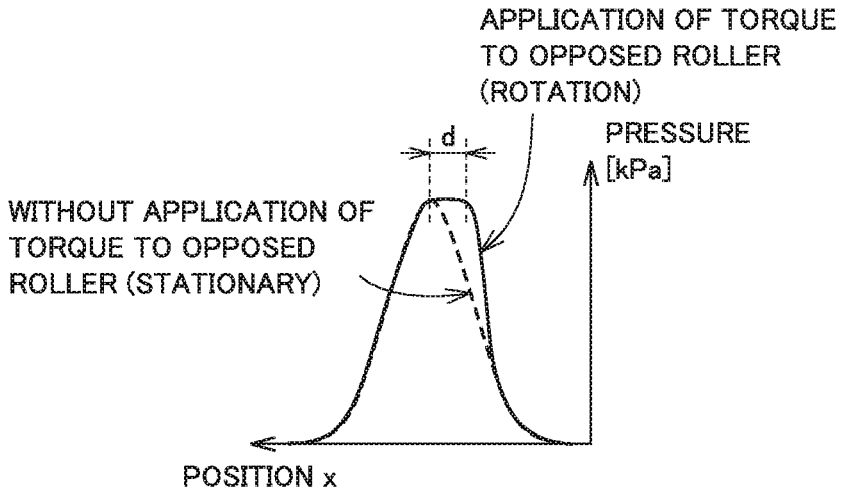
FIG. 11 is a diagram showing a distribution of the pressure measured in FIG. 10.

FIG. 10 is a diagram showing measurement of a pressure applied to the intermediate transfer belt in transfer in the secondary transfer portion according to Embodiment 1. FIG. 11 is a diagram showing a distribution of the pressure measured in FIG. 10. Duration pt of stay in the flat region calculated from actual measurement of a pressure distribution will be described with reference to FIGS. 10 and 11.

As shown in FIG. 10, a tactile sensor 60 (for example, a pressure distribution measurement system I-SCAN manufactured by Nitta Corporation) is sandwiched between opposed roller 24 and secondary transfer roller 33. More specifically, tactile sensor 60 is sandwiched between intermediate transfer belt 21 and secondary transfer roller 33.

Intermediate transfer belt 21 and secondary transfer roller 33 are set to be stationary and a pressure distribution is measured in this state. In order to enhance measurement accuracy, preferably, a pressure distribution along the direction of travel of intermediate transfer belt 21 is obtained by taking a pressure distribution two-dimensionally along the direction of travel of intermediate transfer belt 21 and a direction of width of intermediate transfer belt 21 and averaging the pressure distribution along the direction of width.

FIG. 11 shows with a dashed line, a pressure distribution measured with opposed roller 24 being not rotated and shows with a solid line, a pressure distribution measured with opposed roller 24 being rotated by applying rotary torque.

In a form of actual use, intermediate transfer belt 21 is driven and transported and secondary transfer roller 33 is rotated. A function produced by rotary torque to the opposed roller even while intermediate transfer belt 21 is stationary as in the measurement state is the same as in an example in which intermediate transfer belt 21 moves. Therefore, with measurement as above, width d [mm] of the flat region in the distribution of the pressure applied to any one point on intermediate transfer belt 21 when that any one point passes through the nip portion in the actual manner of use can be measured.

Duration pt [msec.] in which any one point stays in the flat region is expressed in an expression (8) below, where Vsys [mm/sec.] represents a system speed, that is, a speed of transportation of a recording medium.

$$pt=d/Vsys\times10^3 \qquad \text{Expression (8)}$$

Since duration pt in which any one point stays in the flat region can be calculated by using the expression (8), delay dt from the time when any one point reaches the boundary between the increase region and the flat region in the pressure distribution until the time when an amount of deformation of intermediate transfer belt 21 attains to the peak can readily be set based on calculated pt.

<Method 3 of Calculating Duration pt of Stay in Flat Region>

Figure 12:
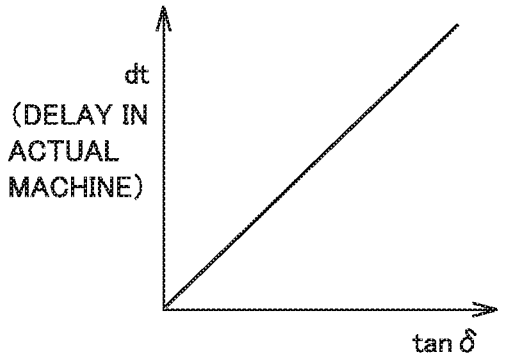
FIG. 12 is a diagram showing relation between a loss tangent calculated from measurement of dynamic viscoelasticity and delay in deformation of the intermediate transfer belt in the intermediate transfer belt according to Embodiment 1.

FIG. 12 is a diagram showing relation between a loss tangent calculated from measurement of dynamic viscoelasticity and delay in deformation of the intermediate transfer belt in the intermediate transfer belt according to Embodiment 1. A method of calculating duration pt in which any one point stays in the flat region when intermediate transfer belt 21 passes through the nip portion will be described with reference to FIG. 12.

A loss tangent tanδ found in measurement of dynamic viscoelasticity can be used as an indicator for delay dt from a time when any one point on intermediate transfer belt 21 reaches the boundary between the increase region and the flat region in the pressure distribution when that any one point passes through the nip portion until a time when an amount of deformation of intermediate transfer belt 21 attains to the peak.

For example, EXSTAR DMS 7100 manufactured by SII NanoTechnology Inc. can be employed as a dynamic viscoelasticity measurement apparatus.

Loss tangent tanδ of intermediate transfer belt 21 at 25° C. can be measured with the present measurement apparatus under such conditions as a program temperature of 25° C., a sample dimension of a length of 20 mm and a width of 10 mm, tensile force of 10 gf (98 mN), and a measurement frequency from 0.01 to 100 Hz.

As loss tangent tanδ is greater, phase delay of strain corresponding to a stress is greater. Therefore, as loss tangent tanδ is greater, deformation of intermediate transfer belt 21 in the nip portion is delayed relative to application of a pressure.

Relation between loss tangent tanδ and delay dt can be regarded as substantially linear to the extent of suitable use in the image formation apparatus. Therefore, relation between loss tangent tanδ and delay dt can be expressed in an expression (9) below, with a representing a coefficient.

$$dt = a \times \tan\delta \qquad \text{Expression (9)}$$

As described above, in order to sufficiently exhibit inherent capability of intermediate transfer belt 21 to deform, duration pt should only be not shorter than delay dt, and relation in an expression (10) below should only be satisfied with reference to the expression (9).

$$pt \geq a \times \tan\delta \qquad \text{Expression (10)}$$

As will be described later, coefficient a is preferably set to 10.9, and in image formation apparatus 1, an expression (11) below is preferably satisfied, with pt [msec.] represents a duration in which any one point stays in the flat region and tanδ represents a loss tangent at 25° C. of intermediate transfer belt 21.

$$pt \geq 10.9 \times \tan\delta \qquad \text{Expression (11)}$$

With the expression (11), duration pt of stay can readily be set based on loss tangent tanδ.

<Method 4 of Calculating Duration pt of Stay in Flat Region>

Duration pt of stay in which any one point stays in the flat region when intermediate transfer belt 21 passes through the nip portion can be calculated with a displacement amount measurement apparatus 100 which will be described below (see FIG. 13A).

<Displacement Amount Measurement Apparatus>

Intermediate transfer belt 21 in the present embodiment can ensure good transferability not only in an example in which plain paper without particular surface irregularities is employed as recording medium 1000 described above but also in an example in which embossed paper with irregularities is employed. Prior to description of a mechanism of the intermediate transfer belt, details of a method of evaluation with the displacement amount measurement apparatus described above will be described below.

Figure 13A:
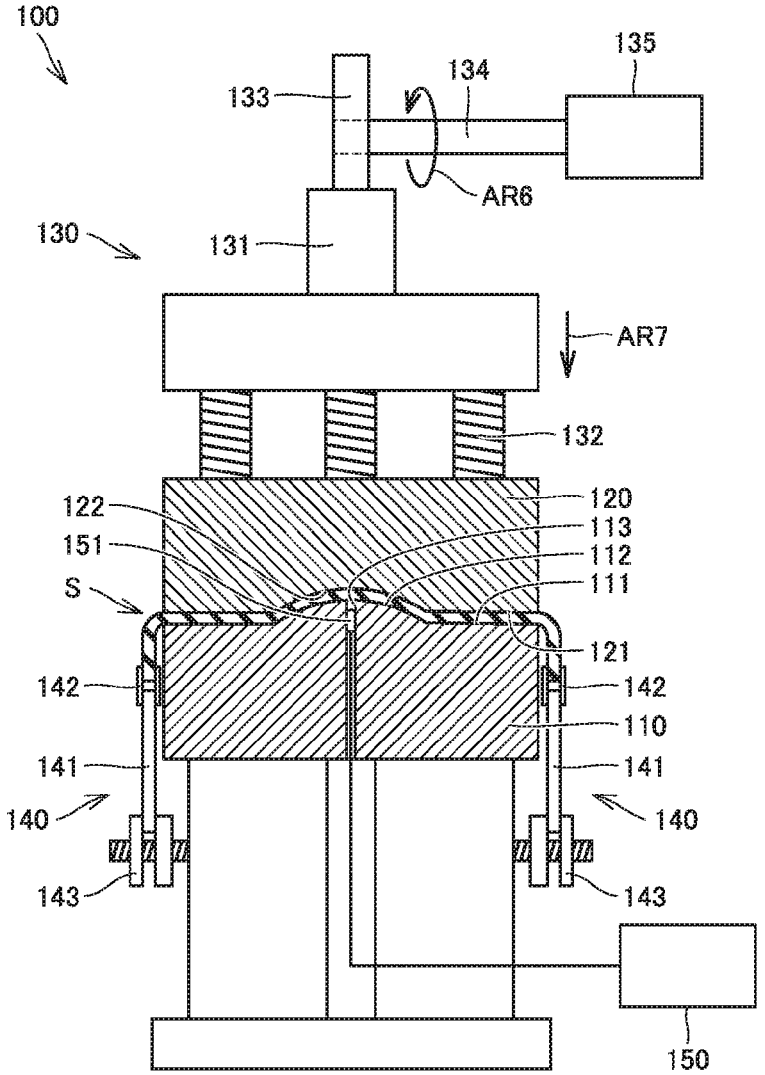
FIGS. 13A to 13C are schematic diagrams showing a construction of a displacement amount measurement apparatus and an operation of a pressurization mechanism provided in the displacement amount measurement apparatus.
Figure 13B:
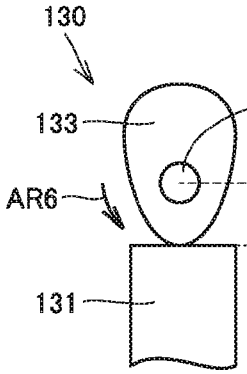
Figure 13C:
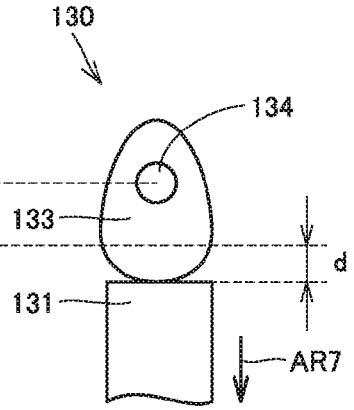
Figure 14A:
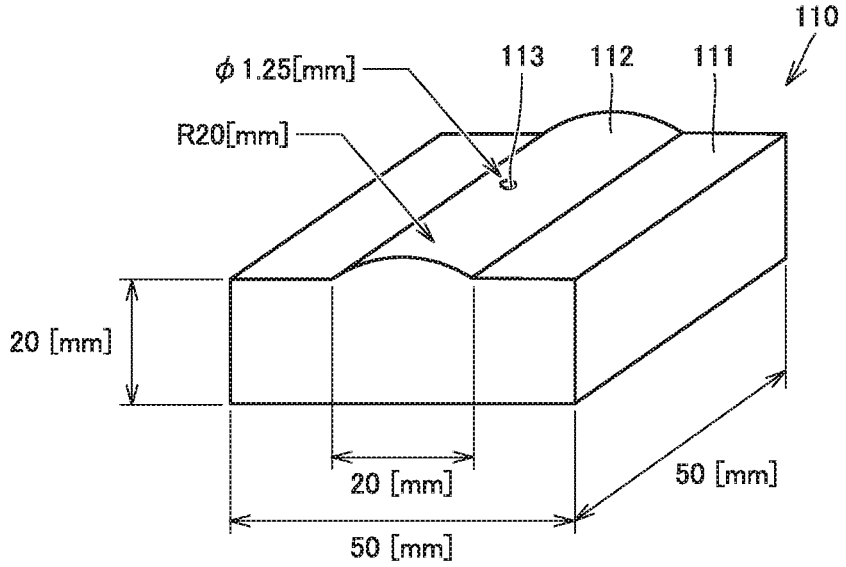
FIGS. 14A and 14B are perspective views of a lower block and an upper block of the displacement amount measurement apparatus shown in FIG. 13A.
Figure 14B:
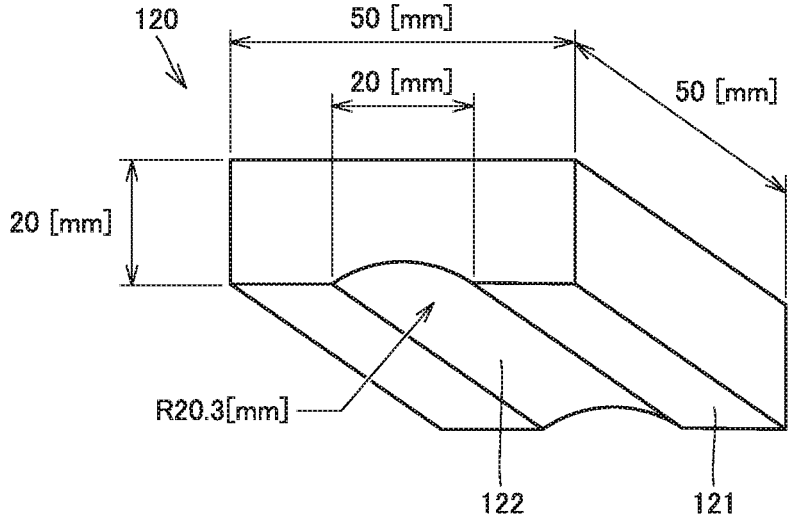

FIG. 13A is a schematic diagram showing a construction of the displacement amount measurement apparatus, and FIGS. 13B and 13C are schematic diagrams showing an operation of a pressurization mechanism provided in the displacement amount measurement apparatus. FIG. 14A is a perspective view from above of a lower block of the displacement amount measurement apparatus shown in FIG. 13A and FIG. 14B is a perspective view from below of an upper block of the displacement amount measurement apparatus shown in FIG. 13A.

As shown in FIG. 13A, displacement amount measurement apparatus 100 mainly includes a lower block 110, an upper block 120, a pressurization mechanism 130, a tension application mechanism 140, and a displacement meter 150.

As shown in FIGS. 13A and 14A, lower block 110 is made of an aluminum block having a width and a depth of 50 [mm] and a height of 20 [mm], and has a projecting curved surface 112 having a width of 20 [mm] in a central portion of an upper surface 111 in a direction of width. Projecting curved surface 112 has a radius of curvature of 20 [mm].

In a top portion of projecting curved surface 112 located along a direction of depth of lower block 110, the central portion in the direction of depth is provided with a hole having a diameter of 1.25 [mm] (a tolerance of ±0.02 [mm]). A head portion 151 of displacement meter 150 is arranged at a position retracted from an opening of hole 113.

As shown in FIGS. 13A and 14B, upper block 120 is made of an aluminum block having a width and a depth of 50 [mm] and a height of 20 [mm], and has a recessed curved surface 122 having a width of 20 [mm] in a central portion of a lower surface 121 in a direction of width. Recessed curved surface 122 has a radius of curvature of 20.3 [mm].

A tolerance of upper surface 111 and projecting curved surface 112 of lower block 110 and lower surface 121 and a surface of recessed curved surface 122 of upper block 120 is each 0.02 [mm].

As shown in FIG. 13A, upper surface 111 of lower block 110 and lower surface 121 of upper block 120 are arranged as being opposed to each other. As lower block 110 and upper block 120 are arranged as being positioned, projecting curved surface 112 and recessed curved surface 122 described above are arranged as being superimposed on each other along a vertical direction.

Pressurization mechanism 130 is arranged above upper block 120. Pressurization mechanism 130 includes a pressurization member 131 which is a member in a form of a block, a spring 132 arranged between pressurization member 131 and upper block 120, a cam 133 arranged to be in contact with an upper surface of pressurization member 131, a shaft 134 coupled to cam 133, and a drive motor 135 which rotationally drives shaft As shown in FIGS. 13B and 13C, drive motor 135 rotationally drives shaft 134 in a direction shown with an arrow AR6 in the figures so that cam 133 coupled to shaft 134 rotates together with shaft 134 and accordingly pressurization member 131 is pushed downward (in a direction shown with an arrow AR7 in the figures). Thus, pressurization member 131 pushes upper block 120 downward with spring 132 being interposed, and a vertically downward load is applied to upper block 120. Magnitude of the load is determined by an amount of pushing downward d of pressurization member 131, and amount of pushing downward d of pressurization member 131 can be adjusted by an amount of rotation of cam 133.

As shown in FIG. 13A, a belt S to be evaluated is arranged between lower block 110 and upper block 120 and opposing ends of belt S are pulled outward from between lower block 110 and upper block 120. Tension application mechanism 140 is connected to each of the opposing ends of belt S.

Tension application mechanism 140 includes a film 141, a tape 142, and a weight 143. Film 141 is formed from a film made of polyethylene terephthalate and having a thickness of 100 [μm] and tape 142 is implemented by a tacky tape made of polyimide and having a thickness of 30 μ[m]. One end of film 141 is attached to an end portion of belt S with tape 142 and weight 143 is attached to the other end of film 141. A tensile load applied by weight 143 is adjusted to 44 [N/m]. When belt S to be evaluated has a sufficient size, weight 143 may directly be attached to the opposing ends of belt S without using film 141 and tape 142 described above.

Displacement meter 150 serves to detect displacement of the surface of belt S, and head portion 151 of displacement meter 150 is set in hole 113 in lower block 110 so as to be opposed to belt S as described above. A micro-head spectral-interference laser displacement meter (a spectral unit (model: SI-F01U), a head portion (model: SI-F01)) manufactured by Keyence Corporation is employed as displacement meter 150.

<Evaluation Method>

Figure 15:
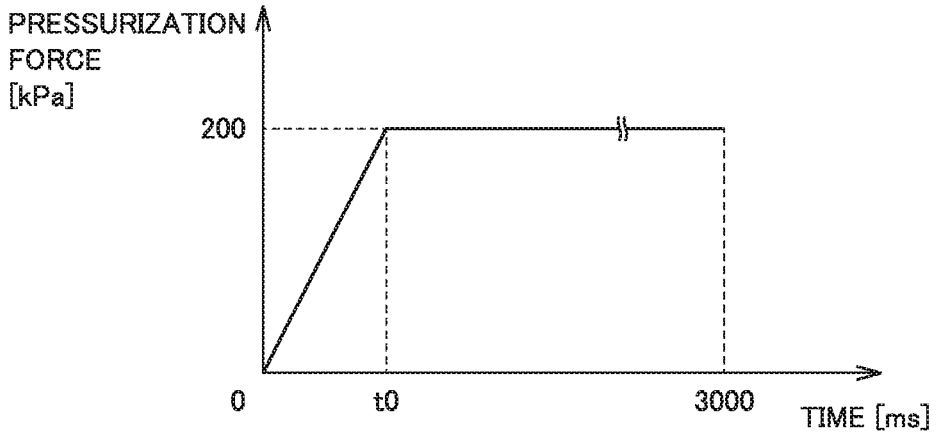
FIG. 15 is a graph for illustrating a method of evaluating a belt with the displacement amount measurement apparatus shown in FIG. 13A.
Figure 16:
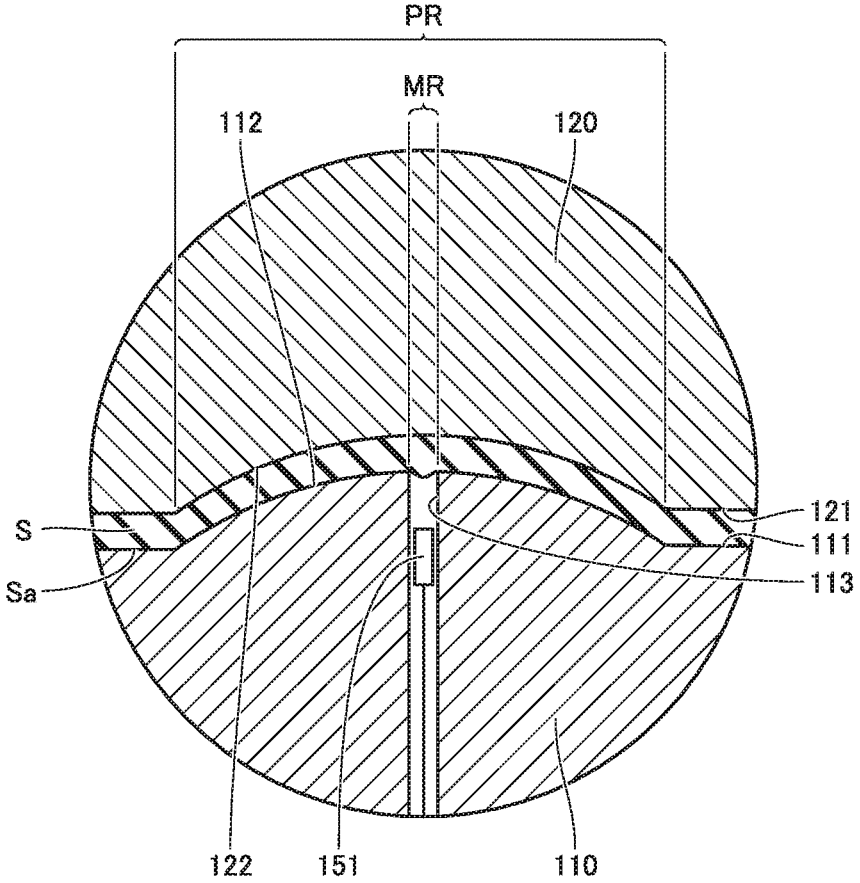
FIG. 16 is an enlarged cross-sectional view of a vicinity of a hole in the lower block while the belt is pressurized with the displacement amount measurement apparatus shown in FIG. 13A.

FIG. 15 is a graph for illustrating a method of evaluating a belt with the displacement amount measurement apparatus shown in FIG. 13A. FIG. 16 is an enlarged cross-sectional view of a vicinity of the hole in the lower block while the belt is pressurized with the displacement amount measurement apparatus shown in FIG. 13A.

Belt S is evaluated in a procedure below with displacement amount measurement apparatus 100 shown in FIG. 13A described previously. Evaluation is conducted in an environment at a temperature of 20 [° C.] and a humidity of 50 [%].

Initially, prior to setting belt S in displacement amount measurement apparatus 100, a distribution of a pressure in a portion of contact between projecting curved surface 112 of lower block 110 and recessed curved surface 122 of upper block 120 is measured. A tactile sensor (a pressure distribution measurement system I-SCAN) manufactured by Nitta Corporation is employed for measurement of a pressure distribution.

Specifically, a measurement portion of the tactile sensor is inserted between lower block 110 and upper block 120, pressurization member 131 is pushed down, and a pressure distribution after lapse of thirty seconds is measured. This procedure is repeated and a pressure in the portion of contact between projecting curved surface 112 and recessed curved surface 122 and a vicinity thereof is adjusted to be within 200 [kPa] ±40 [kPa].

Prior to measurement, belt S is stored for six hours or longer in an environment at a temperature of 20 [° C.] and a humidity of 50 [%]. Regarding a size of belt S to be evaluated, a length corresponding to the direction of width of lower block 110 and upper block 120 is set to 60 [mm] and a length corresponding to the direction of depth of lower block 110 and upper block 120 is set to 50 [mm]. A length corresponding to the direction of width of lower block 110 and upper block 120 should only be not smaller than 35 [mm] and not greater than 300 [mm], and a length corresponding to the direction of depth of lower block 110 and upper block 120 should only be not smaller than 50 [mm] and not greater than 150 [mm]. When a length corresponding to the direction of width of lower block 110 and upper block 120 is insufficient, weight 143 should only be attached to opposing ends thereof with film 141 and tape 142 described above.

Then, the tactile sensor is removed, upper block 120 is lowered by pressurization mechanism 130 such that lower block 110 and upper block 120 are in slight contact with each other, and thereafter a state of contact is stabilized by holding this state for thirty seconds. Thereafter, pressurization mechanism 130 is used to press upper block 120 against lower block 110. A condition for pressurization is set to be the same as a condition for pressurization of belt S which will be described later (for details, reference is to be made to a condition for pressurization of belt S which will be described later).

For three seconds from a time point of start of pressurization, a position of recessed curved surface 122 of upper block 120 in a portion opposed to hole 113 in lower block 110 is measured with displacement meter 150, and this position is set as a baseline of measurement of an amount of displacement of belt S which will be described later.

Upper block 120 is raised to release contact between lower block 110 and upper block 120 and belt S is placed on upper surface 111 of lower block 110. A first main surface Sa of belt S is set to face downward (that is, lower block 110). In placing belt S, attention is to be paid not to introduce a foreign matter in between belt S and lower block 110 and between belt S and upper block 120.

After upper block 120 is lowered with pressurization mechanism 130 such that upper block 120 and belt S are in slight contact with each other, a state of contact is stabilized by holding this state for thirty seconds. Thereafter, pressurization mechanism 130 is used to press upper block 120 against belt S.

As shown in FIGS. 15 and 16, belt S is pressurized such that a pressurized region PR of belt S sandwiched between projecting curved surface 112 and recessed curved surface 122 is pressurized with pressurization force increasing at a predetermined rate of pressurization [kPa/ms], and after the pressurization force reaches 200 [kPa], a state that pressurized region PR is pressurized at a constant level with pressurization force of 200 [kPa] is held. Referring to FIG. 15, a time period from a time point of start of pressurization of pressurized region PR until a time point when the pressurization force reaches 200 [kPa] is defined as t0 [s]. Thereafter, pressurization of belt S is released at a time point of lapse of three seconds since start of pressurization.

For three seconds from the time point of start of pressurization until release of pressurization, a position of a measurement region MR which is a portion of first main surface Sa of belt S corresponding to hole 113 in lower block 110 is measured with displacement meter 150. The portion including measurement region MR of belt S deforms to expand into hole 113 as a site of belt S located around that portion is sandwiched between lower block 110 and upper block 120 and compressed, and the position of measurement region MR is varied with this deformation.

In measurement of the baseline described above and in measurement of a position of measurement region MR, an output from displacement meter 150 is taken in by using a digital oscilloscope DL1640 manufactured by Yokogawa Electric Corporation. A sampling period is set to 5 [ms].

Displacement of measurement region MR of belt S is calculated as chronological data by finding a difference between the measured position of measurement region MR and the baseline described above.

Measurement described above is conducted ten times in total with a position of placement of belt S with respect to lower block 110 being varied such that the position of measurement region MR described above is different with respect to belt S to be measured.

<Typical Pattern of Displacement>

Figure 17:
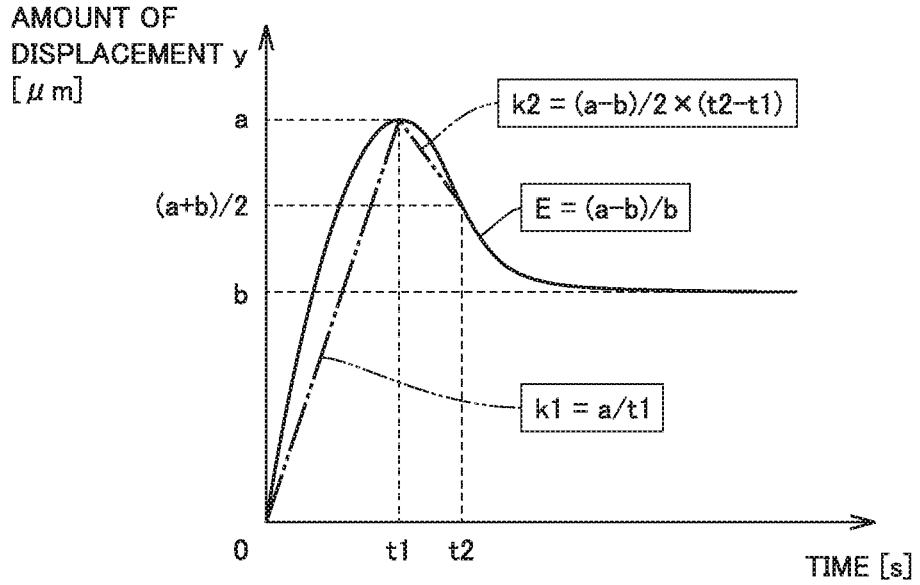
FIG. 17 is a graph exhibiting a pattern of behaviors of displacement of a measurement region of the belt obtained when the belt is evaluated with the displacement amount measurement apparatus shown in FIG. 13A.

When various belts each including an elastic layer are evaluated by applying the method of evaluating a belt with displacement amount measurement apparatus 100 described above, a pattern below can typically be observed as a pattern exhibiting a behavior of displacement of a measurement region of the belt. FIG. 17 is a graph showing a pattern of behaviors in displacement of a measurement region of the belt.

As shown in FIG. 17, with increase in pressurization force for pressurization of belt S after start of pressurization, an amount of displacement y of measurement region MR of belt S increases and a local peak in displacement of measurement region MR of belt S is produced as being delayed relative to a time point (that is, t0 [s]) when pressurization force for pressurization of belt S reaches 200 [kPa]. Thereafter, amount of displacement y of measurement region MR of belt S starts to decrease, and it finally gradually decreases over time and converges to a prescribed amount of displacement. The pattern can be concluded to have an overshoot portion in transition of displacement of measurement region MR of belt S.

In the following, displacement in a phase of increase in amount of displacement y of measurement region MR of belt S in the pattern is referred to as primary displacement and displacement in a phase of decrease in amount of displacement y of measurement region MR of belt S is referred to as secondary displacement.

<Pattern of Displacement of Transfer Belt>

Intermediate transfer belt 21 in the present embodiment described above exhibits a pattern shown in FIG. 17 (that is, a pattern with an overshoot portion) when the belt is evaluated by applying the method of evaluating a belt with displacement amount measurement apparatus 100 detailed above.

This is based on finding by the present inventor that when the present inventor prepares a plurality of types of belts and uses the belt as an intermediate transfer belt of an image formation apparatus to form an image on embossed paper, a belt with the overshoot portion is drastically higher in transferability than a belt without the overshoot portion.

The reason why the belt with the overshoot portion can ensure high transferability is basically that even when intermediate transfer belt 21 is pressurized from a side of a rear surface (that is, second main surface 21*s*2), a front surface thereof (that is, first main surface 21*s*1) also greatly shakes. Therefore, in order to realize a transfer belt which can ensure high transferability to a recording medium having irregularities in a recording surface such as embossed paper, attention should be paid to the overshoot portion described above.

Referring to FIG. 17, a maximum value of amount of displacement y representing a local peak of displacement of measurement region MR of belt S is defined as a [μm] and a converged value representing amount of displacement y after convergence of displacement of measurement region MR of belt S is defined as b [μm]. A time period from a time point of start of pressurization until a time point of observation of maximum value a [μm] is defined as t1 [s] and a time period from the time point of start of pressurization until a time point when amount of displacement y of measurement region MR of belt S again reaches (a+b)/2 after observation of maximum value a [μm] is defined as t2 [s].

An overshoot ratio E [-], a primary displacement rate k1 [μm/s], and a secondary displacement rate k2 [μm/s] are additionally defined as parameters representing a characteristic behavior of displacement of measurement region MR of belt S having an overshoot portion.

Overshoot ratio E [-] is a parameter representing magnitude of overshoot and calculated as $E=(a-b)/b$.

Primary displacement rate k1 [μm/s] is a parameter representing a rate of increase in primary displacement (that is, a rate of increase in amount of displacement) which is displacement until reaching the local peak described above and calculated as $k1=a/t1$.

Secondary displacement rate k2 [μm/s] is a parameter representing a rate of decrease in secondary displacement (that is, a rate of decrease in amount of displacement) which is displacement after reaching the local peak described above and calculated as $k2=(a-b)/\{2\times(t2-t1)\}$.

Overshoot ratio E [-], primary displacement rate k1 [μm/s], and secondary displacement rate k2 are parameters representing how much the front surface of the transfer belt (that is, the first main surface) shakes when the transfer belt is pressurized from the side of the rear surface (that is, the second main surface), and the parameters are greater as the front surface of the transfer belt shakes to a greater extent of variation.

More specifically, when overshoot ratio E [-] takes a relatively great value, the front surface of the transfer belt has been displaced to a greater extent. When primary displacement rate k1 [μm/s] takes a relatively great value, primary displacement of the transfer belt has occurred at a higher speed. When secondary displacement rate k2 [μm/s] takes a relatively great value, secondary displacement of the transfer belt has occurred at a higher speed.

Intermediate transfer belt 21 in the present embodiment satisfies first to third conditions below.

The first condition is that overshoot ratio E [-] satisfies a condition of $0.2 \leq E \leq 3$. With intermediate transfer belt 21 satisfying the first condition, high transferability even to a recording medium with surface irregularities can be achieved and lowering in quality of an image due to repeated use can be suppressed.

When overshoot ratio E [-] satisfies a condition of $E<0.2$, the front surface of the transfer belt does not much shake in spite of pressurization of the transfer belt from the rear surface side and a sufficient effect in terms of transferability cannot be expected. When overshoot ratio E [-] satisfies a condition of $3<E$, break or wear of the transfer belt may occur in an early stage due to repeated use and lowering in quality of an image is concerned.

The second condition is that primary displacement rate k1 μ[m/s] described above satisfies a condition of $60 \leq k1 \leq 320$. With intermediate transfer belt 21 satisfying the second condition, high transferability even to a recording medium with surface irregularities can be achieved and lowering in quality of an image due to repeated use can be suppressed.

When primary displacement rate k1 μ[m/s] satisfies a condition of $k1<60$, the front surface of the transfer belt does not much shake in spite of pressurization of the transfer belt from the rear surface side and a sufficient effect in terms of transferability cannot be expected. When primary displacement rate k1 μ[m/s] satisfies a condition of $320<k1$, break or wear of the transfer belt may occur in an early stage due to repeated use and lowering in quality of an image is concerned.

The third condition is that secondary displacement rate k2 [μm/s] described above satisfies a condition of 6≤k2≤30. With intermediate transfer belt 21 satisfying the third condition, high transferability even to a recording medium with surface irregularities can be achieved and lowering in quality of an image due to repeated use can be suppressed.

When secondary displacement rate k2 [μm/s] satisfies a condition of k2<6, the front surface of the transfer belt does not much shake in spite of pressurization of the transfer belt from the rear surface side and a sufficient effect in terms of transferability cannot be expected. When secondary displacement rate k2 satisfies a condition of 30<k2, break or wear of the transfer belt may occur in an early stage due to repeated use and lowering in quality of an image is concerned.

Overshoot ratio E [-], primary displacement rate k1 μ[m/s], and secondary displacement rate k2 described above are found by calculating an average value of four remaining values excluding three greatest values and three smallest values among values calculated from 10 pieces in total of chronological data obtained by varying a position of measurement region MR in the method of evaluating a belt with displacement amount measurement apparatus 100 described above.

<Relation Between Pattern of Displacement and Transferability>

A reason why high transferability can be ensured when a belt exhibiting a pattern with an overshoot portion is employed as an intermediate transfer belt of an image formation apparatus to form an image on embossed paper will now be described in detail.

Figure 18A:
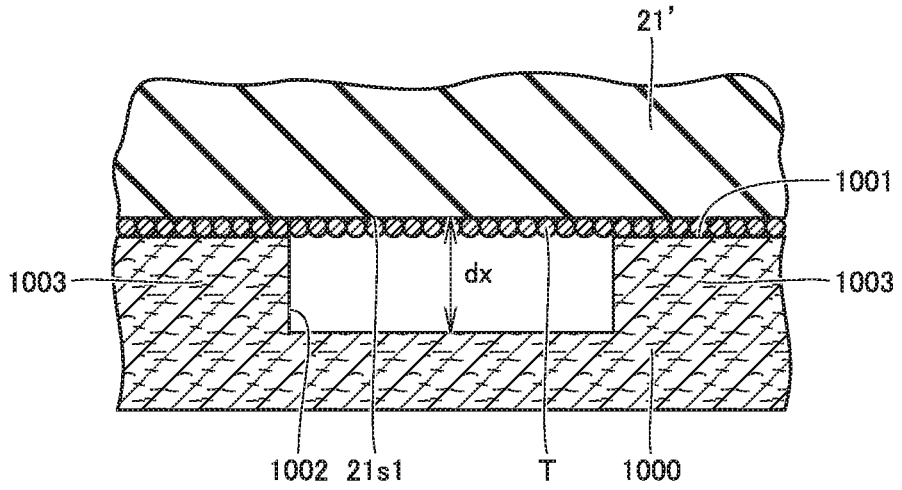
FIGS. 18A and 18B are a schematic diagram and a graph for illustrating movement of toner from the transfer belt to embossed paper when a transfer belt consisting of a non-elastic layer is employed and relation between an applied voltage and transfer efficiency, respectively.
Figure 18B:
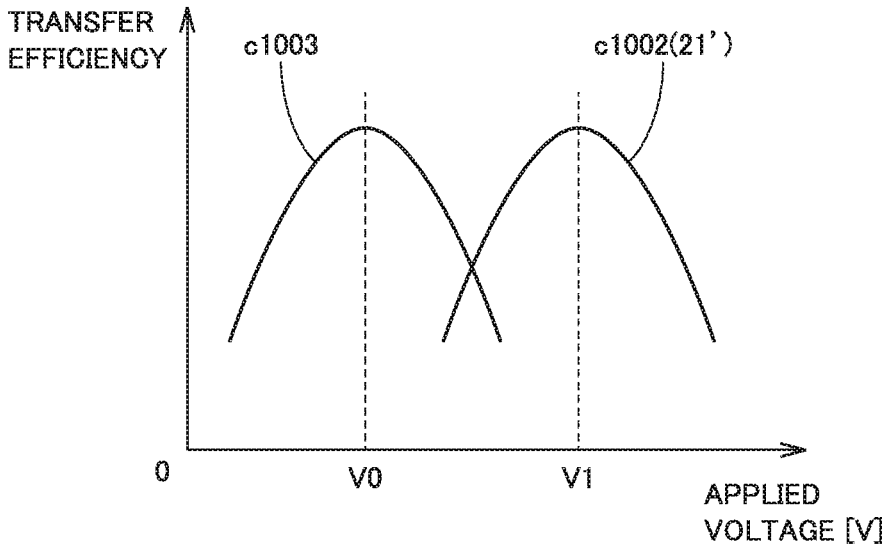

FIG. 18A is a schematic diagram illustrating movement of toner from the transfer belt to embossed paper when the transfer belt consisting of a non-elastic layer is employed and FIG. 18B is a graph illustrating relation between a voltage applied in that case and transfer efficiency.

As shown in FIG. 18A, when a toner image is transferred to recording medium 1000 which is embossed paper with a transfer belt 21' consisting of a non-elastic layer, recording surface 1001 of a portion where a recess 1002 in embossed paper is not located (which is referred to as a projection 1003 below for the sake of convenience) and toner T located on first main surface 21*s*1 of transfer belt 21' are in contact with each other. Recording surface 1001 of a portion where recess 1002 in embossed paper is located and toner T located on first main surface 21*s*1 of transfer belt 21' are not in contact with each other.

Therefore, in order to move toner T to the bottom surface of recess 1002 in embossed paper, toner T should be caused to jump from transfer belt 21'. In order to have toner T jump from transfer belt 21', force received from electric field by toner T should overcome adhesion force of toner T to transfer belt 21'. Adhesion force is the sum of non-electrostatic adhesion force (van der Waals forces) and electrostatic adhesion force (electrostatic attractive force by charges of charged toner and image charges produced in the transfer belt).

Force F received by toner T from electric field is expressed as F=q×dV/dx where q represents an amount of charges of toner T, dV represents a potential difference between embossed paper and transfer belt 21', and dx represents a distance between embossed paper and transfer belt 21'. As is understood from this relation, force F is in proportion to potential difference dV between embossed paper and transfer belt 21'. Therefore, as distance dx is greater, an applied voltage required for having toner T jump increases.

Therefore, as shown in FIG. 18B, an applied voltage V1 at which efficiency of transfer in recess 1002 is maximum is higher than an applied voltage VO at which efficiency of transfer in projection 1003 is maximum. In FIG. 18B, a curve showing relation between an applied voltage and efficiency in transfer to projection 1003 is denoted with a sign c1003 and a curve showing relation between an applied voltage and efficiency in transfer to recess 1002 is denoted with a sign c1002 (21').

Normally, in an image formation apparatus, an applied voltage is set around applied voltage V0 at which transfer efficiency is maximum in projection 1003. Therefore, as efficiency of transfer in recess 1002 is higher around applied voltage V0, a difference in density of an image between recess 1002 and projection 1003 of embossed paper is smaller and an image higher in quality can be obtained.

Figure 19A:
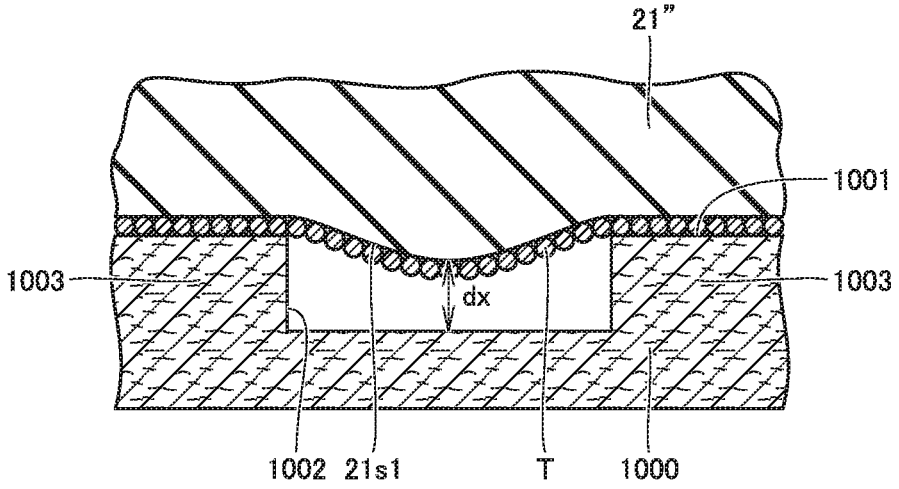
FIGS. 19A and 19B are a schematic diagram and a graph for illustrating movement of toner from the transfer belt to embossed paper when a transfer belt including an elastic layer is employed and relation between an applied voltage and transfer efficiency, respectively.
Figure 19B:
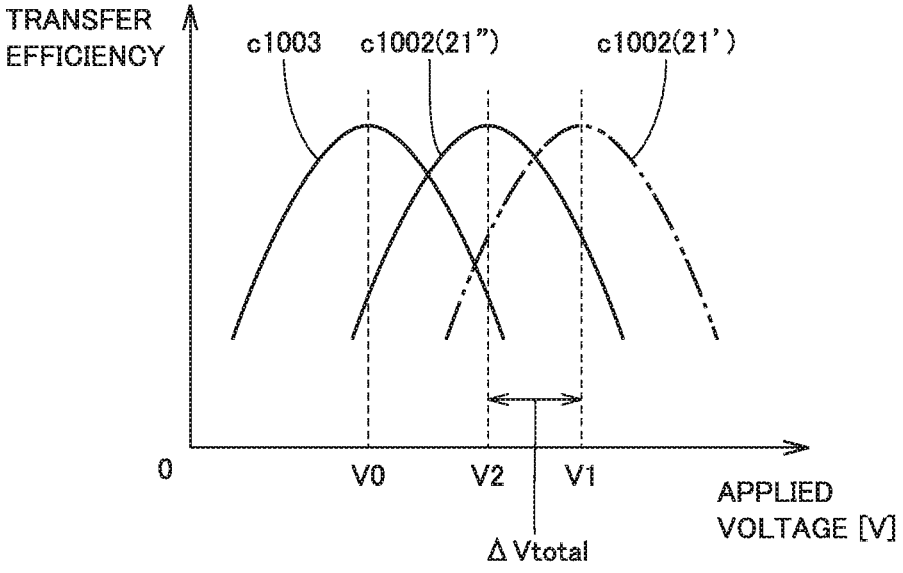

FIG. 19A is a schematic diagram showing movement of toner from the transfer belt to embossed paper when the transfer belt including an elastic layer is employed and FIG. 19B is a graph illustrating relation between a voltage applied in that case and transfer efficiency.

As shown in FIG. 19A, when a transfer belt 21" including an elastic layer is employed, in general, transfer belt 21" deforms such that a part of transfer belt 21" on a side of first main surface 21*s*1 enters recess 1002 in embossed paper and distance dx between the bottom surface of recess 1002 of embossed paper and transfer belt 21" thus decreases. Therefore, an effect of lowering in applied voltage at which efficiency of transfer in recess 1002 is maximum is obtained. This effect has conventionally been known and it is referred to as a following deformation effect.

When transfer belt 21" including the elastic layer exhibits a pattern with an overshoot portion described above, first main surface 21*s*1 significantly shakes in deformation of transfer belt 21" described above. As first main surface 21*s*1 deforms as expanding or contracting, positional relation between transfer belt 21" and toner T which adheres thereto (that is, a distance between toner T and first main surface 21*s*1 or an area of contact therebetween) is varied and adhesion force of toner T to transfer belt 21" is lowered. Therefore, an effect of further lowering in applied voltage at which efficiency of transfer in recess 1002 is maximum is obtained. This effect has not conventionally been known but has been found by the present inventor, and it is referred to as an adhesion force lowering effect.

As such a following deformation effect or an adhesion force lowering effect in addition thereto is exhibited, as shown in FIG. 19B, an applied voltage V2 at which efficiency of transfer in recess 1002 is maximum is lower than applied voltage V1 at which efficiency of transfer in recess 1002 is maximum when transfer belt 21' consisting of the non-elastic layer described above is employed. In FIG. 19B, a curve showing relation between an applied voltage and efficiency in transfer in recess 1002 is denoted with a sign c1002 (21").

Therefore, as compared with an example where transfer belt 21' consisting of the non-elastic layer described above is employed, efficiency of transfer in recess 1002 is higher around applied voltage V0, a difference in density of an image between recess 1002 and projection 1003 in embossed paper is smaller, and an image higher in quality can be obtained.

The adhesion force lowering effect is particularly noticeably obtained in a transfer belt exhibiting a pattern with an overshoot portion in transition of an amount of displacement measured with displacement amount measurement apparatus 100. An extent of the obtained effect is significantly associated with the overshoot portion in the pattern described above.

When primary displacement rate k1 μ[s] described above is sufficiently high, the first main surface of the transfer belt experiences primary displacement at a high speed in an early stage of passage of the transfer belt through the nip portion and the high adhesion force lowering effect is obtained. When overshoot ratio E [-] described above is sufficiently high, fast and complicated deformation of the first main surface of the transfer belt is caused in an intermediate stage of passage of the transfer belt through the nip portion and the high adhesion force lowering effect is obtained. When secondary displacement rate k2 μ[m/s] described above is sufficiently high, the first main surface of the transfer belt experiences secondary displacement at a high speed in a last stage of passage of the transfer belt through the nip portion and the high adhesion force lowering effect is obtained.

Referring to FIG. 19B, relation of ΔVtotal=ΔVgap+ΔVadh is satisfied where ΔVtotal represents a difference between applied voltage V1 and applied voltage V2 described above, ΔVgap represents a decrement in applied voltage at which efficiency of transfer in recess 1002 is maximum owing to the following deformation effect described above, and ΔVadh represents a decrement in applied voltage at which efficiency of transfer in recess 1002 is maximum owing to the adhesion force lowering effect described above.

Since ΔVtotal is expressed as V1-V2 as above, ΔVadh is expressed as V1-V2-ΔVgap. V1 and V2 take values specific to each transfer belt and a value thereof can be derived through experiments. ΔVgap can experimentally be derived from amount of displacement y of measurement region MR of belt S measured with the method of evaluating a belt with displacement amount measurement apparatus 100 described above. Therefore, ΔVadh can be calculated through computation from these values.

<Experiment for Confirming Relation of Overshoot Ratio E, Primary Displacement Rate k1, and Secondary Displacement Rate k2 with ΔVadh>

The present inventor has manufactured a number of belts different in composition of an elastic layer by variously preparing a type or an amount of a resin, an additive, and a cross-linking agent to be contained in the elastic layer, evaluated the belts based on the method of evaluating a belt with displacement amount measurement apparatus 100 described above, and found overshoot ratio E, primary displacement rate k1, and secondary displacement rate k2 of each belt.

A value for V2 of each belt is found by selecting a plurality of belts different from one another in overshoot ratio E, primary displacement rate k1, and secondary displacement rate k2 from among these belts and experimentally measuring efficiency in transfer to the recess in embossed paper by using the plurality of selected belts. In measurement of V2, displacement amount measurement apparatus 100 shown in FIG. 13A is used, a belt to be measured and embossed paper are arranged as being sandwiched between lower block 110 and upper block 120, and a voltage is applied to lower block 110 and upper block 120 such that there is a potential difference between lower block 110 and upper block 120. A voltage at which highest transfer efficiency is achieved with an applied voltage being variously varied is defined as V2.

A value for V1 is found by conducing similar measurement for an non-elastic belt, and ΔVgap is calculated through computation from an amount of displacement of measurement region MR of each belt measured with the method of evaluating a belt with displacement amount measurement apparatus 100.

Figure 20:
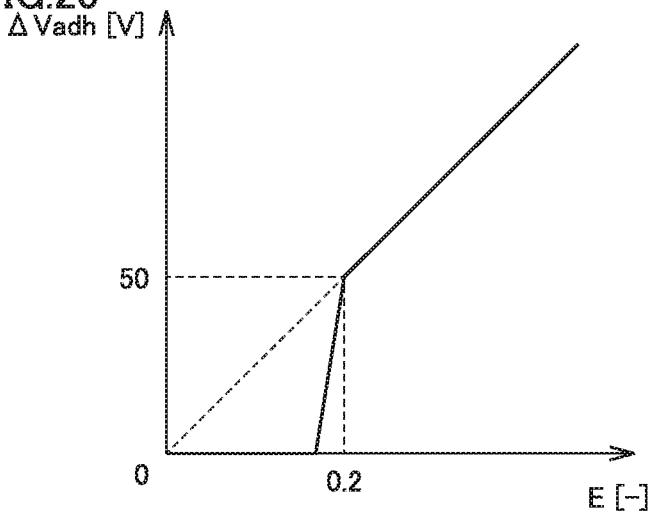
FIG. 20 is a graph showing relation between an overshoot ratio E and ΔVadh.
Figure 21:
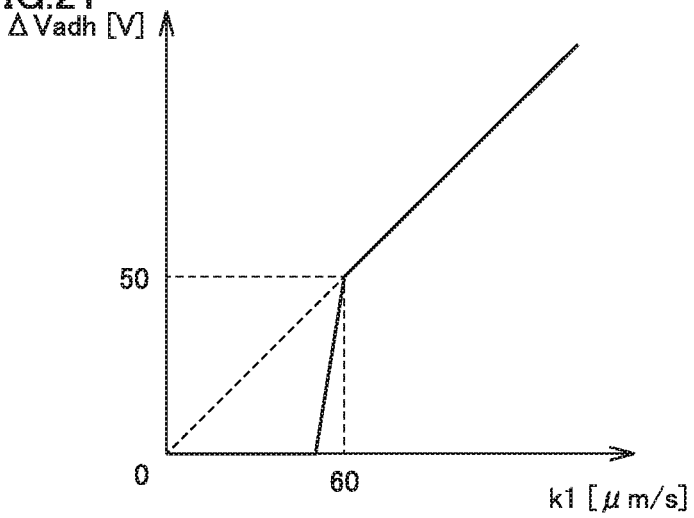
FIG. 21 is a graph showing relation between a primary displacement rate k1 and ΔVadh.
Figure 22:
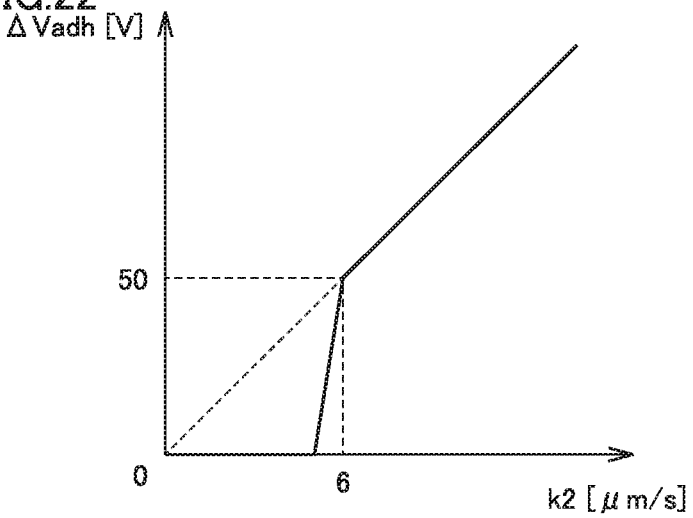
FIG. 22 is a graph showing relation between a secondary displacement rate k2 and ΔVadh.

Relation of overshoot ratio E, primary displacement rate k1, and secondary displacement rate k2 with ΔVadh is summed up based on data of each belt. FIG. 20 is a graph showing relation between overshoot ratio E and ΔVadh. FIG. 21 is a graph showing relation between primary displacement rate k1 and ΔVadh. FIG. 22 is a graph showing relation between secondary displacement rate k2 and ΔVadh.

As is understood from FIG. 20, it has been confirmed that, in relation between overshoot ratio E and ΔVadh, ΔVadh is lower than 50 [V] in a range of 0≤E<0.2 and the adhesion force lowering effect is hardly obtained. In a range of 0.2≤E, it has been confirmed that, with increase in value for overshoot ratio E, ΔVadh tends to increase beyond 50 [V] and the high adhesion force lowering effect is obtained.

As is understood from FIG. 21, it has been confirmed that, in relation between primary displacement rate k1 and ΔVadh, ΔVadh is lower than 50 [V] in a range of 0 k1<60 and the adhesion force lowering effect is hardly obtained. In a range of 60≤k1, it has been confirmed that, with increase in value for primary displacement rate k1, ΔVadh tends to increase beyond 50 [V] and the high adhesion force lowering effect is obtained.

As is understood from FIG. 22, it has been confirmed that, in relation between secondary displacement rate k2 and ΔVadh, ΔVadh is lower than 50 [V] in a range of 0≤k2<6 and the adhesion force lowering effect is hardly obtained. In a range of 6≤k2, it has been confirmed that, with increase in value for secondary displacement rate k2, ΔVadh tends to increase beyond 50 [V] and the high adhesion force lowering effect is obtained.

The results above serve as basis for setting a lower limit value for each of overshoot ratio E, primary displacement rate k1, and secondary displacement rate k2 under the first to third conditions described above, and show that the sufficient adhesion force lowering effect in addition to the following deformation effect described above is obtained by satisfying conditions on a side of the lower limit values for the first to third conditions.

<Mutual Relation Among Displacement Parameters>

When all three of overshoot ratio E, primary displacement rate k1, and secondary displacement rate k2 are sufficiently high, a very high adhesion force lowering effect is exhibited and high transferability to a recording medium with irregularities in a recording surface such as embossed paper can be ensured.

When a transfer belt exhibiting a pattern with an overshoot portion is employed, in transfer of toner to a recording medium small in height difference among irregularities such as non-embossed paper, the surface of the transfer belt deforms as completely following irregularities in the recording medium. An area of contact between the surface of the transfer belt and the surface of the recording medium thus increases, and consequently separability of the recording medium from the transfer belt tends to lower.

With the transfer belt high in secondary displacement rate k2, however, even though the surface of the transfer belt deforms as completely following irregularities in the recording medium in the central portion of the nip portion where a transfer pressure is highest, the transfer belt has already recovered from deformation around an exit of the nip portion. Since an area of contact between the surface of the transfer belt and the surface of the recording medium has decreased around the exit of the nip portion, the recording medium is readily separated from the transfer belt. In contrast, when the transfer belt low in secondary displacement rate k2 is employed, the surface of the transfer belt deforms as completely following irregularities in the recording medium in the central portion of the nip portion and thereafter deformation of the transfer belt has not sufficiently recovered around the exit of the nip portion. Therefore, the area of contact between the surface of the transfer belt and the surface of the recording medium remains large and the recording medium is less likely to be separated from the transfer belt.

Therefore, by setting not only overshoot ratio E and primary displacement rate k1 but also secondary displacement rate k2 to simultaneously be high, separability of the recording medium with irregularities from the transfer belt can be ensured while transferability to the recording medium is ensured.

(Time Constant τ of Transient Displacement)

In general, a time constant is employed as an indicator for a response speed in a transient phenomenon. When strain deformation of a viscoelastic body such as rubber is described, a delay in strain or a time period for relaxation of a stress may be called a time constant. As the time constant is smaller, strain deformation is fast and relaxation of a stress is also fast. As the time constant is larger, strain deformation is slow and relaxation of a stress is also slow. The time constant is an indicator for a rate of deformation and a rate of recovery from deformation.

The present inventor has paid attention to what should be called a time constant of transient displacement of a transfer belt and found that all of overshoot ratio E, primary displacement rate k1, and secondary displacement rate k2 can all be designed to be proper by successfully adjusting a time constant of transient displacement of the transfer belt. A time constant of transient displacement is defined as τ [s].

(Method of Measuring Time Constant τ)

Time constant τ is significantly different among belts. Time constant τ of belt S can be found from an amount of displacement of belt S to be measured with displacement amount measurement apparatus 100 described previously.

With the evaluation method described with reference to FIGS. 15 and 16, amount of displacement y is measured with a time period (that is, t0 described previously) from start of pressurization with displacement amount measurement apparatus 100 until pressurization reaches a highest pressure being varied, and overshoot ratio E is calculated from maximum value a and converged value b of amount of displacement y. A series of results of measurement thus obtained is plotted with the abscissa representing a duration of pressurization t0 and the ordinate representing overshoot ratio E.

Figure 23:
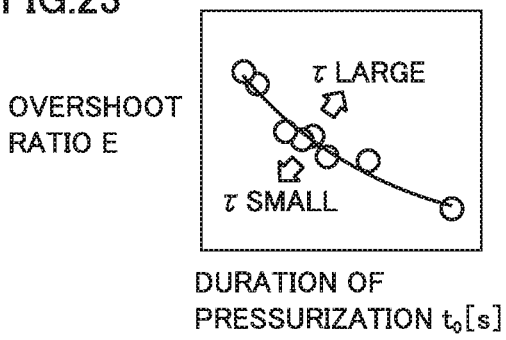
FIG. 23 is a graph showing relation between a duration of pressurization of the belt and an overshoot ratio when the belt is pressurized with the displacement amount measurement apparatus.

FIG. 23 is a graph showing relation between duration of pressurization t0 of belt S and overshoot ratio E when belt S is pressurized with displacement amount measurement apparatus 100. As shown in FIG. 23, when duration of pressurization t0 is increased, that is, when a rate of pressurization is lowered, an internal stress is relaxed in a relatively early stage. Therefore, transient displacement (overshoot) due to concentration of the internal stress is less likely and overshoot ratio E is lower.

As shown in FIG. 23, such a series of results of measurement that overshoot ratio E exponentially attenuates as duration of pressurization t0 is longer is plotted. Time constant τ is found by curve-fitting the plot to an exponential function as follows, which is defined by time constant τ and a constant α[-]. Constant α is an arbitrary coefficient.

$$E=\alpha\times\exp(-t0/\tau)$$

As shown in FIG. 23, when time constant τ is small, a graph is such that overshoot ratio E abruptly attenuates with increase in duration of pressurization t0. When time constant τ is large, a graph is such that overshoot ratio E gently attenuates with increase in duration of pressurization t0. Time constant τ is one indicator for a time period for relaxation (a relaxation rate) of the internal stress.

A rate of deformation of a belt and a rate of relaxation of an internal stress are in positive correlation. A belt fast in strain deformation is also fast in relaxation of an stress, whereas a belt slow in strain deformation is also slow in relaxation of a stress. Therefore, time constant τ serves as an indicator for both of a rate of deformation of the belt and a rate of relaxation of the internal stress.

(Relation Between Time Constant τ and Waveform of Displacement)

Figure 24:
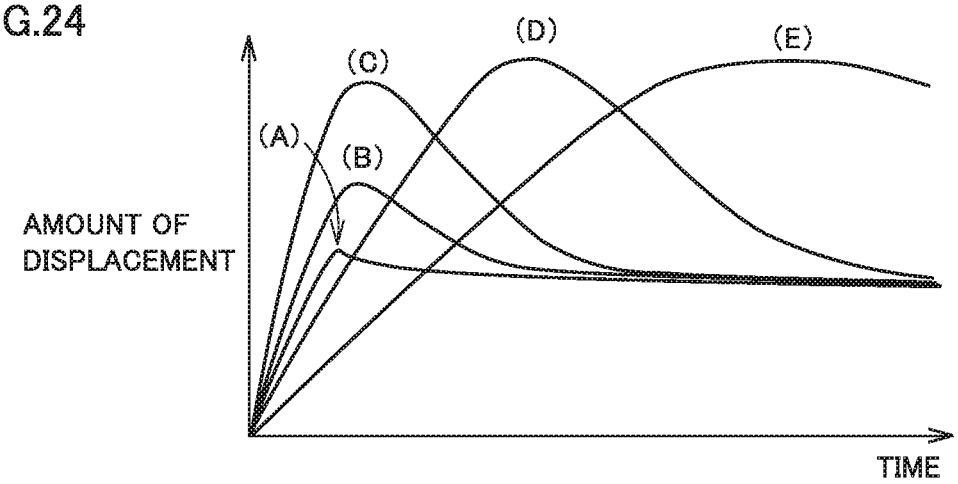
FIG. 24 is a graph showing a behavior of displacement of belts different in time constant.

FIG. 24 is a graph showing a behavior of displacement of belts different in time constant τ. A number of belts are manufactured by variously adjusting a type and an amount of a resin, an additive, and a cross-linking agent to be contained in elastic layer 21*b* (FIG. 2). These belts are different in composition of elastic layer 21*b* and consequently different in time constant τ. FIG. 24 shows transition of an amount of displacement with a duration of pressurization obtained in measurement of these belts with the evaluation method described with reference to FIGS. 15 and 16 with displacement amount measurement apparatus 100. A graph (A), a graph (B), a graph (C), a graph (D), and a graph (E) shown in FIG. 24 are greater in time constant τ in this order. As shown in FIG. 24, a tendency as below is observed between time constant τ and a waveform of transient displacement of the belt.

As shown in the graph (B) in FIG. 24, a belt relatively small in time constant τ is relatively fast in deformation and relaxation of the belt, and therefore it is high in primary displacement rate kl and secondary displacement rate k2 whereas it is slightly low in overshoot ratio E.

As shown in the graph (D) in FIG. 24, a belt relatively large in time constant τ is relatively slow in deformation and relaxation of the belt, and therefore it is high in overshoot ratio E whereas it is slightly low in primary displacement rate kl and secondary displacement rate k2.

The graph (C) in FIG. 24 is intermediate between the graph (B) and the graph (D) in time constant τ, and overshoot ratio E, primary displacement rate kl, and secondary displacement rate k2 are all high in a good balance.

As shown in the graph (A) in FIG. 24, when time constant τ is further smaller than in the graph (B), overshoot ratio E is further lower. As a result of lowering in overshoot ratio E, primary displacement rate kl and secondary displacement rate k2 are also lower.

As shown in the graph (E) in FIG. 24, when time constant τ is further greater than in the graph (D), primary displacement rate k1 and secondary displacement rate k2 are further lower and overshoot ratio E tends to be saturated.

Therefore, the belt having moderate time constant τ as shown in the graph (B), the graph (C), and the graph (D) in FIG. 24 achieves sufficiently high overshoot ratio E, primary displacement rate k1, and secondary displacement rate k2.

Figure 25:
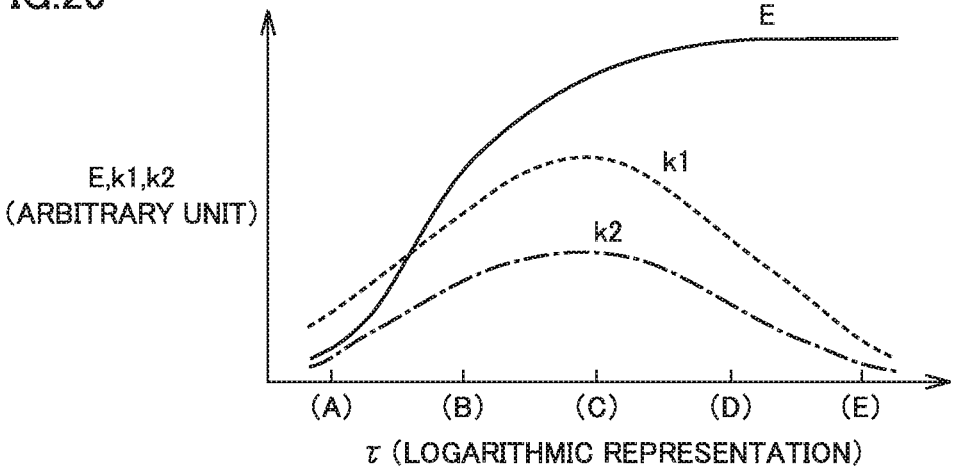
FIG. 25 is a graph showing relation of an overshoot ratio, a primary displacement rate, and a secondary displacement rate with a time constant.

FIG. 25 is a graph showing relation of overshoot ratio E, primary displacement rate k1, and secondary displacement rate k2 with time constant τ. FIG. 25 shows approximation curves of plots of overshoot ratio E, primary displacement rate k1, and secondary displacement rate k2, and time constant τ obtained by measurement of a number of belts different in composition of elastic layer 21*b* with the evaluation method described with reference to FIGS. 15 and 16 with displacement amount measurement apparatus 100.

The abscissa in the graph shown in FIG. 25 represents time constant τ in a logarithmic representation. The ordinate in the graph shown in FIG. 25 represents overshoot ratio E, primary displacement rate k1, and secondary displacement rate k2. In the graph in FIG. 25, with importance being placed on ease of understanding of the drawing, a scale on the ordinate of the graph is adjusted as appropriate. In the graph in FIG. 25, a scale on the ordinate is different for each of overshoot ratio E, primary displacement rate k1, and secondary displacement rate k2.

As shown in FIG. 25, overshoot ratio E is lower as time constant τ is smaller. When time constant τ is small, deformation of the belt and relaxation of an internal stress occur very fast and hence strain of the belt is less likely to concentrate in hole 113 (FIG. 16) in displacement amount measurement apparatus 100. Consequently, when displacement of the center of hole 113 is observed with displacement meter 150, overshoot is less likely to occur and measured overshoot ratio E is lower.

Overshoot ratio E is higher with increase in time constant τ. As time constant τ is greater, deformation of the belt and relaxation of an internal stress occur more slowly and hence strain of the belt is concentrated to the center of hole 113. Consequently, overshoot is more likely and measured overshoot ratio E is higher.

Overshoot ratio E is saturated when it becomes high to some extent. Overshoot ratio E is saturated at a value at which strain of the belt is concentrated to a maximum extent and does not increase any more.

When time constant τ is large, primary displacement rate k1 takes a small value because deformation of the belt is slow. With decrease in time constant τ, deformation of the belt occurs faster and primary displacement rate k1 increases. With further decrease in time constant τ, primary displacement rate k1 again decreases. Though a rate of deformation of the belt increases with decrease in time constant τ, overshoot ratio E is lower when time constant τ is smaller, and hence maximum value a of the amount of displacement is smaller. Consequently, an inclination of the amount of displacement toward maximum value a, that is, a rate of increase in displacement, is also smaller. Thus, relation of primary displacement rate kl with time constant τ is in a shape projecting upward as having a peak when time constant τ attains to a certain value.

When time constant τ is large, secondary displacement rate k2 is low because relaxation of an internal stress of the belt is slow. With decrease in time constant τ, relaxation of the internal stress of the belt occurs faster and secondary displacement rate k2 increases. With further decrease in time constant τ, secondary displacement rate k2 again decreases. Though a rate of relaxation of the internal stress of the belt increases with decrease in time constant τ, overshoot ratio E is lower when time constant τ is smaller, and hence a difference between maximum value a and converged value b of the amount of displacement is smaller. Consequently, an inclination of the amount of displacement toward converged value b after it has attained to maximum value a, that is, a rate of decrease in displacement, is also smaller. Thus, relation of secondary displacement rate k2 with time constant τ is in a shape projecting upward as having a peak when time constant τ attains to a certain value.

Therefore, as shown in FIG. 25, a range of time constant τ in which each of overshoot ratio E, primary displacement rate k1, and secondary displacement rate k2 takes a large value includes an overlapping region.

In FIG. 25, the abscissa represents time constant τ corresponding to each of the graphs (A), (B), (C), (D), and (E) described with reference to FIG. 24.

(Relation Between Time Constant τ and Adhesion Force Lowering Effect)

Figure 26:
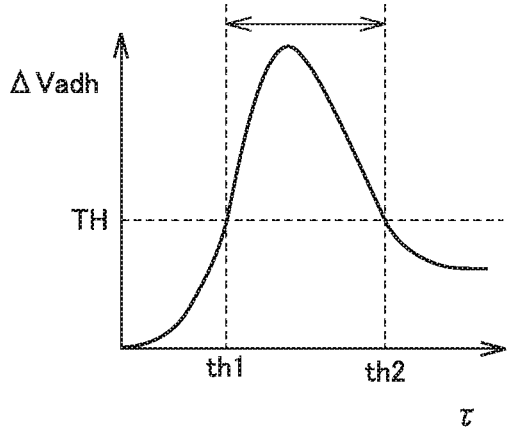
FIG. 26 is a graph showing relation between a time constant and an adhesion force lowering effect.

FIG. 26 is a graph showing relation between time constant τ and the adhesion force lowering effect. FIG. 26 shows an approximation curve of a plot of time constant τ found by curve-fitting described with reference to FIG. 23 and ΔVadh calculated based on V1, V2, and ΔVgap described above, with the abscissa representing time constant τ and the ordinate representing ΔVadh of a number of belts different in composition of the elastic layer described above.

As shown in FIG. 26, relation of ΔVadh with time constant τ is in a shape projecting upward as having a peak when time constant τ attains to a certain value. It can be seen that, with a lower limit value for ΔVadh at which an image quality improvement effect is noticeably obtained being denoted with TH, a range of time constant τ satisfying a range of ΔVadh≥TH, that is, th1≤τ≤th2, achieves a high adhesion force lowering effect and is ideal.

EXAMPLE

In an Example, an image formation apparatus manufactured by Konica Minolta Inc. (a digital printer: bizhub PRESS C8000) was used to actually form an image, with an intermediate transfer belt provided therein being varied to various belts exhibiting a pattern with an overshoot portion.

A rigid roller made of a metal (composed of SUS) having a diameter of 40 mm was employed as a secondary transfer roller of the image formation apparatus. A roller having a diameter of 40 mm in which an elastic layer composed of a sponge and rubber was provided around a core having a diameter of 24 mm was employed as an opposed roller. A hardness measured with a micro durometer (MD-1 manufactured by Kobunshi Keiki Co., Ltd.) was 40°. A pressure in the secondary transfer portion was set to 200 kPa. A length in an axial direction of a nip was set to 340 mm.

(Evaluation of Transferability to Paper with Irregularities)

Embossed paper manufactured by Tokushu Tokai Paper Co., Ltd. and having a trade name Leathac (registered trademark) 66 was used for evaluation of transferability. A grammage of this embossed paper was 302 [g/m$^2$]. A formed image was a solid image. In determination, a micro densitometer was used to measure a reflection density of a sharp and deep recess (groove) and a reflection density of a projection and a difference in density therebetween was calculated. A particularly good example in which a difference in density was less than 0.15 was determined as "excellent", a good example in which a difference in density was not less than 0.15 and less than 0.25 was determined as "good," an example in which a difference in density was at an allowable level not less than 0.25 and less than 0.40 was determined as "satisfactory," and an example in which a difference in density was at an unallowable level not less than 0.40 was determined as "failure".

(Evaluation of Separability of Paper)

Plain paper having a trade name J paper manufactured by Konica Minolta Inc. was employed for evaluation of separability. A grammage of this paper was 64 [g/m$^2$]. In determination, 1000 copies of an image variously different in density were printed, and the number of times of paper jamming due to insufficient separation in the secondary transfer portion during printing was counted. A good example in which no paper jamming occurred was determined as "good", an allowable level of occurrence of paper jamming three times or less was determined as "satisfactory", and an unallowable level of occurrence of paper jamming four times or more was determined as "failure".

(Results of Evaluation)

A plurality of belts different in composition of an elastic layer were evaluated with displacement amount measurement apparatus 100 described above based on the method of evaluating a belt described with reference to FIGS. 15 and 16, and time constant τ, overshoot ratio E, primary displacement rate k1, and secondary displacement rate k2 of each belt were found. An image formation apparatus in which each belt was applied as the intermediate transfer belt was used for evaluation of printing on paper of an A4 size under such conditions as a temperature of 20° C., a humidity of 50%, and a linear velocity (system speed) of an outer circumferential surface of the secondary transfer roller and the opposed roller of 200 [mm/s] FIG. 27 is a table showing results of evaluation of the belts and results of evaluation of the image in Examples.

Belt types A to G shown in FIG. 27 were all manufactured by the present inventor, of which base layer was composed of polyimide and elastic layer was composed of nitrile rubber. A composition of the elastic layer in each belt was different by variously preparing a type or an amount of a resin, an additive, and a cross-linking agent contained in the elastic layer, and consequently time constant τ was different. A belt type X was not manufactured by the present inventor but was an intermediate transfer belt employed in a commercially available image formation apparatus, of which base layer was composed of polyimide and elastic layer was composed of chloroprene rubber.

Belt type A employed in Example 1 is a belt expected to achieve the highest adhesion force lowering effect. When this belt was employed, the high adhesion force lowering effect was expressed, particularly good transferability in the recess in embossed paper was obtained, and separability from non-embossed paper was also good.

In Examples 1 to 5, the high adhesion force lowering effect was expressed, particularly good transferability in the recess of embossed paper was obtained, and separability from non-embossed paper was also equal to or higher than the allowable level. In the belts in Examples 1 to 5, time constant τ was in a range of 0.015 ≤τ≤0.1. Thus, a threshold value th1 which is a lower limit value for time constant τ shown in FIG. 26 can be set to 0.015 and a threshold value th2 which is an upper limit value for time constant τ can be set to 0.1. By thus controlling a range of time constant τ and employing an intermediate transfer belt of which time constant τ satisfies a condition of 0.015≤τ≤0.1, transferability to paper with irregularities and paper separability can both be achieved.

Belts employed in Comparative Example 1 and Comparative Example 3 had time constant τ less than 0.015 which was out of the range above. In Comparative Example 1 and Comparative Example 3, sufficiently high values for overshoot ratio E, primary displacement rate k1, and secondary displacement rate k2 were not obtained.

Therefore, in Comparative Example 1 and Comparative Example 3, the adhesion force lowering effect was hardly expressed and good transferability in the recess in embossed paper was not obtained.

A belt employed in Comparative Example 2 had time constant τ greater than 0.1 which was out of the range above. In Comparative Example 2, though a high value for overshoot ratio E was obtained, sufficiently high values for primary displacement rate k1 and secondary displacement rate k2 were not obtained. Therefore, the adhesion force lowering effect was expressed to some extent and transferability in the recess in embossed paper remained at a good level. It is estimated that, since secondary displacement rate k2 was low in spite of high overshoot ratio E, the surface of the transfer belt deformed as completely following irregularities in paper in the central portion of the nip portion where a transfer pressure was highest, however, thereafter deformation did not sufficiently recover even around the exit of the nip portion, and hence an area of contact between the surface of the transfer belt and the surface of paper remained large. Thus, paper was less likely to be separated from the transfer belt and separability from non-embossed paper was at the failure level.

In Comparative Example 1 and Comparative Example 3, the result of paper separability was good. In Comparative Example 1 and Comparative Example 3, though secondary displacement rate k2 was low, overshoot ratio E was also low. It is estimated that the surface of the transfer belt was less likely to deform as completely following irregularities in paper in the central portion of the nip portion where a transfer pressure was highest and an amount of displacement itself was also small, and therefore the transfer belt had already recovered from deformation around the exit of the nip portion and an area of contact between the surface of the transfer belt and the surface of paper had been small. It is thus estimated that paper can readily be separated from the transfer belt.

It has been found based on the results above that when time constant τ is less than 0.015 or exceeds 0.1, both of transferability to paper with irregularities and paper separability cannot be achieved. It has been shown that, by appropriately controlling time constant τ to satisfy a condition of 0.015≤τ≤0.1, sufficiently high values for all of overshoot ratio E, primary displacement rate k1, and secondary displacement rate k2 can be obtained and hence both of transferability to paper with irregularities and paper separability can be achieved.

Therefore, by appropriately controlling time constant τ of transient displacement of intermediate transfer belt 21 to satisfy the condition of 0.015≤τ0.1, an image formation apparatus which can achieve high transferability also to a recording medium with surface irregularities, can suppress lowering in quality of an image due to repeated use, can reliably achieve separation of a recording medium which is difficult to be separated from the intermediate transfer belt such as paper small in thickness or highly tacky paper, and can achieve suppressed possibility of occurrence of jamming can be provided.

<Nip Pressurization Duration Tnip in Secondary Transfer Portion>

Even with intermediate transfer belt 21 including an elastic layer as above, when a combination between a duration of pressurization of intermediate transfer belt 21 in transfer to a recording medium and intermediate transfer belt 21 is inappropriate, the adhesion force lowering effect may not be exhibited and transferability to a recording medium with irregularities in a recording surface such as embossed paper may become poor. When a duration of pressurization is short, deformation of intermediate transfer belt 21 is delayed as failing to follow and hence an amount of transient displacement in nip portion N cannot sufficiently be obtained. Consequently, the adhesion force lowering effect is hardly expressed and good transferability in the recess in embossed paper cannot be obtained. When a duration of pressurization is long, a rate of relaxation of an internal stress of intermediate transfer belt 21 is dominant, and hence an amount of displacement of intermediate transfer belt 21 attenuates during pressurization and an amount of transient displacement in nip portion N cannot sufficiently be obtained. Consequently, the adhesion force lowering effect is hardly expressed and good transferability in the recess in embossed paper cannot be obtained. Realization of high transferability by appropriately setting a duration of pressurization during transfer in accordance with various intermediate transfer belts 21 will be described below.

Figure 28:
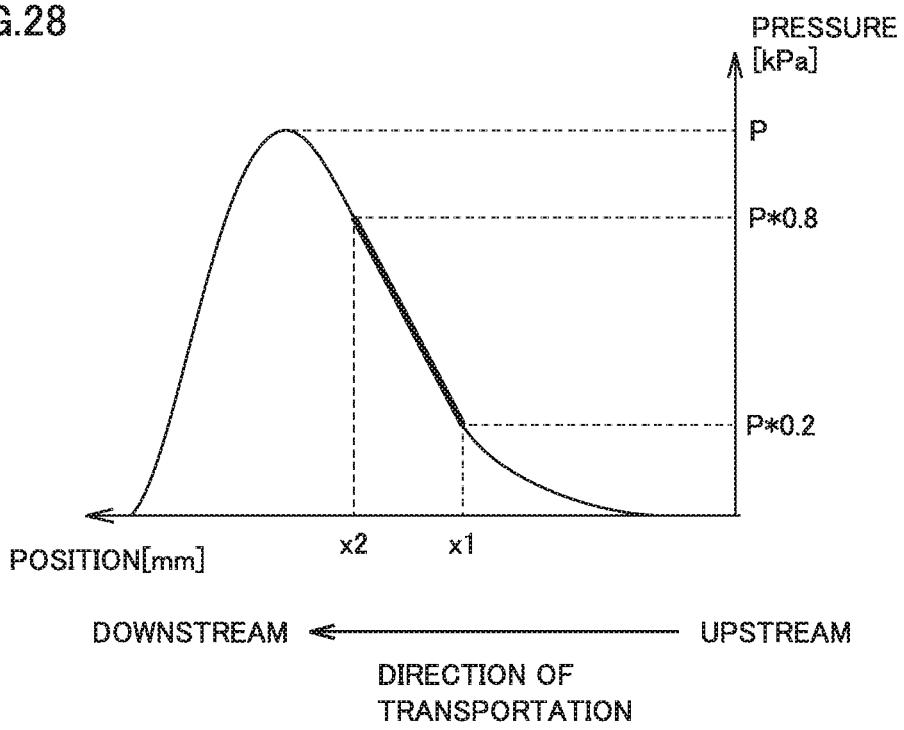
FIG. 28 is a graph showing a pressure received by the intermediate transfer belt in a direction of transportation of the intermediate transfer belt in a nip portion.

Initially, a duration of pressurization of an intermediate transfer belt in transfer of toner to a recording medium in image formation apparatus 1 will be described. FIG. 28 is a graph showing a pressure applied to intermediate transfer belt 21 in a direction of transportation of intermediate transfer belt 21 in nip portion N. A pressure distribution is measured by sandwiching a tactile sensor (a pressure distribution measurement system I-SCAN) manufactured by Nitta Corporation between secondary transfer roller 33 and intermediate transfer belt 21, setting intermediate transfer belt 21 to a stationary state, and bringing secondary transfer roller 33 in pressure contact.

In the graph shown in FIG. 28, the abscissa represents a direction of transportation of intermediate transfer belt 21 and the ordinate represents a pressure applied to intermediate transfer belt 21. A maximum pressure value P [kPa] is found based on a pressure distribution along the direction of transportation of intermediate transfer belt 21, and a position x1 [mm] in the direction of transportation at which a pressure attains to 20% (P*0.2) [kPa] of maximum value P [kPa] and a position x2 [mm] in the direction of transportation at which a pressure attains to 80% (P*0.8) [kPa] of maximum value P [kPa] within a range from the entry of nip portion N until the pressure reaches a peak pressure are found. As shown in FIG. 28, a pressure substantially linearly increases with respect to a position in the direction of transportation in a region between x1 and x2. A duration in which intermediate transfer belt 21 passes through the region between xl and x2 is defined as a nip pressurization duration Tnip [s]. Nip pressurization duration Tnip [s] can be calculated from system speed Vsys [mm/s] described above and expressed as Tnip=(x2−x1)/Vsys.

<Indicator Tm for Intermediate Transfer Belt>

Figure 29:
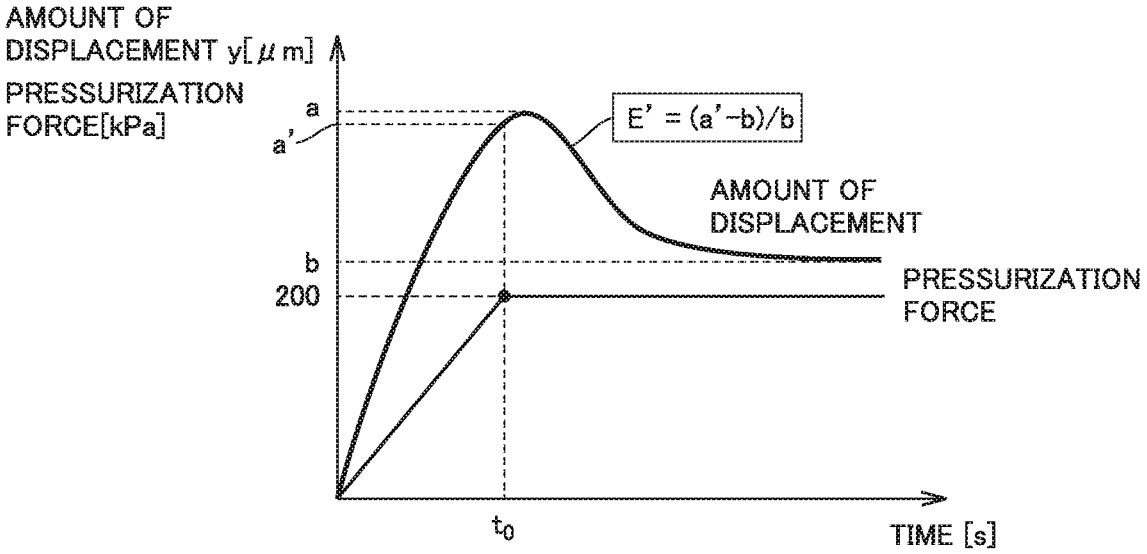
FIG. 29 is a graph showing relation between a behavior of displacement of a measurement region of the intermediate transfer belt and pressurization force applied to a pressurized region obtained in evaluation of the intermediate transfer belt with the displacement amount measurement apparatus.

An indicator for various intermediate transfer belts 21 will now be defined. FIG. 29 is a graph showing relation between a behavior of displacement of a measurement region of intermediate transfer belt 21 and force of pressurization against pressurized region PR obtained in evaluation of intermediate transfer belt 21 with displacement amount measurement apparatus 100. In measurement of displacement of intermediate transfer belt 21 with displacement amount measurement apparatus 100, after pressurization force reaches 200 [kPa] at a predetermined rate of pressurization [kPa/ms], constant pressurization force of 200 [kPa] is applied. Since pressurized region PR is held in such a state as being pressurized with constant pressurization force of 200 [kPa], even after the pressurization force reaches 200 [kPa] at t0 [s], an amount of displacement of intermediate transfer belt 21 increases and maximum value a [μm] of an amount of displacement may be observed with delay relative to to [s] (which is referred to as a "duration of pressurization" below).

When intermediate transfer belt 21 is pressurized in image formation apparatus 1, unlike evaluation with displacement amount measurement apparatus 100, after a pressure in nip portion N attains to the maximum, it promptly decreases as shown in FIG. 28 described above. In evaluation with displacement amount measurement apparatus 100, after the pressurization force attains to the maximum, it is held constant as it is. In nip portion N in image formation apparatus 1, however, the pressure is not held but it promptly lowers. Therefore, it is estimated that an amount of displacement attains to the maximum at a value smaller than a [μm] without reaching maximum amount of displacement a [μm] in the actual nip portion as shown in FIG. 29. In evaluation of intermediate transfer belt 21 with displacement amount measurement apparatus 100, an indicator which seems to be closer to an actual amount of displacement in nip portion N is introduced.

Figure 30:
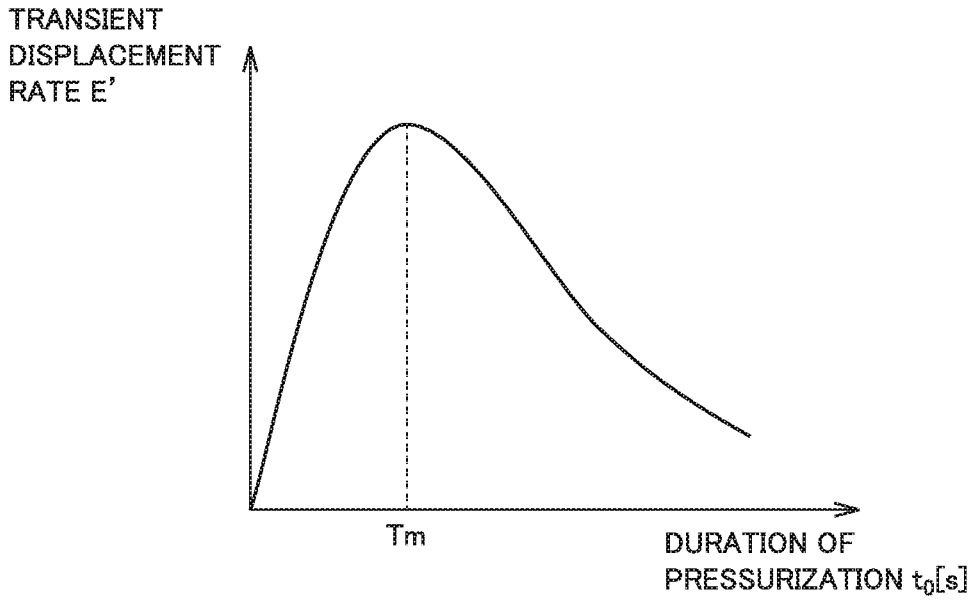
FIG. 30 is a graph showing relation between a duration of pressurization t0 [s] and a transient displacement rate E'[-].

As shown in FIG. 29, an amount of displacement in duration of pressurization t0 [s] is defined as a maximum transient displacement amount a' [μm] and a transient displacement rate E' [-] is defined as E'=(a'−b)/b. FIG. 30 is a graph showing relation between duration of pressurization t0 [s] and transient displacement rate E' As shown in FIG. 30, displacement amount measurement apparatus 100 is used to measure transient displacement rate E' [-] with t0 [s] shown in FIG. 29 being varied and relation between t0 [s] and transient displacement rate E' [-] is plotted in a graph. A graph in a shape projecting upward is obtained for intermediate transfer belt 21 according to the present invention. Here, t0 [s] when transient displacement rate E' [-] attains to a maximum value is defined as a transient response time period Tm [s]. Transient response time period Tm [s] is an indicator specific to each belt among intermediate transfer belts 21.

Figure 31A:
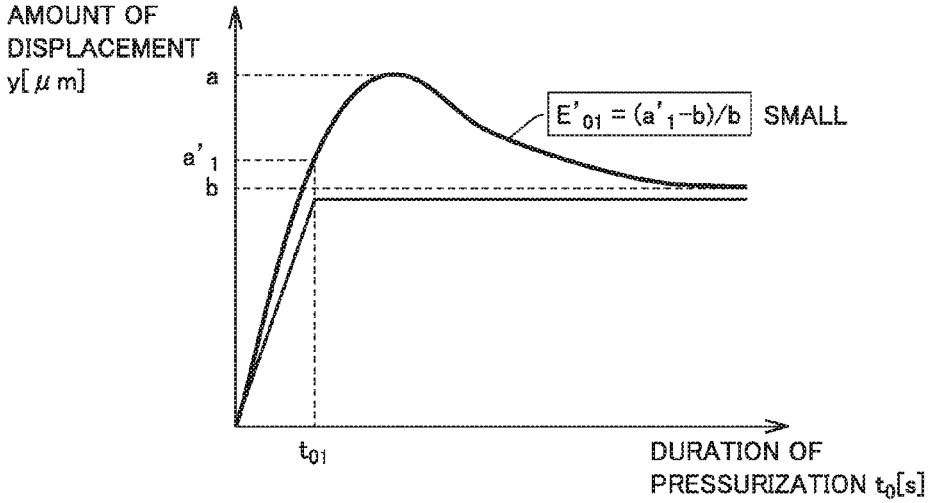
FIGS. 31A to 31C are diagrams showing differences in maximum transient displacement amount a' [μm] when t0 [s] is shorter than, substantially as long as, and longer than a transient response time period Tm [s], respectively.
Figure 31B:
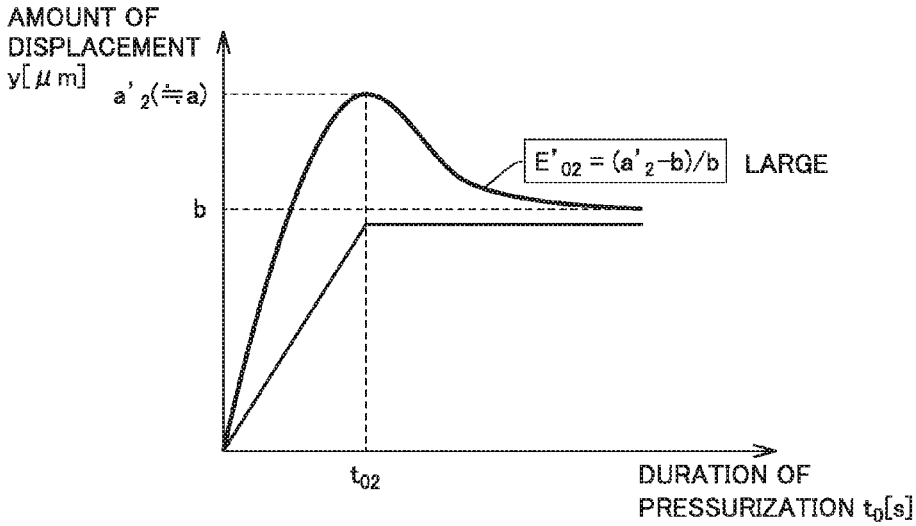
Figure 31C:
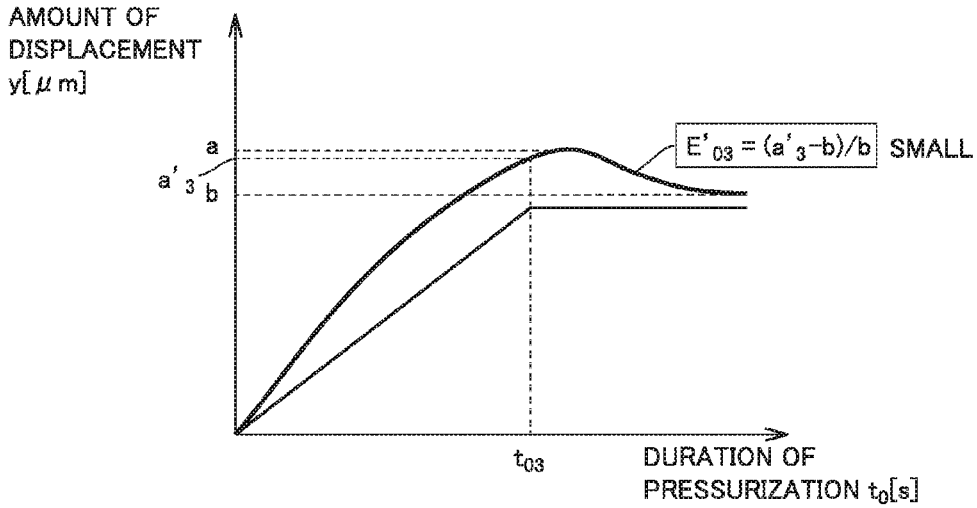

In order to express high transient displacement rate E' [-], relation between duration of pressurization t0 [s] and transient response time period Tm [s] is important. FIGS. 31A, 31B, and 31C are diagrams showing differences in maximum transient displacement amount a' [μm] when duration of pressurization t0 [s] is shorter than, substantially as long as, and long than transient response time period Tm [s], respectively.

A duration of pressurization in an example in which t0 [s] is shorter than Tm [s] (t0 <<Tm) is denoted as t01 [s], and a maximum transient displacement amount and a transient displacement rate at t01 [s] are denoted as a'1 [μm] and E'01 [-], respectively. In this case, deformation of intermediate transfer belt 21 is delayed as failing to follow. Therefore, as shown in FIG. 31A, maximum transient displacement amount a'1 [μm] is smaller than maximum value a [μm] of displacement and transient displacement rate E'01 [-] is lower.

A duration of pressurization in an example in which t0 is closer to Tm (t0 Tm) is denoted as t02 [s], and a maximum transient displacement amount and a transient displacement rate at t02 [s] are denoted as a'2 [μm] and E'02 [-], respectively. In this case, as shown in FIG. 31B, maximum transient displacement amount a'2 [μm] is substantially equal to maximum value a [μm] of displacement and transient displacement rate E' 02 [-] is higher.

A duration of pressurization in an example in which t0 is longer than Tm (Tm <<t0) is denoted as t03 [s], and a maximum transient displacement amount and a transient displacement rate at t03 [s] are denoted as a'3 [μm] and E'03 [-], respectively. In this case, a rate of relaxation of an internal stress of intermediate transfer belt 21 is dominant Therefore, as shown in FIG. 31C, a difference between maximum transient displacement amount a'3 [μm] and converged value b [μm] of displacement is smaller and transient displacement rate E' 03 [-] is lower.

<Relation Between Nip Pressurization Duration Tnip and Transient Response Time Period Tm>

Figure 32:
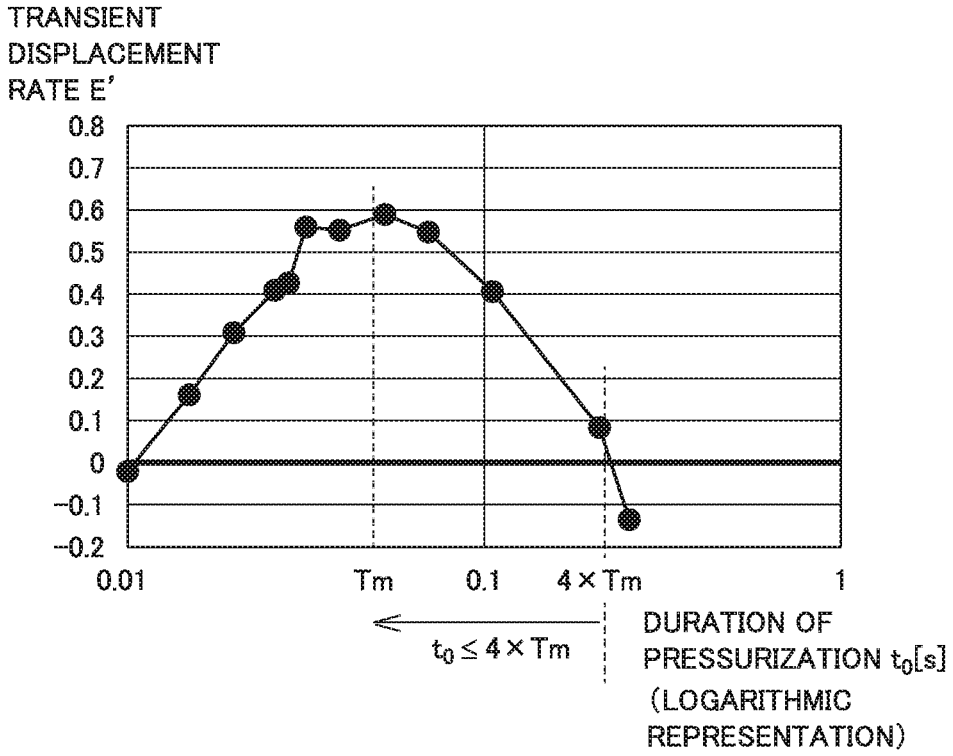
FIG. 32 is a graph in which relation between duration of pressurization t0 [s] and transient displacement rate E' is plotted with the abscissa representing t0 [s] in a logarithmic representation.
Figure 33:
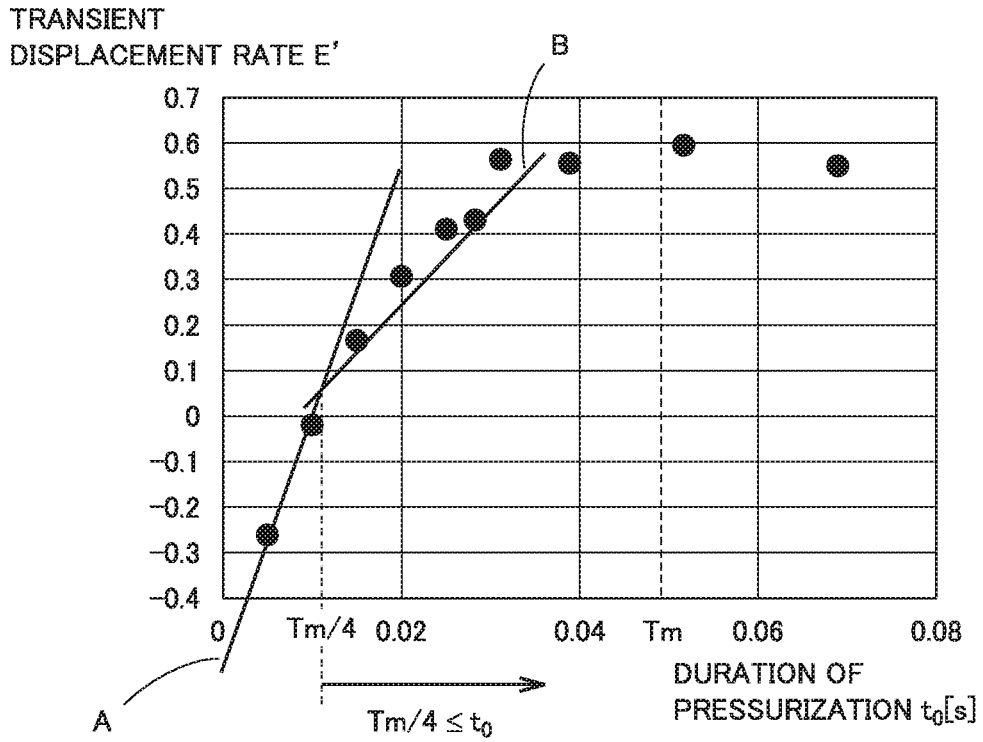
FIG. 33 is a graph showing a part of the graph shown in FIG. 32 as being enlarged with the abscissa being linearly represented.

FIG. 32 is a graph in which relation between duration of pressurization t0 [s] and transient displacement rate E' is plotted with the abscissa representing t0 [s] in a logarithmic representation. FIG. 33 is a graph showing a part of the graph shown in FIG. 32 as being enlarged with the abscissa being linearly represented. As considered with reference to FIG. 30, transient displacement rate E' [-] with respect to duration of pressurization t0 [s] draws a curve projecting upward and transient response time period Tm [s] can be found from a maximum value of transient displacement rate E' H. An optimal condition for duration of pressurization t0 [s] for exhibiting in a stable manner an effect of improvement in transferability to a recording medium with irregularities in a recording surface owing to lowering in adhesion force is considered with reference to FIGS. 32 and 33.

An upper limit value for duration of pressurization t0 [s] will initially be considered. In order to obtain the adhesion force lowering effect, transient displacement rate E' [-] desirably takes a positive value. It can be seen in the graph in FIG. 32 that the upper limit value for duration of pressurization t0 [s] in which a condition of E'>0 is satisfied is around Tm×4 and hence the upper limit value for duration of pressurization t0 [s] is determined as Tm×4.

A lower limit value for duration of pressurization t0 [s] will now be considered. It can be seen that a rate of change in transient displacement rate E' [-] is high in a region lower than an intersection between a straight line A and a straight line B in FIG. 33. In that region, even though duration of pressurization t0 [s] is slightly varied, a value for transient displacement rate E' [-] is significantly varied and greatly affects image quality, which is not preferred. Therefore, Tm/4 [s] around the intersection between straight line A and straight line B is defined as the lower limit value for duration of pressurization t0 [s].

From the foregoing, an optimal condition for t0 [s] for exhibiting in a stable manner the effect of improvement in transferability to a recording medium with irregularities in the recording surface owing to lowering in adhesion force is concluded as Tm/4 t0 Tm×4.

In the region between x1 and x2 in FIG. 28, a pressure applied to intermediate transfer belt 21 increases in proportion to a position in the direction of transportation. Under the pressurization condition as shown in FIG. 15 in evaluating intermediate transfer belt 21 with displacement amount measurement apparatus 100, pressurization force increases in proportion also in a region until duration of pressurization t0 [s].

Therefore, it can be estimated that nip pressurization duration Tnip [s] which is a time period for passage through the region between xl and x2 in image formation apparatus 1 corresponds to duration of pressurization t0 [s] representing a pressurization condition in evaluating intermediate transfer belt 21 with displacement amount measurement apparatus 100 shown in FIG. 13A. As described above, optimal condition for t0 [s] for exhibiting in a stable manner the effect of improvement in transferability to a recording medium with irregularities in the recording surface owing to lowering in adhesion force is defined as Tm/4≤t0 Tm×4. Therefore, it is concluded that Tm/4≤Tnip≤Tm×4 can be defined as a condition optimal for exhibiting in a stable manner the effect of improvement in transferability to a recording medium with irregularities in the recording surface owing to lowering in adhesion force.

As described above, relation between transient response time period Tm [s] which is an indicator for intermediate transfer belt 21 in evaluating intermediate transfer belt 21 with displacement amount measurement apparatus 100 and nip pressurization duration Tnip [s] representing a process condition in image formation apparatus 1 affects transferability. By adjusting Tnip [s] set by the process condition in image formation apparatus 1 in accordance with indicator Tm [s] for intermediate transfer belt 21 to satisfy Tm/4≤Tnip≤Tm×4, high transferability to a recording medium with irregularities in the recording surface can be achieved.

<Example A>

In Examples, an image formation apparatus manufactured by Konica Minolta Inc. (a digital printer: bizhub PRESS C8000) was used to actually form an image, with an intermediate transfer belt provided therein being varied to a belt exhibiting a displacement pattern shown in FIG. 17 and with a pressure increase rate ΔP/Δt being varied.

The intermediate transfer belt employed in the present Example had a base layer composed of polyimide and an elastic layer composed of nitrile rubber. The base layer had a thickness of 80 [μm] and the elastic layer had a thickness of 200 [μm]. A number of intermediate transfer belts different in composition of the elastic layer were prototyped by variously adjusting a type or an amount of a resin, an additive, and a cross-linking agent to be contained in the elastic layer. The belts were evaluated based on the method of evaluating intermediate transfer belt 21 with displacement amount measurement apparatus 100 and transient response time period Tm [s] of various intermediate transfer belts 21 was found. Influence by relation between transient response time period Tm [s] and nip pressurization duration Tnip [s] onto transferability to a recording medium with irregularities in the recording surface was checked. Evaluation was conducted with a rate of pressurization being set to 4 [kPa/ms] (t0=0.05 [s]).

(Transferability)

Embossed paper manufactured by Tokushu Tokai Paper Co., Ltd. having a trade name Leathac (registered trademark) 66 was used for checking transferability. A grammage of this embossed paper was 302 [g/m$^2$]. A formed image was a solid image. In determination, a micro densitometer was used to measure a reflection density of a sharp and deep recess and a reflection density of a projection and a difference in density therebetween was calculated. A difference in density less than 0.25 was determined as "good," a difference in density not less than 0.25 and less than 0.40 was determined as "satisfactory," and a difference in density not less than 0.40 was determined as "failure".

(Result of Evaluation)

FIG. 34 is a table showing results of checking of transferability to embossed paper (transferability to paper with irregularities) of intermediate transfer belt 21 with nip pressurization duration Tnip [s] being varied for belt type A of which transient response time period Tm [s] is 0.024 [s]. FIG. 35 is a table showing results of checking of transferability to embossed paper (transferability to paper with irregularities) of intermediate transfer belt 21 with nip pressurization duration Tnip [s] being set to 0.024 [s] for various intermediate transfer belts 21 different in transient response time period Tm [s].

In Example 6 in FIGS. 34 and 35, nip pressurization duration Tnip [s] representing the process condition in image formation apparatus 1 was adjusted in accordance with a value for transient response time period Tm [s] representing an indicator specific to each of various intermediate transfer belts 21. Consequently, the adhesion force lowering effect of intermediate transfer belt 21 was significantly expressed and particularly good transferability in the recess of embossed paper was obtained.

In Examples 7 to 10 in FIGS. 34 and 35, transient response time period Tm [s] and nip pressurization duration Tnip [s] satisfy relation of $Tm/4 \leq Tnip \leq Tm \times 4$. In results in Examples 6 to 10, the adhesion force lowering effect of intermediate transfer belt 21 was sufficiently expressed and good transferability in the recess in embossed paper at the allowable level was obtained.

<Comparative Example A>

In Comparative Example 4 in FIG. 34 and Comparative Example 7 in FIG. 35, relation between transient response time period Tm [s] and nip pressurization duration Tnip [s] satisfies $Tnip < Tm/4$. In this case, deformation of intermediate transfer belt 21 is delayed as failing to follow, and an amount of transient displacement in the nip is not sufficiently obtained. Consequently, the adhesion force lowering effect was hardly expressed and good transferability in the recess in embossed paper was not obtained.

In Comparative Example 5 in FIG. 34 and Comparative Example 6 in FIG. 35, relation between transient response time period Tm [s] and nip pressurization duration Tnip [s] of intermediate transfer belt 21 satisfies $Tm \times 4 < Tnip$. In this case, a rate of relaxation of an internal stress of intermediate transfer belt 21 is dominant, and therefore an amount of displacement of intermediate transfer belt 21 attenuates during pressurization and an amount of transient displacement in the nip is not sufficiently obtained. Consequently, the adhesion force lowering effect was hardly expressed and good transferability in the recess in embossed paper was not obtained.

Intermediate transfer belt 21 of which overshoot ratio $E-(a-b)/b$ obtained in evaluation of intermediate transfer belt 21 with displacement amount measurement apparatus 100 under a condition satisfying $Tnip \approx Tm$ is around 1 is employed for belt type A to belt type E in Examples and Comparative Examples. In the present experiment, when overshoot ratio E [-] satisfies a condition of $0.2 \leq E \leq 3$ and Tnip [s] and transient response time period Tm [s] satisfy a condition of $Tnip \approx Tm$, sufficient transferability in the recess in embossed paper was obtained. A transferability improvement effect when intermediate transfer belt 21 satisfying $E < 0.2$ was employed was limited. When intermediate transfer belt 21 which satisfied $E > 3$ was employed, necessary durability was not obtained, although the transferability improvement effect was sufficient.

When a belt of which time constant $\tau$ satisfied a condition of $0.015 \leq \tau 0.1$ was employed, sufficient transferability in the recess in embossed paper was obtained. When a belt of which transient displacement time constant $\tau$ was smaller than 0.015 was employed, the transferability improvement effect was limited. When a belt of which transient displacement time constant $\tau$ was greater than 0.1 was employed, separability of paper from the belt was poor and quality was lowered although the transferability improvement effect was sufficient.

<Time Constant $\tau$ and Delay dt>

Figure 36:
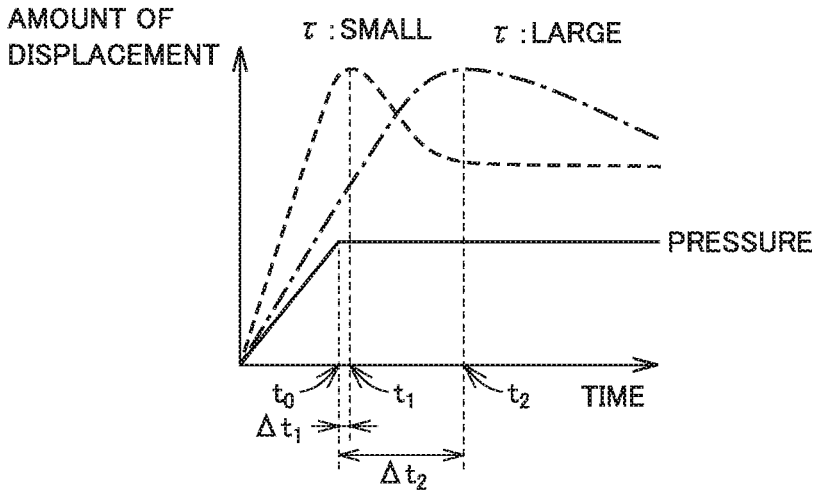
FIG. 36 is a diagram showing variation in amount of displacement of the intermediate transfer belt when the intermediate transfer belt according to Embodiment 1 is evaluated with the displacement amount measurement apparatus shown in FIG. 13A.

FIG. 36 is a diagram showing variation in amount of displacement of the intermediate transfer belt when the intermediate transfer belt according to Embodiment 1 is evaluated with the displacement amount measurement apparatus shown in FIG. 13A. As shown in FIG. 36, when a first time period (t0 [msec.]) from a time point of start of pressurization against a pressurized region until a time point when a pressure attains to a maximum value (200 [kPa]) is set and a second time period from the time point of start of pressurization against the pressurized region until an amount of displacement of a measurement region which is a portion in the first main surface of the intermediate transfer belt 21 corresponding to hole 113 attains to the maximum is denoted as tx [msec.], the second time period is longer than the first time period. In addition, as time constant $\tau$ is larger, $\Delta t$ [msec.] representing a difference between the second time period and the first time period increases.

Specifically, t2 is greater than t1 where t1 represents the second time period in an example where an intermediate transfer belt small in time constant was employed and t2 represents the second time period in an example in which an intermediate transfer belt great in time constant was employed. Both of t1 and t2 are greater than t0, and relation of $\Delta t2 > \Delta t1$ is satisfied where $\Delta t1$ represents $t1-t0$ and $\Delta t2$ represents $t2-t0$.

As At representing a difference between the second time period and the first time period is greater, deformation of intermediate transfer belt 21 in the nip portion is delayed relative to application of a pressure.

Figure 37:
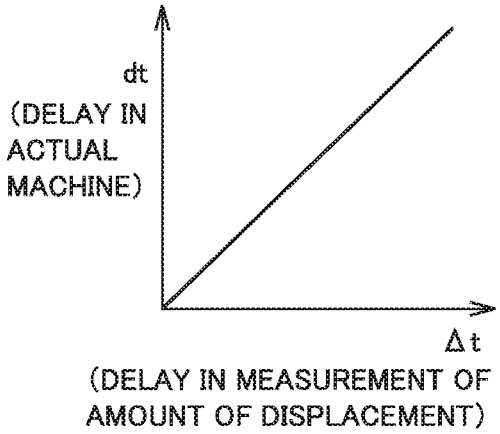
FIG. 37 is a diagram showing relation between delay in deformation of the transfer belt relative to application of a pressure and delay in deformation of the intermediate transfer belt obtained from a result from the displacement amount measurement apparatus in transfer in the secondary transfer portion according to Embodiment 1.

FIG. 37 is a diagram showing relation between delay in deformation of the transfer belt relative to application of a pressure in transfer in the secondary transfer portion according to Embodiment 1 and delay in deformation of the intermediate transfer belt obtained from a result from the displacement amount measurement apparatus. Relation between delay dt from a time when any one point on intermediate transfer belt 21 reaches the boundary between the increase region and the flat region in a pressure distribution until a time when an amount of displacement of intermediate transfer belt 21 attains to the peak and At described above is substantially linear as shown in FIG. 37 and can be expressed as in an expression (12) where k represents a coefficient.

$$dt = k \times \Delta t \qquad \text{Expression (12)}$$

As described above, in order to sufficiently exhibit inherent capability of intermediate transfer belt 21 to deform, duration pt of stay described above should only be equal to or longer than delay dt, and relation in an expression (13) below should only hold with reference to the expression (12).

$$pt \geq k \times \Delta t \qquad \text{Expression (13)}$$

As will be described later, coefficient k is preferably set to 0.55 and an expression (14) below is preferably satisfied in image formation apparatus 1 where pt [msec.] represents a duration in which any one point stays in the flat region and $\Delta t$ [msec.] represents $tx-t0$ which is a difference between second time period tx and first time period t0.

$$pt \geq 0.55 \times \Delta t \qquad \text{Expression (14)}$$

With the expression (14), duration pt of stay can readily be set based on $\Delta t$.

Embodiment 2

Figure 38:
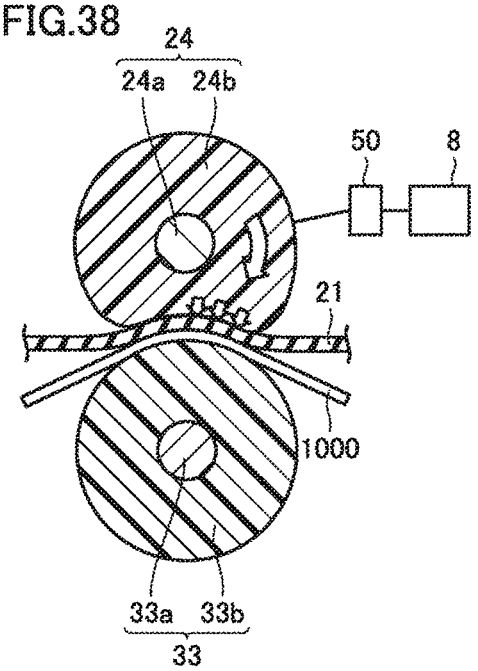
FIG. 38 is a schematic diagram of the secondary transfer portion according to Embodiment 2.

FIG. 38 is a schematic diagram of the secondary transfer portion according to Embodiment 2. The secondary transfer portion according to Embodiment 2 will be described with reference to FIG. 38.

As shown in FIG. 38, the secondary transfer portion according to Embodiment 2 is different from the secondary transfer portion according to Embodiment 1 in that secondary transfer roller 33 includes core 33*a* composed of a conductive material and conductive elastic portion 33*b* covering a circumferential surface of core 33*a*.

In this case, secondary transfer roller 33 is substantially similar in construction to opposed roller 24, however, elastic portion 33*b* of secondary transfer roller 33 is higher in hardness than elastic portion 24*b* of opposed roller 24.

Therefore, while secondary transfer roller 33 and opposed roller 24 are in pressure contact with each other, secondary transfer roller 33 digs in opposed roller 24.

In this case as well, rotational drive portion 50 applies rotary torque to opposed roller 24 such that a direction of rotation in the nip portion is the same as a direction of rotation of intermediate transfer belt 21 in the nip portion. A distribution of a pressure applied to intermediate transfer belt 21 thus has the increase region, the flat region, and the decrease region as in Embodiment 1.

The image formation apparatus according to Embodiment 2 also obtains an effect substantially the same as that of the image formation apparatus according to Embodiment 1 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Embodiment 3

Figure 39:
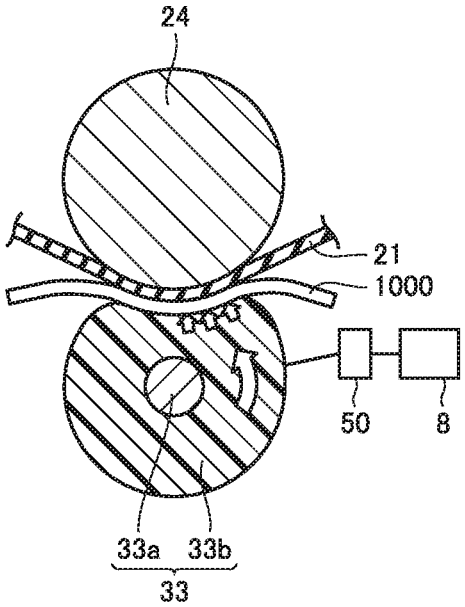
FIG. 39 is a schematic diagram of the secondary transfer portion according to Embodiment 3.

FIG. 39 is a schematic diagram of the secondary transfer portion according to Embodiment 3. The secondary transfer portion according to Embodiment 3 will be described with reference to FIG. 39.

As shown in FIG. 39, the secondary transfer portion according to Embodiment 3 is different from the secondary transfer portion according to Embodiment 1 in that opposed roller 24 is composed of a conductive material and transfer roller 33 includes core 33*a* composed of a conductive material and conductive elastic portion 33*b* covering the circumferential surface of core 33*a*.

Opposed roller 24 digs in secondary transfer roller 33 while secondary transfer roller 33 and opposed roller 24 are in pressure contact with each other.

In this case, rotational drive portion 50 applies rotary torque to secondary transfer roller 33 such that the direction of rotation in the nip portion is the same as the direction of rotation of intermediate transfer belt 21 in the nip portion. Thus, the distribution of the pressure applied to intermediate transfer belt 21 has the increase region, the flat region, and the decrease region as in Embodiment 1.

The image formation apparatus according to Embodiment 3 also obtains an effect substantially the same as that of the image formation apparatus according to Embodiment 1 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Since a pressure is applied to intermediate transfer belt 21 with a recording medium being interposed in Embodiment 3, the pressure applied to intermediate transfer belt 21 is slightly distributed by the recording medium. Since elastic portion 33*b* of secondary transfer roller 33 deforms to bury the recess in the recording medium, some of the pressure applied to intermediate transfer belt 21 from secondary transfer roller 33 is absorbed by the irregular shape of the recording medium.

Therefore, in Embodiment 3, in consideration of distribution and absorption of the pressure, rotary torque greater than in Embodiment 1 is preferably applied to the secondary transfer roller.

When secondary transfer roller 33 digs in opposed roller 24 as in Embodiment 1, a function and effect of the present invention to improve transferability to paper with irregularities tends to be exhibited as described below.

Since opposed roller 24 directly applies pressure to the rear surface of intermediate transfer belt 21 in Embodiment 1, a pressure can sufficiently be transmitted to the intermediate transfer belt. Since the rear surface of the intermediate transfer belt is coated with a resin layer composed of polyimide (PI) or the like, it is smooth. Therefore, deformation of elastic portion 24*b* of opposed roller 24 is not absorbed by irregularities in the recording medium.

For the reason as above, Embodiment 1 can more effectively improve transferability to paper with irregularities than Embodiment 3.

Embodiment 4

Figure 40:
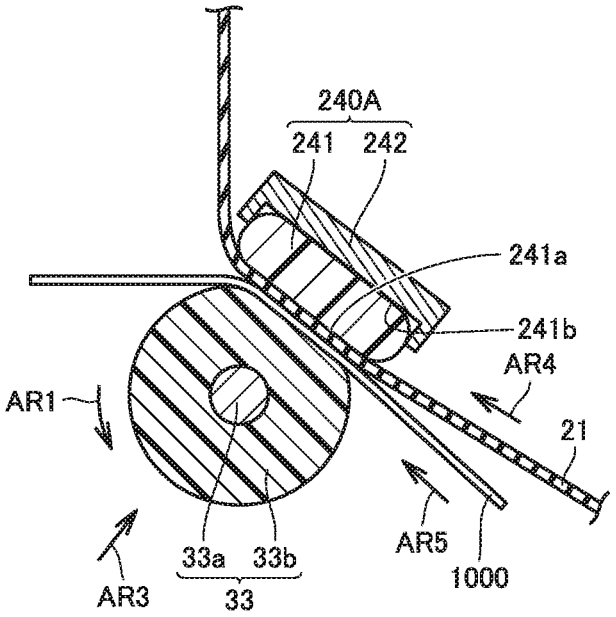
FIG. 40 is a schematic diagram of the secondary transfer portion according to Embodiment 4.

FIG. 40 is a schematic diagram of the secondary transfer portion according to Embodiment 4. The secondary transfer portion according to Embodiment 4 will be described with reference to FIG. 40.

As shown in FIG. 40, the secondary transfer portion according to Embodiment 4 is different from the secondary transfer portion according to Embodiment 1 in construction of secondary transfer roller 33 and an opposed member 240A. The construction is otherwise substantially the same.

Secondary transfer roller 33 includes core 33*a* composed of a conductive material and conductive elastic portion 33*b* covering the circumferential surface of core 33*a*. Secondary transfer roller 33 is constructed to be rotatable in the direction shown with AR1. Secondary transfer roller 33 is pressed in the direction shown with AR3. Secondary transfer roller 33 is pressed against opposed member 240A.

Opposed member 240A is arranged as being opposed to secondary transfer roller 33. Opposed member 240A includes a pad member 241 and a holding member 242. Holding member 242 holds pad member 241.

Pad member 241 is constructed not to be rotatable. Pad member 241 is in a shape of a block. Pad member 241 has a first surface 241*a* and a second surface 241*b* opposed to each other. First surface 241*a* and second surface 241*b* are planar. First surface 241*a* is in contact with the intermediate transfer belt.

Pad member 241 is preferably low in friction coefficient in order to suppress force of friction against the rear surface of intermediate transfer belt 21. Pad member 241 preferably has a moderate electrical resistance as an opposing electrode for generating prescribed electric field between the pad member and secondary transfer roller 33.

A metal, a resin, rubber, and a foamed sponge can be adopted for pad member 241.

SUS and an aluminum alloy can be employed as a metal. Polyethylene (PE), polyethylene terephthalate (PET), polyimide (PI), polycarbonate (PC), and an acrylonitrile butadiene styrene (ABS) resin can be employed as a resin. Polyurethane rubber, nitrile butadiene rubber (NBR), chloroprene rubber, and silicone rubber can be employed as rubber.

Holding member 242 holds pad member 241 from a side of second surface 241*b* of pad member 241. An abutment surface of holding member 242 in contact with second surface 241*b* is planar. Holding member 242 is fixed in a housing of image formation apparatus 1 so as to be immovable even in a state of pressure contact between secondary transfer roller 33 and opposed member 240A. Holding member 242 is preferably constructed not to deform in the state of pressure contact.

In the state of pressure contact between secondary transfer roller 33 and pad member 241, first surface 241*a* of pad member 241 is flat and elastic portion 33*b* of secondary transfer roller 33 in a portion pressed against first surface 241*a* is preferably also flat.

By increasing a thickness of elastic portion 33*b* of secondary transfer roller 33, a distribution of a pressure applied to intermediate transfer belt 21 is closer to a flat state.

Even when opposed member 240A is constructed as above, by appropriately selecting a hardness (elasticity) of elastic portion 33*b* of secondary transfer roller 33, an outer diameter, a diameter of the core and a thickness of elastic portion 33*b* of secondary transfer roller 33, and a shape of pad member 241, a distribution of a pressure applied to intermediate transfer belt 21 is substantially flat around a peak pressure as in Embodiment 1.

Therefore, the image formation apparatus according to Embodiment 4 also obtains an effect substantially the same as that of the image formation apparatus according to Embodiment 1 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Since first surface 241*a* of pad member 241 is flat as a whole in Embodiment 4, a width of pressure contact between pad member 241 and the secondary transfer roller is greater than in an example where opposed roller 24 is employed. Therefore, a peak pressure tends to be low in a distribution of a pressure applied to the intermediate transfer belt.

When the peak pressure is insufficient, deformation of the intermediate transfer belt is not sufficiently caused and deterioration in transferability is concerned.

Therefore, in Embodiment 4, in order to achieve a high peak pressure, pressing force for pressing secondary transfer roller 33 against pad member 241 is preferably greater.

Embodiment 5

Figure 41:
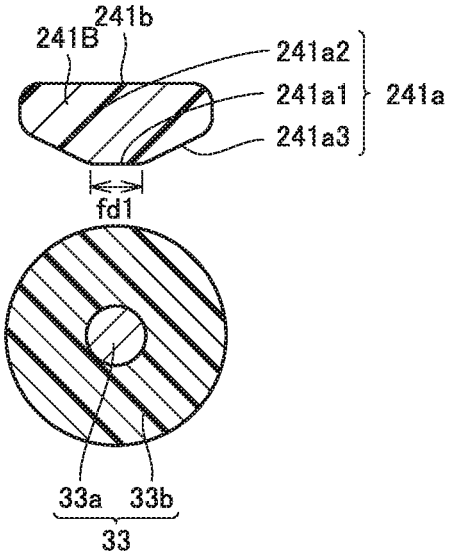
FIG. 41 is a diagram showing an opposed member and a secondary transfer roller of the secondary transfer portion according to Embodiment 5 as being separate from each other.
Figure 42:
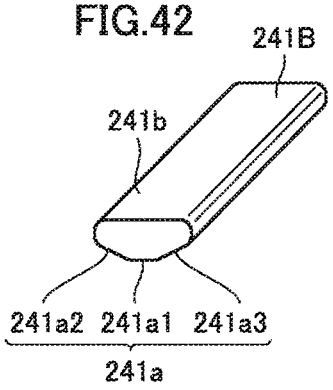
FIG. 42 is a diagram showing the opposed member of the secondary transfer portion according to Embodiment 5.

FIG. 41 is a diagram showing an opposed member and the secondary transfer roller of the secondary transfer portion according to Embodiment 5 as being separate from each other. FIG. 42 is a diagram showing the opposed member of the secondary transfer portion according to Embodiment 5. FIGS. 41 and 42 do not show a holding member included in the opposed member for the sake of convenience. The secondary transfer portion according to Embodiment 5 will be described with reference to FIGS. 41 and 42.

As shown in FIGS. 41 and 42, the secondary transfer portion according to Embodiment 5 is different from Embodiment 4 in shape of a pad member 241B. The construction is otherwise substantially the same.

Pad member 241B is formed from an elastic member such as rubber and a sponge. Pad member 241B is constructed such that a cross-sectional shape orthogonal to the axial direction of secondary transfer roller 33 is substantially trapezoidal. Pad member 241B has first surface 241*a* and second surface 241*b* opposed to each other.

First surface 241*a* has a flat surface 241*a*1 in the central portion and inclined surfaces 241*a*2 and 241*a*3 at opposing ends of the central portion. Flat surface 241*a*1 is substantially in parallel to the direction of transportation of a recording medium in the nip portion. Flat surface 241*a*1 has a width fd1 along the direction of transportation. Inclined surfaces 241*a*2 and 241*a*3 are inclined as being away from secondary transfer roller 33 as a distance from flat surface 241*a*1 is longer.

Figure 43:
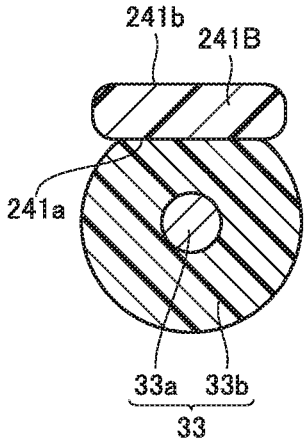
FIG. 43 is a diagram showing a state of pressure contact between the opposed member and the secondary transfer roller of the secondary transfer portion according to Embodiment 5.

FIG. 43 is a diagram showing a state of pressure contact between the opposed member and a transfer member of the secondary transfer portion according to Embodiment 5. A state of pressure contact between the opposed member and secondary transfer roller 33 will be described with reference to FIG. 43.

As shown in FIG. 43, in the state of pressure contact, pad member 241B deforms such that first surface 241*a* is flat as a whole. Elastic portion 33*b* of secondary transfer roller 33 in a portion pressed against first surface 241*a* is also flat.

A pressure applied to intermediate transfer belt 21 in the state of pressure contact is determined by an amount of compressive deformation of pad member 241B. A pressure applied to the intermediate transfer belt is higher in flat surface 241*a*1 where an amount of compressive deformation is great, whereas a pressure is lower as a distance from flat surface 241*a*1 is longer. Since an amount of deformation in flat surface 241*a*1 is substantially constant, a pressure applied to a portion corresponding to flat surface 241*a*1 in intermediate transfer belt 21 is substantially uniform.

Figure 44:
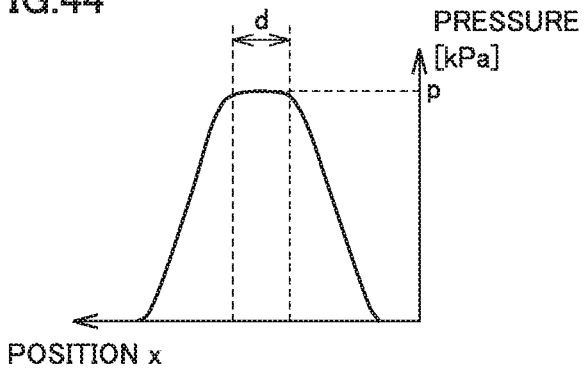
FIG. 44 is a diagram showing a distribution of a pressure applied to the intermediate transfer belt in transfer in the secondary transfer portion according to Embodiment 5.

FIG. 44 is a diagram showing a distribution of a pressure applied to the intermediate transfer belt in transfer in the secondary transfer portion according to Embodiment 5. As shown in FIG. 44, as pad member 241B deforms as above, a distribution of a pressure applied to intermediate transfer belt 21 in the state of pressure contact has the increase region, the flat region, and the decrease region as in Embodiment 1.

Width d of the flat region is determined by width fd1 of flat surface 241*a*1. Width d of the flat region is greater as width fd1 is greater.

The image formation apparatus according to Embodiment 5 also obtains an effect substantially the same as that of the image formation apparatus according to Embodiment 4 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

In addition, by shaping first surface 241*a* of pad member 241B as above, a pressure applied to intermediate transfer belt 21 is determined in accordance with an amount of compressive deformation of pad member 241B. Therefore, as compared with a construction in which first surface 241*a* is flat as a whole and a distribution of a pressure applied to the intermediate transfer belt is flat as a whole as in Embodiment 4, a pressure is low in a region other than a region having width d where a pressure attains to the peak in the pressure distribution in Embodiment 5. Consequently, pressing force applied to intermediate transfer belt 21 can be suppressed as a whole while a necessary peak pressure and the flat region are ensured.

Force of friction between pad member 241B and intermediate transfer belt 21 can thus be reduced. Consequently, intermediate transfer belt 21 can smoothly be transported and disturbance of an image can be suppressed. Since wear of pad member 241B can be suppressed, generation of image noise due to powders resulting from wear can also be suppressed.

Embodiment 6

Figure 45:
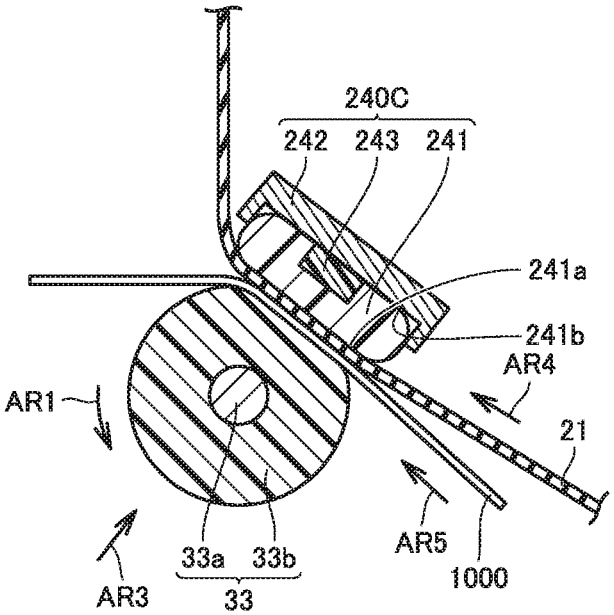
FIG. 45 is a schematic diagram of the secondary transfer portion according to Embodiment 6.
Figure 46:
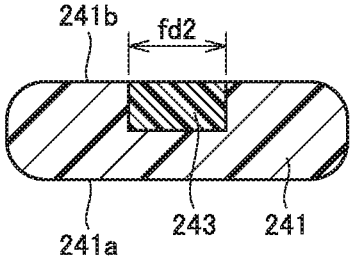
FIG. 46 is a diagram showing an opposed member of the secondary transfer portion according to Embodiment 6.

FIG. 45 is a schematic diagram of the secondary transfer portion according to Embodiment 6. FIG. 46 is a diagram showing an opposed member of the secondary transfer portion according to Embodiment 6. The secondary transfer portion according to Embodiment 6will be described with reference to FIGS. 45 and 46.

As shown in FIGS. 45 and 46, the secondary transfer portion according to Embodiment 6 is different from the secondary transfer portion according to Embodiment 4 in construction of an opposed member 240C. The construction is otherwise substantially the same.

Opposed member 240C includes pad member 241, holding member 242, and a reinforcement member 243.

Pad member 241 is in a shape of a block. Pad member 241 is formed from an elastic member such as rubber and a sponge. Pad member 241 is lower in hardness than reinforcement member 243.

Holding member 242 is the same in construction as that in Embodiment 4. Reinforcement member 243 is embedded in pad member 241. Reinforcement member 243 is located on a side of second surface 241*b* of pad member 241. Reinforcement member 243 extends along a direction in parallel to the axial direction of secondary transfer roller 33. Reinforcement member 243 has a width fd2. Reinforcement member 243 is composed of a metal, a resin, and rubber higher in hardness than pad member 241.

While secondary transfer roller 33 and pad member 241 are in pressure contact with each other, first surface 241*a* of pad member 241 is flat and elastic portion 33*b* of secondary transfer roller 33 in a portion pressed against first surface 241*a* is also flat.

Reinforcement member 243 is higher in hardness than pad member 241 as above. Therefore, in the state of pressure contact, a pressure applied to intermediate transfer belt 21 is high at a position corresponding to reinforcement member 243 and the pressure is low in other portions. Therefore, a distribution of a pressure applied to intermediate transfer belt 21 in the state of pressure contact has the increase region, the flat region, and the decrease region as in Embodiment 1.

A width of the flat region is determined by width fd2 of reinforcement member 243. A width of the flat region is greater as width fd2 is greater.

The image formation apparatus according to Embodiment 6 also obtains an effect substantially the same as that of the image formation apparatus according to Embodiment 4 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

In addition, with reinforcement member 243, Embodiment 6 is lower in pressure in a portion other than the region having width d where the pressure attains to the peak in the pressure distribution than such a construction that first surface 241*a* is flat as a whole and a distribution of a pressure applied to the intermediate transfer belt is flat as a whole as in Embodiment 4. Consequently, pressing force applied to intermediate transfer belt 21 can be suppressed as a whole while a necessary peak pressure and the flat region are ensured.

Force of friction between pad member 241 and intermediate transfer belt 21 can thus be reduced. Consequently, intermediate transfer belt 21 can smoothly be transported and disturbance of an image can be suppressed. Since wear of pad member 241 can be suppressed, generation of image noise due to powders resulting from wear can also be suppressed.

Embodiment 7

Figure 47:
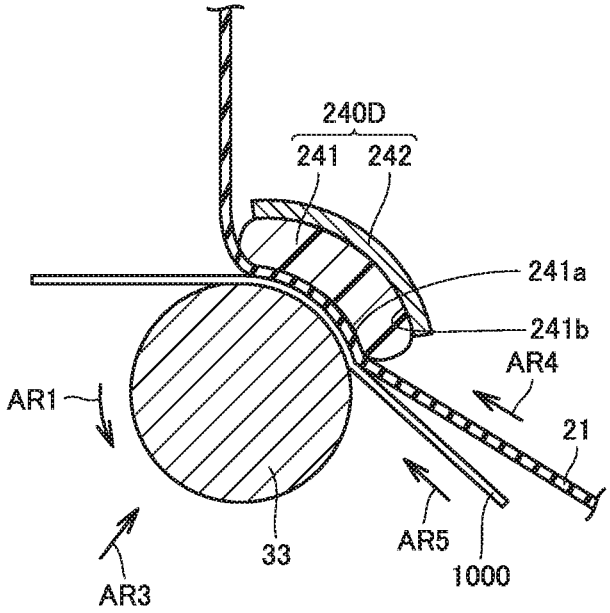
FIG. 47 is a schematic diagram of the secondary transfer portion according to Embodiment 7.
Figure 48:
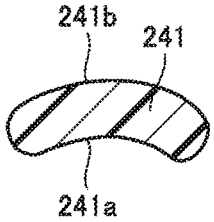
FIG. 48 is a diagram showing an opposed member in a state of non-pressure contact in the secondary transfer portion according to Embodiment 7.

FIG. 47 is a schematic diagram of the secondary transfer portion according to Embodiment 7. FIG. 48 is a diagram showing an opposed member in a state of non-pressure-contact of the secondary transfer portion according to Embodiment 7. The secondary transfer portion according to Embodiment 7 will be described with reference to FIGS. 47 and 48.

As shown in FIG. 47, the secondary transfer portion according to Embodiment 7 is different from the secondary transfer portion according to Embodiment 4 in construction of secondary transfer roller 33 and an opposed member 240D. The construction is otherwise substantially the same.

Secondary transfer roller 33 is composed of a conductive material. Secondary transfer roller 33 is a rigid roller composed of a metal such as SUS.

Opposed member 240D includes pad member 241 and holding member 242. Pad member 241 is in a curved shape which can accept a circumferential surface of secondary transfer roller 33 in a non-pressure-contact state in which secondary transfer roller 33 and pad member 241 are not in pressure contact with each other.

Pad member 241 is formed from an elastic member such as a resin and rubber. Pad member 241 is preferably composed of a material low in friction coefficient in order to suppress force of friction against intermediate transfer belt 21. Holding member 242 is in a curved shape in conformity with the circumferential surface of secondary transfer roller 33.

In a state of pressure contact in which secondary transfer roller 33 and pad member 241 are in pressure contact with each other, first surface 241*a* of pad member 241 is in the curved shape in conformity with the circumferential surface of secondary transfer roller 33. Intermediate transfer belt 21 is thus curved such that the surface on the side of secondary transfer roller 33 is recessed. A toner carrying surface of intermediate transfer belt 21 is compressed in an in-plane direction. In this case as well, a distribution of a pressure applied to intermediate transfer belt 21 has the increase region, the flat region, and the decrease region as in Embodiment 1.

The image formation apparatus according to Embodiment 7 also obtains an effect substantially the same as that of the image formation apparatus according to Embodiment 4 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

The toner carrying surface of intermediate transfer belt 21 is compressed in the in-plane direction as described above so that the compressed elastic layer is likely to deform toward a recess in a recording medium.

Transferability to the recess in the recording medium is thus further improved.

(Modification)

Figure 49:
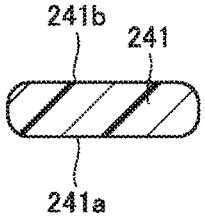
FIG. 49 is a diagram showing the opposed member in a non-pressure-contact state of the secondary transfer portion according to a modification.

FIG. 49 is a diagram showing the opposed member in a non-pressure-contact state of the secondary transfer portion according to a modification. The opposed member according to the modification will be described with reference to FIG. 49.

As shown in FIG. 49, pad member 241 of the opposed member according to the modification is in a shape of a flat plate in a non-pressure-contact state. Deformation of pad member 241 is guided by holding member 242 in a curved shape in conformity with the circumferential surface of secondary transfer roller 33. In the state of pressure contact, first surface 241*a* of pad member 241 is thus curved in conformity with the circumferential surface of secondary transfer roller 33 as in Embodiment 7. Pad member 241 may thus be constructed.

Embodiment 8

Figure 50:
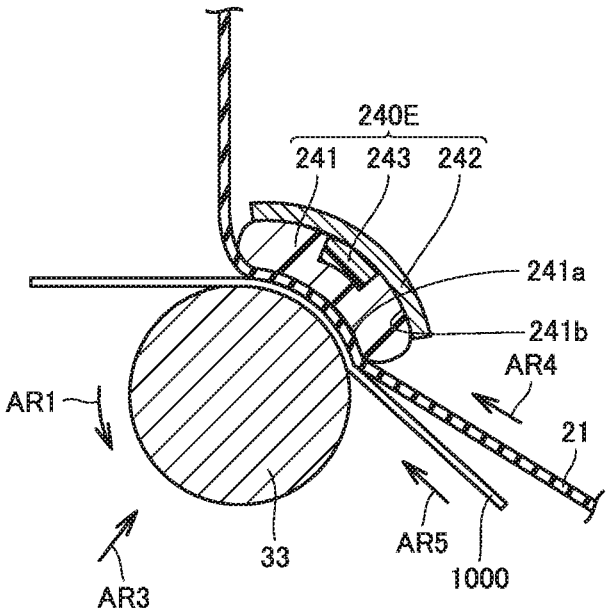
FIG. 50 is a schematic diagram of the secondary transfer portion according to Embodiment 8.

FIG. 50 is a schematic diagram of the secondary transfer portion according to Embodiment 8. The secondary transfer portion according to Embodiment 8 will be described with reference to FIG. 50.

As shown in FIG. 50, the secondary transfer portion according to Embodiment 8 is different from the secondary transfer portion according to Embodiment 7 in construction of an opposed member 240E. The construction is otherwise substantially the same.

Opposed member 240E includes pad member 241, holding member 242, and reinforcement member 243. Pad member 241 and holding member 242 are substantially the same in construction as in Embodiment 7.

Reinforcement member 243 is embedded in pad member 241. Reinforcement member 243 is located on the side of second surface 241*b* of pad member 241. Reinforcement member 243 is curved in conformity with the circumferential surface of secondary transfer roller 33. Reinforcement member 243 extends in a direction in parallel to the axial direction of secondary transfer roller 33. Reinforcement member 243 is composed of a metal, a resin, and rubber higher in hardness than pad member 241.

Reinforcement member 243 is higher in hardness than pad member 241 as above. Therefore, in a state of pressure contact, a pressure applied to intermediate transfer belt 21 is higher at a position corresponding to reinforcement member 243 and the pressure is low in other portions. Therefore, a distribution of a pressure applied to intermediate transfer belt 21 in the state of pressure contact has the increase region, the flat region, and the decrease region as in Embodiment 1.

The image formation apparatus according to Embodiment 8 also obtains an effect substantially the same as that of the image formation apparatus according to Embodiment 7 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Embodiment 9

Figure 51:
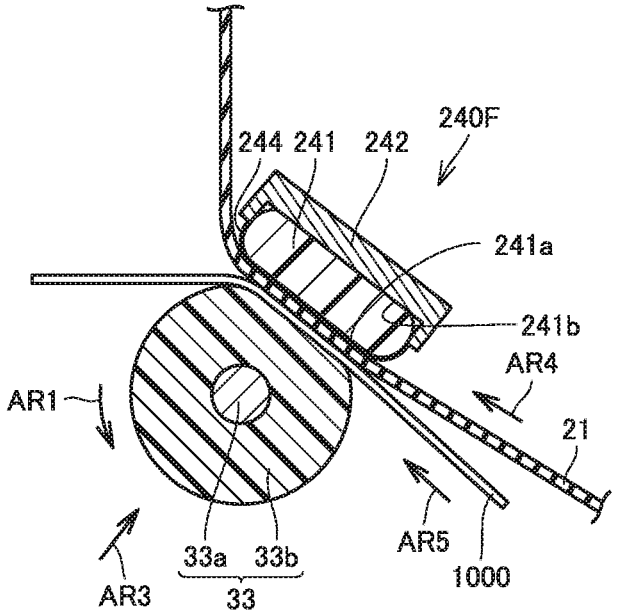
FIG. 51 is a schematic diagram of the secondary transfer portion according to Embodiment 9.

FIG. 51 is a schematic diagram of the secondary transfer portion according to Embodiment 9. The secondary transfer portion according to Embodiment 9 will be described with reference to FIG. 51.

As shown in FIG. 51, the secondary transfer portion according to Embodiment 9 is different from the secondary transfer portion according to Embodiment 4 in construction of an opposed member 240F. The construction is otherwise substantially the same.

Opposed member 240F is provided with a low-friction sheet 244 between first surface 241*a* of pad member 241 and intermediate transfer belt 21.

A sheet member composed of a resin such as polyethylene terephthalate (PET), polyimide (PI), and polycarbonate (PC) and a sheet member composed of a metal such as SUS can be employed for low-friction sheet 244. The sheet member has a thickness preferably not smaller than 10 μm and not greater than 100 μm. Low-friction sheet 244 is preferably low in friction coefficient and high in flexibility and wear resistance.

Instead of the low-friction sheet, first surface 241*a* of pad member 241 may be coated with a fluorine-based resin such as polytetrafluoroethylene (PTFE).

According to the construction as above, the image formation apparatus according to Embodiment 9 obtains an effect substantially the same as that of the image formation apparatus according to Embodiment 4.

Embodiment 10

Figure 52:
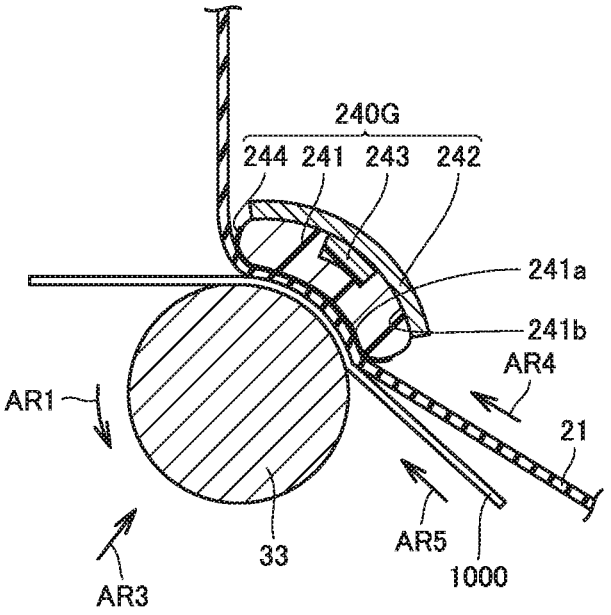
FIG. 52 is a schematic diagram of the secondary transfer portion according to Embodiment 10.

FIG. 52 is a schematic diagram of the secondary transfer portion according to Embodiment 10. The secondary transfer portion according to Embodiment 10 will be described with reference to FIG. 52.

As shown in FIG. 52, the secondary transfer portion according to Embodiment 10 is different from the secondary transfer portion according to Embodiment 8 in construction of an opposed member 240G. The construction is otherwise substantially the same.

Opposed member 240G is provided with low-friction sheet 244 between first surface 241*a* of pad member 241 and intermediate transfer belt 21. A sheet similar to low-friction sheet 244 according to Embodiment 9 can be employed as low-friction sheet 244.

Instead of low-friction sheet 244, first surface 241*a* of pad member 241 may be coated with a fluorine-based resin such as polytetrafluoroethylene (PTFE).

According to the construction as above, the image formation apparatus according to Embodiment 10 obtains an effect substantially the same as that of the image formation apparatus according to Embodiment 8.

Embodiment 11

Figure 53:
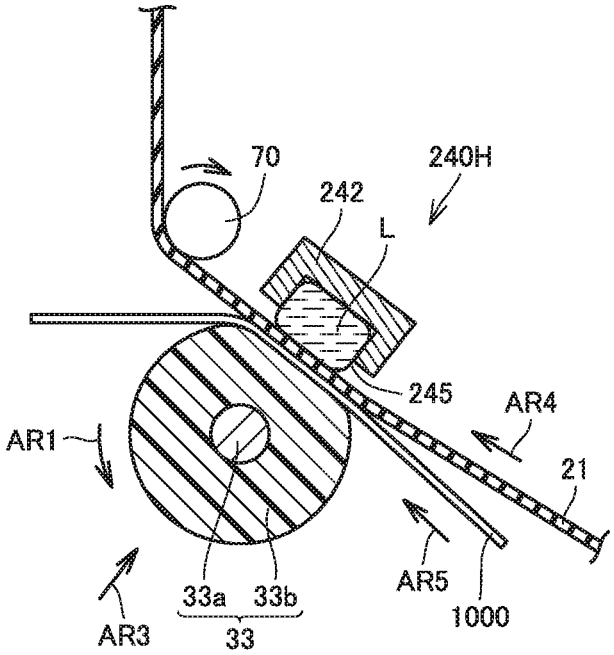
FIG. 53 is a schematic diagram of the secondary transfer portion according to Embodiment 11.

FIG. 53 is a schematic diagram of the secondary transfer portion according to Embodiment 11. The secondary transfer portion according to Embodiment 11 will be described with reference to FIG. 53.

As shown in FIG. 53, the secondary transfer portion according to Embodiment 11 is different from the secondary transfer portion according to Embodiment 4 in construction of an opposed member 240H. The construction is otherwise substantially the same.

In Embodiment 11, the image formation apparatus includes a support roller 70 around which intermediate transfer belt 21 is wound, and intermediate transfer belt 21 rotates as support roller 70 is rotationally driven.

Secondary transfer roller 33 includes core 33*a* composed of a conductive material and conductive elastic portion 33*b* covering the circumferential surface of core 33*a*. Secondary transfer roller 33 is constructed to be rotatable in the direction shown with AR1. Secondary transfer roller 33 is pressed in the direction shown with AR3. Secondary transfer roller 33 is pressed against opposed member 240H.

Opposed member 240H is arranged as being opposed to secondary transfer roller 33. Opposed member 240H includes a fluid bag 245 in which a fluid L is sealed and holding member 242 which holds fluid bag 245.

Examples of a material for a bag-like member as fluid bag 245 can include a resin member such as nylon, polyethylene, polypropylene, and polyimide and a rubber material such as silicone rubber, polyurethane rubber, and chloroprene rubber.

Fluid bag 245 preferably has flexibility and wear resistance. Fluid bag 245 preferably has resistance to a material sealed therein. Fluid bag 245 preferably has a moderate electrical resistance as an opposing electrode for generating prescribed electric field between the fluid bag and secondary transfer roller 33. In a hermetically sealed state that fluid L has hermetically been sealed, fluid bag 245 is substantially in a shape of a parallelepiped.

A gas and a liquid can be employed as fluid L to be sealed in fluid bag 245. Examples of a gas can include common air, a nitrogen gas, and a carbon dioxide gas. Examples of a liquid can include water and various industrial oils such as silicone oil.

An internal pressure in fluid bag 245 is considerably high, and in the state of pressure contact in which secondary transfer roller 33 and opposed member 240H are in pressure contact with each other, fluid bag 245 digs in secondary transfer roller 33. Elastic portion 33*b* of secondary transfer roller 33 in a portion pressed against fluid bag 245 thus becomes substantially flat.

In the state of pressure contact, a pressure in fluid bag 245 becomes uniform. Therefore, a distribution of a pressure applied to intermediate transfer belt 21 tends to ensure the flat region where a pressure is substantially constant around the peak of the pressure. The pressure distribution has the increase region, the flat region, and the decrease region as in Embodiment 4.

The image formation apparatus according to Embodiment 11 also obtains an effect substantially the same as that of the image formation apparatus according to Embodiment 4 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Embodiment 12

Figure 54:
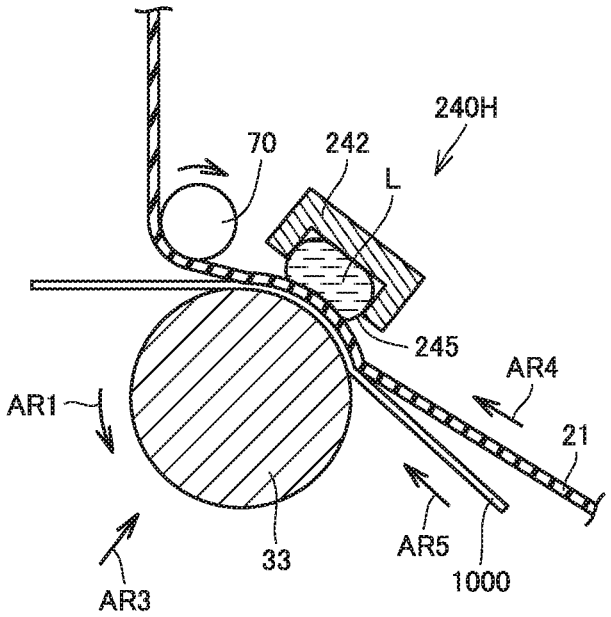
FIG. 54 is a schematic diagram of the secondary transfer portion according to Embodiment 12.

FIG. 54 is a schematic diagram of the secondary transfer portion according to Embodiment 12. The secondary transfer portion according to Embodiment 12 will be described with reference to FIG. 54.

As shown in FIG. 54, the secondary transfer portion according to Embodiment 12 is different from the secondary transfer portion according to Embodiment 11 in construction of secondary transfer roller 33. The construction is otherwise substantially the same.

Secondary transfer roller 33 is composed of a conductive material. Secondary transfer roller 33 is a rigid roller composed of a metal such as SUS.

In the state of pressure contact in which secondary transfer roller 33 and opposed member 240H are in pressure contact with each other, secondary transfer roller 33 digs in fluid bag 245. Fluid bag 245 is thus curved such that the surface on the side of the secondary transfer roller is recessed. The toner carrying surface of intermediate transfer belt 21 is compressed in the in-plane direction. In this case as well, a distribution of a pressure applied to intermediate transfer belt 21 has the increase region, the flat region, and the decrease region as in Embodiment 11.

The image formation apparatus according to Embodiment 12 also obtains an effect substantially the same as that of the image formation apparatus according to Embodiment 11 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Embodiment 13

Figure 55:
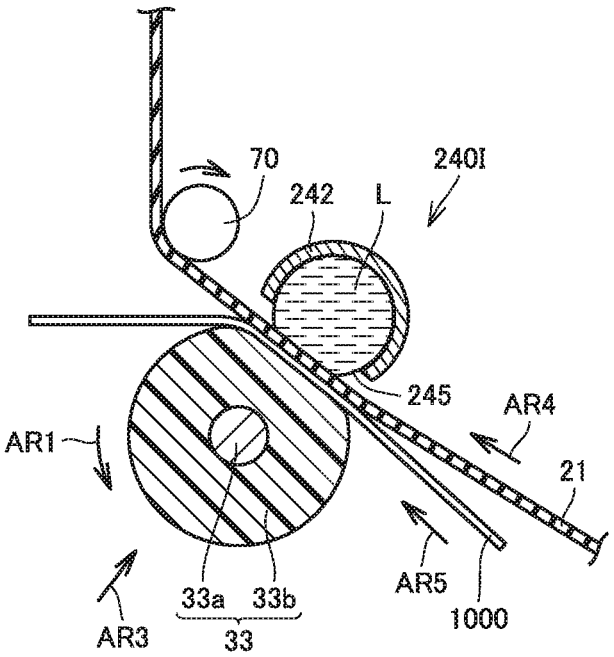
FIG. 55 is a schematic diagram of the secondary transfer portion according to Embodiment 13.

FIG. 55 is a schematic diagram of the secondary transfer portion according to Embodiment 13. The secondary transfer portion according to Embodiment 13 will be described with reference to FIG. 55.

As shown in FIG. 55, the secondary transfer portion according to Embodiment 13 is different from the secondary transfer portion according to Embodiment 11 in construction of an opposed member 2401. The construction is otherwise substantially the same.

In opposed member 2401, fluid bag 245 in which fluid L is hermitically sealed is substantially in a columnar shape and holding member 242 which holds fluid bag 245 is in a curved shape.

In the state of pressure contact in which secondary transfer roller 33 and opposed member 2401 are in pressure contact with each other, a portion of abutment between fluid bag 245 and elastic portion 33*b* of secondary transfer roller 33 is substantially flat.

In this case as well, a distribution of a pressure applied to intermediate transfer belt 21 tends to ensure the flat region where a pressure is substantially constant around the peak of the pressure. The pressure distribution has the increase region, the flat region, and the decrease region as in Embodiment 4.

The image formation apparatus according to Embodiment 13 also obtains an effect substantially the same as that of the image formation apparatus according to Embodiment 11 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

Though an example in which fluid bag 245 is in a substantially columnar shape is exemplified and described in Embodiment 13, limitation thereto is not intended. The fluid bag may be in a polygonal prismatic shape of which cross-section orthogonal to the axial direction of secondary transfer roller 33 is polygonal or a columnar shape of which cross-section is in a oval shape such as an elliptical shape and an egg shape.

Embodiment 14

Figure 56:
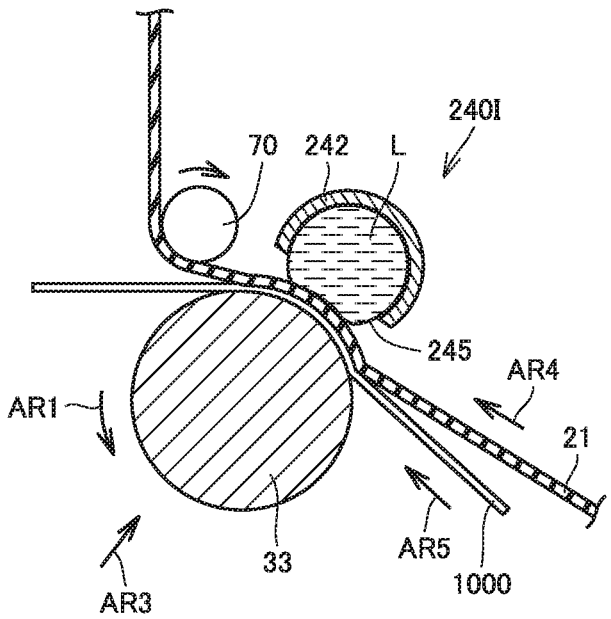
FIG. 56 is a schematic diagram of the secondary transfer portion according to Embodiment 14.

FIG. 56 is a schematic diagram of the secondary transfer portion according to Embodiment 14. The secondary transfer portion according to Embodiment 14 will be described with reference to FIG. 56.

As shown in FIG. 56, the secondary transfer portion according to Embodiment 14 is different from the secondary transfer portion according to Embodiment 13 in secondary transfer roller 33. The construction is otherwise substantially the same.

Secondary transfer roller 33 is composed of a conductive material. Secondary transfer roller 33 is a rigid roller composed of a metal such as SUS.

In the state of pressure contact in which secondary transfer roller 33 and opposed member 2401 are in pressure contact with each other, secondary transfer roller 33 digs in fluid bag 245. Fluid bag 245 is thus curved such that the surface on the side of the secondary transfer roller is recessed. The toner carrying surface of intermediate transfer belt 21 is compressed in the in-plane direction. In this case as well, a distribution of a pressure applied to intermediate transfer belt 21 has the increase region, the flat region, and the decrease region as in Embodiment 13.

The image formation apparatus according to Embodiment 14 also obtains an effect substantially the same as that of the image formation apparatus according to Embodiment 13 by setting duration pt in which any one point on intermediate transfer belt 21 stays in the flat region in the distribution of the pressure applied when that any one point passes through the nip portion to be longer than delay dt from the time when that any one point reaches the boundary between the increase region and the flat region in the pressure distribution until the time when an amount of deformation of intermediate transfer belt 21 attains to the peak.

First Verification Experiment

FIG. 57 is a diagram showing conditions and results in a first verification experiment. The first verification experiment will be described with reference to FIG. 57. In the first verification experiment, relation between duration pt [msec.] in which any one point on intermediate transfer belt 21 stayed in the flat region when that any one point passed through the nip portion and loss tangent tanδ at 25° C. of intermediate transfer belt 21 was investigated. Specifically, an image printed on paper with irregularities was evaluated under conditions shown in Examples 9 to 16 and Comparative Examples 8 to 13 in FIG. 57. In evaluation of the image in Examples 9 to 16 and Comparative Examples 8 to 13, an image formation apparatus constructed substantially similarly to the image formation apparatus according to Embodiment 1 was employed as the image formation apparatus.

Specifically, a belt of which base layer was composed of polyimide and elastic layer was composed of nitrile rubber was employed as intermediate transfer belt 21. The base layer had a thickness of 80 [μm] and the elastic layer had a thickness of 200 [μm]. A plurality of intermediate transfer belts different in composition of the elastic layer were prototyped by variously adjusting a type or an amount of a resin, an additive, and a cross-linking agent to be contained in the elastic layer.

The prototyped belts were subjected to measurement with a dynamic viscoelasticity measurement apparatus (EXSTAR DMS 7100 manufactured by SII NanoTechnology Inc.) to obtain tanδ at 25° C. Tanδ was measured under such conditions as a program temperature of 25° C., a sample dimension of a length of 20 mm and a width of 10 mm, tensile force of 10 gf (98 mN), and a measurement frequency from 0.01 to 100 Hz.

An image formation apparatus in which each belt was applied as the intermediate transfer belt was used for evaluation of printing on paper of an A4 size under such conditions as a temperature of 20° C., a humidity of 50%, and a linear velocity (system speed) of an outer circumferential surface of the secondary transfer roller and the opposed roller of 300 [mm/sec.].

A rigid roller made of a metal (a material being SUS) having a diameter of 40 mm was employed as the secondary transfer roller of the image formation apparatus. An elastic roller in which an elastic layer composed of a sponge and rubber had been provided around the core was employed as the opposed roller. A hardness of the elastic layer of the opposed roller measured with a micro durometer (MD-1 manufactured by Kobunshi Keiki Co., Ltd.) was 40 degrees. Since the rigid roller was employed as the secondary transfer roller and the elastic roller was employed as the opposed roller, the secondary transfer roller dug in the elastic roller. A peak pressure in the secondary transfer portion was 200 kPa. A length of the nip portion in parallel to the axial direction of the secondary transfer roller was 340 mm (0.34 m).

Embossed paper manufactured by Tokushu Tokai Paper Co., Ltd. having a trade name Leathac (registered trademark) 66 was used for checking transferability. A grammage of this embossed paper was 302 [g/m$^2$]. A formed image was a solid image. In determination, a micro densitometer was used to measure a reflection density of a sharp and deep recess and a reflection density of a projection and a difference in density therebetween was calculated. When a difference in density was less than 0.40, determination as "good" was made, and when a difference in density was equal to or more than 0.40, determination as "failure" was made.

In Examples 9 to 12 and Comparative Examples 8 to 10, a roller having a radius of 10 [mm] (0.01 m) was employed as opposed roller 24. Distance of travel w of any one point from an entry of the nip (a point of start of increase in pressure in the direction of transportation of the belt) to a position where the pressure attained to the maximum was 2.2 [mm]. Rotary torque applied to opposed roller 24 was, as shown in FIG. 57, varied from 0 [N.m] to 0.1 [N.m], where rotary torque in a state of following rotation of the intermediate transfer belt was set to 0 [N.m].

Duration pt [msec.] in which any one point stayed in the flat region in a distribution of a pressure applied to the intermediate transfer belt was as shown in FIG. 57.

Duration pt [msec.] in which any one point stayed in the flat region is, as described in aforementioned Embodiment 1, expressed in an expression (15) below, where Vsys [mm/sec.] represents a speed of transportation of a recording medium, w [mm] represents a distance of travel of any one point from the position where the pressure started to increase at the entry of the nip portion in first pressure distribution PD1 to the position where the pressure attained to the maximum, T [N.m] represents rotary torque applied to the opposed roller, r [m] represents a radius of the opposed roller, L [m] represents a length of the nip portion in the direction in parallel to the axial direction of the transfer roller, and p [kPa] represents a maximum value of the pressure in first pressure distribution PD1.

$$pt=(1/Vsys)\sqrt{2wt/rLp}\times10^3 \quad \text{Expression (15)}$$

When the image was evaluated while rotary torque applied to opposed roller 24 was gradually increased, a condition for change in transferability to paper with irregularities from poor to good was the condition shown in Example 11. Namely, under the condition in Example 11, duration pt of stay and delay dt were balanced. As described in connection with method 3 of calculating duration pt of stay in the flat region described above, delay dt and loss tangent tanδ satisfy relation of dt=a.tanδ.

Duration pt of stay was 1.20 [msec.] and loss tangent tanδ was 0.110 in Example 11. Therefore, it was found that coefficient a was appropriately set to 1.20/0.110=10.9.

In Examples 9 to 12, transferability to paper with irregularities was good and relation between duration pt of stay and loss tangent tanδ satisfied pt 10.9×tanδ.

In Comparative Examples 8 to 10, transferability to paper with irregularities was poor, and relation between duration pt of stay and loss tangent tanδ was pt<10.9×tanδ.

In Examples 13 to 16 and Comparative Examples 11 to 13, a roller having a radius of 14 [mm] (0.014 m) was employed as opposed roller 24. Distance of travel w of any one point from the entry of the nip (a point of start of increase in pressure in the direction of transportation of the belt) to a position where the pressure attained to the maximum was 2.4 [mm]. Rotary torque applied to opposed roller 24 was, as shown in FIG. 57, varied from 0 [N.m] to 0.12 [N.m], where rotary torque in a state of following rotation of the intermediate transfer belt was set to 0 [N.m].

In this case as well, in Examples 13 to 16, transferability to paper with irregularities was good and relation between duration pt of stay and loss tangent tanδ satisfied pt<10.9×tanδ.

In Comparative Examples 11 to 13, transferability to paper with irregularities was poor and relation between duration pt of stay and loss tangent tanδ was pt<10.9×tanδ.

It can be concluded from the results above that good transferability to paper with irregularities can be obtained also experimentally by satisfying relation of pt≥10.9×tanδ.

Second Verification Experiment

FIG. 58 is a diagram showing conditions and results in a second verification experiment. The second verification experiment will be described with reference to FIG. 58. In the second verification experiment, variation in amount of displacement of the intermediate transfer belt was measured with displacement amount measurement apparatus 100 described above. Relation between Δt [msec.] representing a difference between the second time period and the first time period and duration pt [msec.] in which any one point on intermediate transfer belt 21 stayed in the flat region when that any one point passed through the nip portion was investigated, where the first time period (t0 [msec.]) from a time point of start of pressurization against a pressurized region until a time point when a pressure attained to the maximum value (200 [kPa]) was set and the second time period from the time point of start of pressurization against the pressurized region until an amount of displacement of a measurement region which was a portion in the first main surface of intermediate transfer belt 21 corresponding to hole 113 attained to the maximum was denoted as tx [msec.]. Specifically, an image printed on paper with irregularities was evaluated under conditions shown in Examples 17 to 22 and Comparative Examples 14 to 19 in FIG. 58. In evaluation of the image in Examples 17 to 22 and Comparative Examples 14 to 19, an image formation apparatus substantially similar in construction to the image formation apparatus according to Embodiment 1 was employed as the image formation apparatus.

An intermediate transfer belt equivalent in construction to the intermediate transfer belt in the first verification experiment was prepared also in the second verification experiment. A number of intermediate transfer belts different in composition of the elastic layer were prototyped by variously adjusting a type or an amount of a resin, an additive, and a cross-linking agent to be contained in the elastic layer.

Each prototyped intermediate transfer belt was evaluated with the displacement amount measurement apparatus described above to obtain Δt.

An image formation apparatus in which each belt was applied as the intermediate transfer belt was used for evaluation of printing on paper of an A4 size under such conditions as a temperature of 20° C., a humidity of 50%, and a linear velocity (system speed) of an outer circumferential surface of the secondary transfer roller and the opposed roller of 300 [mm/sec.].

In the verification experiment 2 as well, a secondary transfer roller and an opposed roller equivalent to those in the first verification experiment were employed. Transferability was evaluated also as in the first verification experiment.

A roller having a radius of 10 [mm] (0.01 m) was employed as opposed roller 24 in Examples 17 to 19 and Comparative Examples 14 to 16. Distance of travel w of any one point from the entry of the nip (a point of start of increase in pressure in the direction of transportation of the belt) to a position where the pressure attained to the maximum was 2.2 [mm]. Rotary torque applied to opposed roller 24 was, as shown in FIG. 58, varied from 0 [N.m] to 0.2 [N.m], where rotary torque in a state of following rotation of the intermediate transfer belt was set to 0 [N.m].

Duration pt [msec.] in which any one point stayed in the flat region in a distribution of a pressure applied to the intermediate transfer belt was as shown in FIG. 58.

When an image was evaluated while rotary torque applied to opposed roller 24 was gradually increased, a condition for change in transferability to paper with irregularities from poor to good was found to be located between Comparative Example 14 and Example 18. In this case, when duration pt of stay was at least approximately 3.30 [msec.], it was in balance with delay dt. As described in connection with method 4 of calculating duration pt of stay in the flat region described above, delay dt and At satisfy relation of dt =

Since delay dt balanced with duration pt of stay of 3.30 [msec.] is 6.0 [msec.], it is concluded that coefficient k is appropriately set to 3.30/6.0=0.55.

In Examples 17 to 19, transferability to paper with irregularities was good and relation between duration pt of stay and Δt satisfied pt≥0.55×Δt.

In Comparative Examples 14 to 16, transferability to paper with irregularities was poor and relation between duration pt of stay and Δt was pt<0.55×Δt.

In Examples 20 to 22 and Comparative Examples 17 to 19, a roller having a radius of 14 [mm] (0.014 m) was employed as opposed roller 24. Distance of travel w of any one point from the entry of the nip (a point of start of increase in pressure in the direction of transportation of the belt) to a position where the pressure attained to the maximum was 2.4 [mm]. Rotary torque applied to opposed roller 24 was, as shown in FIG. 58, varied from 0 [N.m] to 0.24 [N.m], where rotary torque in a state of following rotation of the intermediate transfer belt was set to 0 [N.m].

In this case as well, in Examples 20 to 22, transferability to paper with irregularities was good and relation between duration pt of stay and At satisfied $pt \geq 0.55 \times \Delta t$.

In Comparative Examples 17 to 19, transferability to paper with irregularities was poor and relation between duration pt of stay and At was $pt < 0.55 \times \Delta t$.

It can be concluded from the results above that good transferability to paper with irregularities can be obtained also experimentally by satisfying relation of $pt \geq 0.55 \times \Delta t$.

Though an example in which at least one of a transfer member and an opposed member is in a shape of a roller and constructed to be rotatable is exemplified and described in Embodiments 1 to 14 described above, limitation thereto is not intended. So long as a distribution of a pressure applied to intermediate transfer belt 21 in the nip portion has the flat region at a peak position, both of the transfer member and the opposed member may be formed from a pad member which does not rotate.

Though an example in which the present invention is applied to an image formation apparatus provided with an intermediate transfer belt exhibiting a displacement pattern shown in FIG. 17 is particularly exemplified and described in the present embodiment described above, the scope of application of the present invention is not limited thereto and an intermediate transfer belt exhibiting other displacement patterns is also applicable.

Though an example in which the present invention is applied to what is called a digital multi-function peripheral or a digital printer and an intermediate transfer belt provided therein as an image formation apparatus and a transfer belt is exemplified and described in the present embodiment described above, the present invention can naturally be applied also to other image formation apparatuses and transfer belts provided therein.

Although embodiments of the present invention have been described and illustrated in detail, it is clearly understood that the same is by way of illustration and example only and not limitation, the scope of the present invention should be interpreted by terms of the appended claims.

What is claimed is:

1. A transfer belt comprising an elastic layer, the transfer belt serving to transfer a toner image carried on a first main surface which is one of a pair of exposed main surfaces including the first main surface and a second main surface located opposite to each other to a recording medium, when a pressurized region which is a part of the transfer belt is pressurized with pressurization force reaching 200 [kPa] at a predetermined rate of pressurization [kPa/ms] and thereafter being maintained constant at 200 [kPa] by using a lower block having a projecting curved surface having a width of 20 [mm] and a radius of curvature of 20 [mm] as an upper surface and provided with a hole having a diameter of 1.25 [mm] in a top portion of the projecting curved surface and an upper block having a recessed curved surface having a width of 20 [mm] and a radius of curvature of 20.3 [mm] as a lower surface, placing the transfer belt on the upper surface of the lower block such that the first main surface faces the upper surface of the lower block, and sandwiching the part of the transfer belt between the projecting curved surface and the recessed curved surface by lowering the upper block toward the lower block, the transfer belt satisfying such a condition that E [-] calculated as (a−b)/b and t0 are curve-fitted to an exponential function expressed as $E=\alpha \times \exp(-t0/\tau)$ defined by a time constant $\tau$ [s] with respect to an amount of displacement of the transfer belt and a constant a [-], where $\alpha$ [μm] represents a maximum value of an amount of displacement of a measurement region which is a portion in the first main surface corresponding to the hole, b [μm] represents an amount of displacement of the measurement region after convergence of displacement of the measurement region, and t0 [s] represents a time period from a time point of start of pressurization against the pressurized region until a time point when the pressurization force attains to 200 [kPa], and the time constant $\tau$ satisfies a condition of $0.015 \leq \tau 0.1$.

2. The transfer belt according to claim 1, the transfer belt further comprising a base layer and a surface layer in addition to the elastic layer, wherein the elastic layer is provided to cover the base layer and the surface layer is further provided to cover the elastic layer.

3. The transfer belt according to claim 2, wherein the base layer is higher in hardness than the elastic layer.

4. An image formation apparatus comprising:

an image carrying portion which carries a toner layer and an intermediate transfer belt;

a primary transfer portion which transfers a toner image carried on the image carrying portion to the intermediate transfer belt; and a secondary transfer portion which transfers the toner image carried on the intermediate transfer belt to a recording medium, the secondary transfer portion including a secondary transfer roller, an opposed roller opposed to the secondary transfer roller, and a nip portion formed by the secondary transfer roller and the opposed roller, the intermediate transfer belt being arranged to pass through the nip portion, and the transfer belt according to claim 1 being employed as the intermediate transfer belt.

5. The image formation apparatus according to claim 4, wherein a surface of the secondary transfer roller is higher in hardness than a surface of the opposed roller.

* * * * *